US011319741B2

(12) United States Patent
Talpe

(10) Patent No.: US 11,319,741 B2
(45) Date of Patent: May 3, 2022

(54) HYDRAULICALLY DAMPED ACTUATOR

(71) Applicant: LOCINOX, Waregem (BE)

(72) Inventor: Joseph Talpe, Heestert-Zwevegem (BE)

(73) Assignee: LOCINOX, Waregem (BE)

( * ) Notice: Subject to any disclaimer, the term of this patent is extended or adjusted under 35 U.S.C. 154(b) by 0 days.

(21) Appl. No.: 16/621,194

(22) PCT Filed: Mar. 22, 2018

(86) PCT No.: PCT/EP2018/057381
§ 371 (c)(1),
(2) Date: Dec. 10, 2019

(87) PCT Pub. No.: WO2018/228729
PCT Pub. Date: Dec. 20, 2018

(65) Prior Publication Data

US 2020/0240189 A1 Jul. 30, 2020

(30) Foreign Application Priority Data

Jun. 16, 2017 (WO) ..... PCT/EP2017/064840
Nov. 3, 2017 (EP) ..... 17200017

(51) Int. Cl.
*E05F 3/20* (2006.01)
*E05F 3/12* (2006.01)
*E05F 3/10* (2006.01)

(52) U.S. Cl.
CPC ..... *E05F 3/20* (2013.01); *E05F 3/12* (2013.01); *E05F 3/102* (2013.01);
(Continued)

(58) Field of Classification Search
CPC .... E05F 3/20; E05F 3/12; E05F 3/102; E05Y 2900/132; E05Y 2201/696; E05Y 2400/854; E05Y 2800/174; Y10T 16/2771
See application file for complete search history.

(56) References Cited

U.S. PATENT DOCUMENTS 2,325,711 A * 8/1943 Seaman ..... E05F 3/10 16/54
5,152,029 A * 10/1992 Pai ..... E05D 5/10 16/54

(Continued)

FOREIGN PATENT DOCUMENTS

EP 2186983 A1 * 5/2010 ..... E05F 3/08
EP 3162997 A1 5/2017
GB 500834 A 2/1939

OTHER PUBLICATIONS

International Search Report dated Sep. 18, 2018, issued in corresponding International Application No. PCT/EP2018/057381, filed Mar. 22, 2018, 6 pages.

(Continued)

*Primary Examiner* — Victor D Batson
*Assistant Examiner* — Matthew J Sullivan
(74) *Attorney, Agent, or Firm* — Christensen O'Connor Johnson Kindness PLLC

(57) ABSTRACT

A hydraulically damped actuator closes a hinged closure system. The actuator includes an energy storing mechanism that stores energy when the closure system is being opened and restores the energy to effect closure of the closure system. A hydraulic damping mechanism damps the closing movement of the closure system. The actuator further includes a tubular cylinder barrel with first and a second ends and a rotatable shaft with first and a second extremities. The shaft extends through the tubular cylinder barrel. Both extremities of the shaft are available to be connected with a mechanical connector that transfers rotation of the closure system to the shaft, which allows the actuator to be mounted in two opposing orientations depending on the handedness of the closure system.

21 Claims, 39 Drawing Sheets

(52) U.S. Cl.
CPC ... *E05Y 2201/256* (2013.01); *E05Y 2201/412* (2013.01); *E05Y 2600/10* (2013.01); *E05Y 2900/132* (2013.01); *E05Y 2900/40* (2013.01)

(56) References Cited

U.S. PATENT DOCUMENTS

| | | | | | |
|---|---|---|---|---|---|
| 5,383,253 | A * | 1/1995 | Lin | E05F 3/20 | 16/299 |
| 6,618,902 | B2 * | 9/2003 | Wu | E05F 1/1215 | 16/298 |
| 7,516,519 | B2 * | 4/2009 | Talpe | E05F 1/1215 | 16/316 |
| 9,926,732 | B2 * | 3/2018 | Bacchetti | E05F 3/20 | |
| 10,280,670 | B2 * | 5/2019 | Roberts | E05F 1/1025 | |
| 10,837,213 | B2 * | 11/2020 | Talpe | E05F 3/12 | |
| 10,858,873 | B2 * | 12/2020 | Talpe | E05F 3/20 | |

OTHER PUBLICATIONS

Written Opinion of the International Searching Authority dated Sep. 18, 2018, issued in corresponding International Application No. PCT/EP2018/057381, filed Mar. 22, 2018, 12 pages.

International Preliminary Report on Patentability dated Dec. 17, 2019, issued in corresponding International Application No. PCT/EP2018/057381, filed Mar. 22, 2018, 1 page.

* cited by examiner

HYDRAULICALLY DAMPED ACTUATOR

The present invention relates to a hydraulically damped actuator for closing a closure system having a first member and a second member that are hingedly connected to each other. The actuator comprises a tubular cylinder barrel having a longitudinal axis, a first end and a second end. The actuator further comprises an energy storing mechanism inside the tubular cylinder barrel configured for storing energy when said closure system is being opened and for restoring said energy to effect closure of said closure system and a hydraulic damping mechanism inside the tubular cylinder barrel configured for damping a closing movement of said closure system. The damping mechanism comprises a piston configured to be slidable within said tubular cylinder barrel between two extreme positions in the direction of said longitudinal axis. The actuator also comprises a shaft that is rotatable with respect to said tubular cylinder barrel, said shaft having a first extremity, a second extremity, and a rotation axis that extends in said longitudinal axis, the shaft being configured for operatively coupling the energy storing mechanism and the damping mechanism and a mechanical connector configured for operatively coupling the shaft to said second member.

The actuator of the present invention is typically used in a closure system having a vertical support, e.g. a post, and a closure member hingedly connected thereto. The actuator is then mounted with its longitudinal axis in a vertical orientation and may or may not coincide with the hinge axis of the closure system. However, in cases where the longitudinal axis does not coincide with the hinge axis, the actuator and the mechanical connector typically connect on opposite sides of the hinge axis, i.e. the actuator is mounted to the closure system on one side of the hinge axis while the mechanical connector is mounted to the closure system on the opposite side of the hinge axis.

An actuator having a longitudinal axis which is in line with the hinge axis is known from EP-A-3 162 997 and is typically used in a closure system having a vertical support and a closure member that are hingedly connected using an eye bolt hinge. The actuator is mounted to the post using a support and the mechanical connector directly engages the bolt portion of the eye bolt hinge. The support substantially encloses the tubular cylinder barrel enabling the cylinder barrel to rotate freely within the support. In order to be suitable for both a left-handed and a right-handed closure system, the mechanical connector is rotatably mounted on the support and has two openings to insert a first pin. Inserting the first pin into the first opening locks the mechanical connector to the shaft, while, inserting the first pin into the second opening locks the mechanical connector to the cylinder barrel. When the mechanical connector is locked to the shaft, the cylinder barrel is locked to the support by a second pin. Similarly, when the mechanical connector is locked to the cylinder barrel, the shaft is locked to the support by the second pin. Due to the interchangeability of the first and the second pin in the sense that either the shaft follows the rotation of the closure member with the cylinder barrel being fixed or the cylinder barrel follows the rotation of the closure member with the shaft being fixed, the known actuator is suited for a left-handed and a right-handed closure system.

A drawback of the known actuator is that, due to the required support, the vertical distance between the eye bolt hinge and the energy storing mechanism is substantial. In other words, the rotational motion of the closure system has to be transmitted over a substantial vertical distance resulting in substantial torque on the mechanical connector, which may possibly damage the connector and/or the pin connections to the shaft or the cylinder barrel.

Another drawback of the known actuator is that, because the cylinder barrel may rotate within the support, depending on the handedness of the closure system, there may also be substantial friction that impedes the rotational motion of the cylinder barrel, which may lead to a malfunction of the actuator. Moreover, because the known actuator is typically used outdoors, there is a real possibility that dirt and/or water may enter the space between the support and the cylinder barrel via one of the multiple openings in the support, which dirt and/or water may further increase the friction between the cylinder barrel and the support. Furthermore, water that has entered the space between the support and the cylinder barrel may also freeze, thereby expanding and possibly causing damage to the support and/or the tubular cylinder barrel. Finally, the support around the tubular cylinder barrel increases the outer diameter of the actuator. This diameter is however limited due the fact that the actuator is usually mounted on a post having a limited width.

Another drawback of such actuators is that they have multiple openings for mounting the mechanical connector onto the actuator such that the actuator may be used for both right-handed and left-handed closure systems. This can cause confusion during installation of the actuator.

Moreover, the known actuator has a tubular cylinder barrel which is formed from three different sections, i.e. a section housing the energy storing mechanism and two sections each housing parts of the hydraulic damping mechanism. These sections are slid into one another with the necessary seals therebetween. However, such a construction is complex and the seals may degrade over time causing leaks of hydraulic fluid. Further, the overall strength of the tubular cylinder barrel is reduced due to its section-wise construction.

Furthermore, it has been found that the known actuator is difficult to mount on the closure system. Specifically, the known actuators are designed such that, when the energy storing mechanism reaches its minimum energy, i.e. the relaxed position of the actuator with the piston is in one of its extreme positions, the relative position of the mechanical connector with respect to the tubular cylinder barrel does not correspond to the closed position of the closure system. In fact, the actuator is designed such that, when it is mounted and the closure system is closed, there is still a force exerted onto the closure system to urge it to close, i.e. the piston has not reached its extreme position. This design is deliberate to ensure proper closing of the closure system in cases where the support and the closure member are not perfectly aligned. In a perfectly aligned closure system, the actuator would, for example, theoretically be able to rotate the closure member up to 15 degrees beyond the closed position of the closure system. Consequently, when mounting the actuator onto the closure system, it is necessary to rotate the mechanical connector, typically over 15 degrees, to achieve alignment between the mechanical connector and the tubular cylinder barrel on the one hand and the closed closure system on the other hand. It has been found to be cumbersome and difficult, especially due to the large forces that may be exerted by the energy storing mechanism which may also have an amount of energy stored even in the relaxed state of the actuator, to have to rotate the mechanical connector manually to obtain the necessary alignment.

Another type of actuator is disclosed in EP-A-2 208 845. Such an actuator is typically mounted inside a closure member of the closure system with the shaft of the actuator forming the pivot axis of the closure member. Since the actuator is mounted in the closure member, the cylinder barrel is locked to the closure member and is thus rotating when the closure system is being opened or closed. The mechanical connector is attached to the shaft and to a support, e.g. a post or a ground surface, of the closure system ensuring that the shaft remains stationary when the closure system is being opened or closed.

A downside of this type of actuators is that they are only suitable for either a left-handed or a right-handed closure system, because the energy storing mechanism and the damping mechanism are only operational in a specific direction and the shaft is always stationary. Therefore, different actuators are needed for left-handed and right-handed closure systems.

It is an object of the present invention to provide a hydraulically damped actuator useable for both a left-handed and a right-handed closure system which has, especially when used outdoors, an improved reliability.

This object is achieved according to a first embodiment of the invention in that the shaft extends at least from said first end to said second through the tubular cylinder barrel, in that said tubular cylinder barrel is configured to be fixed to the first member of the closure system with its longitudinal axis in a first orientation for a right-handed closure system and in a second orientation, which second orientation is opposite to the first orientation, for a left-handed closure system, and in that the mechanical connector is configured to be connected to the first extremity of the shaft when the tubular cylinder barrel is with its longitudinal axis in said first orientation and to the second extremity of the shaft when the tubular cylinder barrel is with its longitudinal axis in said second orientation.

Because the shaft extends at least from said first end to said second through the tubular cylinder barrel, the first extremity of the shaft is situated at or near the first end of the tubular cylinder barrel or outside the tubular cylinder barrel and the second extremity of the shaft is situated at or near the second end of the tubular cylinder barrel or outside the tubular cylinder barrel. As such, both extremities are available to be connected with the mechanical connector which enables an easy solution to provide an actuator for both left-handed and right-handed closure systems. Specifically, for a right-handed closure system, the cylinder barrel is mounted with its longitudinal axis in a first orientation (e.g. upright or upside down) and the mechanical connector is mounted to the first extremity of the shaft. This ensures that the shaft, upon opening or closing the closure system, will rotate in a first direction (e.g. clockwise or counter-clockwise depending on how the energy storing mechanism and damping mechanism are configured) to drive the energy storing mechanism and damping mechanism. For a left-handed closure system, the cylinder barrel is mounted with its longitudinal axis in a second orientation that is opposite to the first orientation (e.g. upside down or upright) and the mechanical connector is mounted to the second extremity of the shaft. This ensures that the shaft, upon opening or closing the closure system, will again rotate in the first direction (e.g. clockwise or counter-clockwise depending on how the energy storing mechanism and damping mechanism are configured) to drive the energy storing mechanism and damping mechanism.

Furthermore, by mounting the cylinder barrel upside down for differently handed closure systems and attaching the mechanical connector to the relevant extremity of the shaft, for a given type of closure system (i.e. mounted onto a fixed support as in EP-A-3 162 997 or mounted inside a moveable closure member as in EP-A-2 208 845), either the shaft will rotate with respect to the fixed tubular cylinder barrel or the tubular cylinder barrel will rotate with respect to the fixed shaft irrespective off the handedness of the closure system. Thus, the actuator according to the present invention does not require an additional support in which the tubular cylinder barrel needs to rotate. Therefore, the actuator according to the present invention has an improved reliability because the risk that the actuator will malfunction due to friction between the cylinder barrel and the support is avoided altogether.

Furthermore, omitting the support also enables the tubular cylinder barrel to have a larger diameter without exceeding the width of the support. As such, the internal mechanisms may also be enlarged, thereby improving the robustness of the actuator.

Moreover, the actuator according to the present invention also does not require multiple locking mechanism as in the known actuators in order to be suitable for both left-handed and right-handed closure systems. In other words, the actuator according to the present invention is also less complex when compared to the known actuators.

Finally, the omission of the support enables the vertical distance between the eye bolt hinge and the energy storing mechanism to be smaller when compared to the known actuators. Therefore, the rotational motion of the closure system has to be transmitted over a smaller vertical distance resulting in less torque being exerted on the mechanical connector.

This object is also achieved according to a second embodiment of the invention, wherein the mechanical connector is configured for operatively coupling the tubular cylinder barrel instead of the shaft, to said second member, in that the shaft extends at least from said first end to said second through the tubular cylinder barrel, in that said shaft is configured to be irrotatably fixed at its first and its second extremity to the first member of the closure system with its longitudinal axis in a first orientation for a right-handed closure system and in a second orientation, opposite to the first orientation, for a left-handed closure system, and in that the mechanical connector is configured to be irrotatably fixed to said tubular cylinder barrel.

Because the shaft extends at least from said first end to said second through the tubular cylinder barrel, the first extremity of the shaft is situated at or near the first end of the tubular cylinder barrel or outside the tubular cylinder barrel and the second extremity of the shaft is situated at or near the second end of the tubular cylinder barrel or outside the tubular cylinder barrel. As such, both extremities are available to be fixed to the first member of the closure system while the tubular cylinder barrel is used to affix the mechanical connector which enables an easy solution to provide an actuator for both left-handed and right-handed closure systems. Specifically, for a right-handed closure system, the cylinder barrel is mounted with its longitudinal axis in a first orientation (e.g. upright or upside down). This ensures that the shaft, upon opening or closing the closure system, will rotate in a first direction (e.g. clockwise or counter-clockwise depending on how the energy storing mechanism and damping mechanism are configured) to drive the energy storing mechanism and damping mechanism. For a left-handed closure system, the cylinder barrel is mounted with its longitudinal axis in a second orientation that is opposite to the first orientation (e.g. upside down or upright). This ensures that the shaft, upon opening or closing the closure system, will again rotate in the first direction (e.g. clockwise or counter-clockwise depending on how the energy storing mechanism and damping mechanism are configured) to drive the energy storing mechanism and damping mechanism.

Consequently, the second embodiment of the invention achieves the same advantages as were described above for the first embodiment of the invention.

It is another object of the present invention to provide a hydraulically damped actuator having an improved strength.

This object is achieved according to a third embodiment of the invention in that said tubular cylinder barrel has a first tubular part and a second tubular part separated by an inner collar on the tubular cylinder barrel, the energy storing mechanism being located in said first tubular part and the damping mechanism being located in said second tubular part. Preferably, the first tubular part has an inner diameter which decreases form said first end towards the collar and the second tubular part has an inner diameter which decreases form said second end towards the collar.

The collar separates the energy storing mechanism and the hydraulic damping mechanism and enables the provision of an integrally formed tubular cylinder barrel, i.e. the first and second tubular parts are integrally formed, thus avoiding a tubular cylinder barrel constructed from different sections as in EP-A-3 162 997, thereby improving the strength of the actuator. Moreover, the decreasing inner diameters allow to insert all the elements of the energy storing mechanism from the first end of the tubular cylinder barrel into the first tubular part and all the elements of the hydraulic damping mechanism from the second end of the tubular cylinder barrel into the second tubular part due to the decreasing diameter. As such, the actuator can be conveniently assembled.

It will be readily appreciated that features from the third embodiment of the invention may be used in combination with features from either the first or second embodiments of the invention.

In an embodiment of the present invention the actuator comprises: a first roller bearing, in particular a double roller bearing, preferably a ball bearing, interposed between the shaft and the tubular cylinder barrel, said first roller bearing having an inner race and an outer race, the inner race of the first roller bearing axially engaging a first transverse surface that is, in the direction of said longitudinal axis, in a fixed position with respect to the shaft, the outer race of the first roller bearing axially engaging a second transverse surface that is, in the direction of said longitudinal axis, in a fixed position with respect to the tubular cylinder barrel, the outer race of the first roller bearing preferably radially engaging said tubular cylinder barrel; and a second roller bearing, in particular a double roller bearing, preferably a ball bearing, interposed between the shaft and the tubular cylinder barrel, said second roller bearing having an inner race and an outer race, the inner race of the second roller bearing axially engaging a third transverse surface that is, in the direction of said longitudinal axis, in a fixed position with respect to the shaft, the outer race of the second roller bearing axially engaging a fourth transverse surface that is, in the direction of said longitudinal axis, in a fixed position with respect to the tubular cylinder barrel, the outer race of the second roller bearing preferably radially engaging said tubular cylinder barrel. Preferably, said first and third transverse surfaces are located on the outside of said first and second roller bearings and said second and fourth transverse surfaces are located in between said first and second roller bearings.

Such a configuration is advantageous when considering that the shaft may be subjected to a force in the direction of the longitudinal axis, which may, for example, be generated by the damping mechanism. In either direction of the force, the shaft will transmit the force, via the first or the third transverse surface, to the inner race of either the first or the second roller bearing. The roller bearings will transfer this force to their outer race and thus to the tubular cylinder barrel, via the second or the fourth transverse surface. In other words, the configuration of the roller bearings ensures that the shaft is securely fixed in the direction of the longitudinal axis.

In an embodiment of the present invention the actuator further comprises: a first connection member irrotatably fixed to said first extremity, in particular by a first member pin that is placed through the shaft and through the first connection member in a direction that is transverse to said longitudinal axis, said first connection member forming said first transverse surface, the inner race of the first roller bearing preferably radially engaging said first connection member; and a second connection member irrotatably fixed to said second extremity, in particular by a second member pin that is placed through the shaft and through the second connection member in a direction that is transverse to said longitudinal axis, the second member pin preferably being offset with respect to the rotation axis of the shaft, said second connection member forming said third transverse surface, the inner race of the second roller bearing preferably radially engaging said second connection member, the mechanical connector being configured to be affixed to said first connection member when the tubular cylinder barrel is in said first orientation and to said second connection member when the tubular cylinder barrel is in said second orientation.

In this embodiment, the connection members are directly coupled to the mechanical connector with the roller bearings each axially engaging one of the connection members. As such, longitudinal forces generated by the closure member will be transmitted to the support via the roller bearings, thereby avoiding that such forces are transferred to the internal mechanisms of the actuator.

In an embodiment of the present invention the first connection member comprises at least one right-handed orientation member, the second connection member comprises at least one left-handed orientation member, and the mechanical connector comprises at least one orientation member, said right-handed orientation member and said orientation member being configured such that, when the tubular cylinder barrel is with its longitudinal axis in said first orientation, the mechanical connector is oriented for a right-handed closure system, said left-handed orientation member and said orientation member being configured such that, when the tubular cylinder barrel is with its longitudinal axis in said second orientation, the mechanical connector is oriented for a left-handed closure system.

In this embodiment, the mechanical connector is always correctly oriented, thereby avoiding mistakes that may be made when installing the actuator.

In an embodiment of the present invention the actuator further comprises: a first fixation member disposed around the shaft adjacent to said first roller bearing, said first fixation member preferably forming said second transverse surface; a second fixation member disposed around the shaft adjacent to said second roller bearing, said second fixation member preferably forming said fourth transverse surface; at least one first bolt opening that extends through the tubular cylinder barrel and said first fixation member in a direction transverse to said longitudinal axis, said at least one first bolt opening being configured for inserting a bolt to fix the actuator to the first member of the closure system; and at least one second bolt opening that extends through the tubular cylinder barrel and said second fixation member in a direction transverse to said longitudinal axis, said at least one second bolt opening being configured for inserting a bolt to fix the actuator to the first member of the closure system.

In this embodiment, two fixation members are provided around the shaft adjacent to the roller bearings. In other words, the fixation members are provided inside the tubular cylinder barrel. This provides a strong fixation of the actuator to the support that is able to large forces, which is especially beneficial when the fulcrum between the hinge axis of the closure system and the mechanical connector is small. It is especially advantageous that these fixation members form the second and the fourth transverse surface, since longitudinal forces exerted onto the roller bearings are then directly transferred to the support.

In an embodiment of the present invention the tubular cylinder barrel is configured to be fixed to said first member with said longitudinal axis substantially coinciding with the hinge axis of the closure system.

In this embodiment, the actuator is suitable for a closure system that is able to be rotated about more than 90° and up to 180°.

In an embodiment of the present invention said first member is a moveable closure member, the tubular cylinder barrel being configured to be mounted on or preferably inside said first member.

The cylinder barrel can for example be mounted on the side of the moveable closure member facing the fixed support. Preferably, the cylinder barrel is mounted inside the moveable closure member. This embodiment has the advantage that the actuator is hidden from view. Moreover, when there is not enough space to fix the actuator on the support, inserting the actuator in the closure member provides a solution.

In an embodiment of the present invention said second member is a fixed support and said actuator forms a hinge for hinging the first member to the second member, a roller bearing, in particular a ball bearing, being preferably provided between the said mechanical connector and the tubular cylinder barrel.

In this embodiment, an actuator of the type disclosed in EP-A-2 208 845 is provided that is useable for both a left-handed and a right-handed closure system. Furthermore, the roller bearing enables a smooth rotation of the closure member and may be used to support the closure member thereby avoiding excess forces being borne by the internal mechanisms of the actuator.

In an embodiment of the present invention said second member is a moveable closure member, the mechanical connector comprising a rotating arm that is configured to be connected to said second member, said rotating arm having a proximal part that is irrotatably fixed with respect to the shaft.

This embodiment offers the possibility to fix the actuator to the support.

In an embodiment of the present invention said proximal part has at least one, preferably at least two, pair of first fixation elements, and in that both the first connection member and the second connection member each comprise at least two, preferably at least three, pairs of second fixation elements, the first fixation elements and the second fixation elements being configured to be fixed to one another with rotating arm in at least two, preferably at least three, different possible angular orientations with respect to the shaft.

In this embodiment, the orientation of the extended arm with respect to the actuator may be changed. This is advantageous as it enables to compensate for changes in the relative positioning of the support and the closure member.

In an embodiment of the present invention said rotating arm has a portion that extends substantially in the direction of said longitudinal axis, said portion being configured for interlocking with a portion of the hinge of the closure system which is fixed to the second member.

In this embodiment, an actuator of the type disclosed in EP-A-3 162 997 is provided. As such, there is no need for the actuator to comprise a relatively long rotating arm to connect the actuator to the closure member. Instead, a direct connection can be made with the closure member to transmit the rotation of closure member to the energy storing and damping mechanisms.

In an embodiment of the present invention the tubular cylinder barrel is extrusion moulded with the first tubular part and the second tubular part being integrally formed therein by bore milling.

In this embodiment, the collar is integrally formed with the tubular cylinder barrel, which is itself also integrally formed, thereby providing a substantially leak-free barrier between the first tubular part and the second tubular part.

In an embodiment of the present invention the collar is formed by an annular element which is fixed within the tubular cylinder barrel, in particular by means of at least one bolt or pin which extends transversally through the tubular cylinder barrel, with a seal being preferably pressed between the tubular cylinder barrel and the annular element or the annular element itself forming a seal.

This embodiment provides an alternative way to obtain a collar within the tubular cylinder barrel.

In an embodiment of the present invention the damping mechanism comprises: a closed cylinder cavity in said second tubular part which is filled with a volume of hydraulic fluid; said piston which is disposed within the closed cylinder cavity so as to divide the closed cylinder cavity into a high pressure compartment and a low pressure compartment, the piston being operatively coupled to said shaft to be slidable between said two extreme positions the shaft extending preferably through said piston, in particular through the centre thereof; a motion converting mechanism to convert a relative rotational motion of the shaft with respect to the tubular cylinder barrel into a sliding motion of the piston; a one-way valve allowing fluid flow from the low pressure compartment to the high pressure compartment when said closure system is being opened; and at least one restricted fluid passage between the high pressure compartment and the low pressure compartment.

In this embodiment, the rotation of the closure system is transferred to either the tubular cylinder barrel or the shaft via the mechanical connector with the other one remaining stationary as described above. For both a right-handed and a left-handed closure system the motion converting mechanism will convert a rotational motion of the shaft with respect to said tubular cylinder barrel into a translational motion of the piston in the direction of the longitudinal axis. Due to the one-way valve the closure system is easily opened, while, due to the restricted fluid passage, the piston will damp the closing movement of the closure system.

In an embodiment of the present invention, the closed cylinder cavity is in said second tubular part.

In an embodiment of the present invention the actuator comprises at least one adjustable valve to regulate a flow of hydraulic fluid through said at least one restricted fluid passage.

This embodiment enables adjusting the rotational speed of the closing movement of the closure system.

In an embodiment of the present invention said at least one restricted fluid passage comprises: a first restricted fluid passage configured for regulating a closing speed of the closure system; and a second restricted fluid passage configured for regulating an end stroke of a closing movement of the closure system.

This embodiment enables both the rotational speed and the end stroke of the closing movement of the closure system.

In an embodiment of the present invention said at least one restricted fluid passage is formed in the shaft and comprises a bore that extends substantially in the direction of said longitudinal axis and terminates in an end face of the shaft at the second extremity thereof, said at least one adjustable valve being placed in said bore.

In this embodiment, the restricted fluid passage(s) is/are formed in the shaft which is space efficient. As the adjustable valve(s) is/are placed in said bore in the shaft, it/they are accessible when the actuator is mounted on the closure system irrespective of the orientation of the actuator. As such, the valve(s) may be adjusted when the actuator is mounted to the closure system.

In an embodiment of the present invention said at least one restricted fluid passage comprises: a first section that is formed in the tubular cylinder barrel and extends substantially in the direction of said longitudinal axis; and a second section that is formed in said collar and extends substantially in a direction transverse to said longitudinal axis, said at least one adjustable valve being arranged in said second section. Preferably, said adjustable valve is located substantially in the middle between the first and the second extremity of the shaft.

In this embodiment, the restricted fluid passage(s) is/are formed in the tubular cylinder barrel which enables positioning the adjustable valve(s) in the collar. This provides a solution to the problem that, when the actuator is mounted inside the closure member, the extremity of the shaft is not always readily accessible. As such, positioning the adjustable valve(s) in the shaft is not convenient. However, when the adjustable valve(s) is/are located in the collar, they can be accessed by providing openings in the closure member irrespective of the orientation of the actuator due to the fact that the collar is located centrally with respect to the actuator.

In an embodiment of the present invention the motion converting mechanism comprises a rotation prevention mechanism to prevent rotation of the piston in the closed cylinder cavity, the rotation prevention mechanism comprising a guiding element that is bolted to said collar, the piston being irrotatably and slideably in the direction of said longitudinal axis coupled to the guiding element. Alternatively, the guiding element may be formed by said annular element that forms said collar.

By bolting the guiding element to the collar or by the guiding element forming the collar, the guiding element is securely fixed to the tubular cylinder barrel. Specifically, it is ensured that, the guiding element will not rotate with respect to the tubular cylinder barrel. As such, even when the piston is subjected to large rotational forces, e.g. when the closure systems has a heavy closure member or when the motion converting mechanism comprises threaded portions having a screw thread with a large lead angle, the piston will only be slideable within the closed cylinder cavity.

In an embodiment of the present invention the shaft is integrally formed between its first and second extremity.

This provides a strong shaft that is able to withstand large forces, which is especially beneficial when the energy storing mechanism comprises a spring having a large spring constant, typically necessary for closure systems having a heavy closure member.

In an embodiment of the present invention the energy storing mechanism comprises: a first actuation member that is irrotatably fixed with respect to the tubular cylinder barrel; a second actuation member that is irrotatably fixed with respect to the shaft; and a torsion spring having a first extremity connected to said first actuation member and a second extremity connected to said second actuation member.

The torsion spring provides a simple design to store energy from opening the closure system.

In an embodiment of the present invention an annular element forms both said first actuation member and said first fixation member.

By having an annular element that acts as both the first actuation member and the first fixation member, the actuator may be made more compact.

In an embodiment of the present invention said collar forms said first actuation member.

By having the collar act as the first actuation member, there is no need to provide an additional element to form the first actuation member. As such, the actuator may be made more compact.

In an embodiment of the present invention the first actuation member is irrotatably fixed to the tubular cylinder barrel by a first actuation member pin that is preferably placed through the tubular cylinder barrel shaft and through the first actuation member in a direction that is transverse to said longitudinal axis, and in that the second actuation member is irrotatably fixed to the shaft by a second actuation member pin that is preferably placed through the shaft and through the second actuation member in a direction that is transverse to said longitudinal axis, the cylinder barrel having an opening enabling to insert the second actuation member pin in said direction into the cylinder barrel to be placed through the shaft and through the second actuation member. Preferably, the second actuation member is provided with a hole to receive the second actuation member pin, the second actuation member pin being locked in said hole, in particular by mechanically deforming the inlet opening of the hole after having inserted the second actuation member pin therein.

The pins, especially when they are transversally inserted, ensure a reliable connection between the tubular cylinder barrel and the first actuation member and between the shaft and the second actuation member.

In an embodiment of the present invention the tubular cylinder barrel is integrally formed.

This provides a strong tubular cylinder that is able to withstand large forces. Moreover, this enable to provide a tubular cylinder barrel having a thin outside wall without sacrificing the required robustness of the tubular cylinder barrel. Furthermore, this contributes to ensuring that the closed cylinder cavity is substantially leak-free.

It is a further object of the present invention to provide an actuator that may be easily mounted onto the closure system.

This further object is achieved according to the present invention by an actuator further comprising: a first mounting aid removably interposed between said first extremity and the tubular cylinder barrel to maintain the shaft in a partially rotated position with respect to the tubular cylinder barrel, said partially rotated position corresponding to a partially opened closure system; and a second mounting aid removably interposed between said second extremity and the tubular cylinder barrel to maintain the shaft in said partially rotated position with respect to the tubular cylinder barrel. Which actuator may be mounted onto the closure system by a method comprising the steps of: a) providing the actuator with the first and second mounting aids; b) irrotatably fixing the tubular cylinder barrel to said first member with its longitudinal axis in said first orientation for a right-handed closure system or in said second orientation for a left-handed closure system; c) removing either the first mounting aid for a right-handed closure system or the second mounting aid for a left-handed closure system; d) connecting, after step c), the mechanical connector either to the first extremity of the shaft for a right-handed closure system or to the second extremity of the shaft for a left-handed closure system; e) connecting, after step c), the mechanical connector to said second member; and f) removing, after steps d) and e), either the first mounting aid for a left-handed closure system or the second mounting aid for a right-handed closure system.

The removably interposed mounting aids ensure that a specific predefined position of the shaft with respect to the tubular cylinder body is maintained, which specific position may be chosen to be any position of the piston between its most extreme positions. Consequently, the mounting aids are able to maintain a relative positioning between the shaft, and thus the piston, and the tubular cylinder body that corresponds to a partially opened position of the closure system. For example, the mounting aids may be designed such that the shaft is rotated 30 degrees with respect to its relaxed position, which would then correspond to a closure system that is 15 degrees opened. Only removing a single of the disposable mounting aids does not affect the positioning of the shaft with respect to the tubular cylinder body. As such, when the mechanical connector is fixed to the shaft, after having removed a single one of the mounting aids, the mechanical connector is oriented based on the relative positioning between the shaft and the tubular cylinder body and may therefore also be rotated, for example over 30 degrees, with respect to its zero position when the energy storing mechanism has reached its minimum energy due to the piston being in one of its extreme positions. The fixed relative positioning of the mechanical connector makes it easier to mount the actuator to the closure system as it is now the closure system, e.g. the second member, that needs to be aligned with respect to the mechanical connector, which closure system is easy to rotate as there is no tension exerted thereon. In other words, the fixed relative positioning of the mechanical connector thus avoids the need for rotating the mechanical connector to align with the closure system as was the case with the actuator disclosed in EP-A-3 162 997, thereby making it easier to mount the actuator. Once the mechanical connector is fixed to the second member and the tubular cylinder barrel to the first member, the remaining disposable mounting aid is removed and the closure system will close due to the actuator. After mounting the actuator, the mounting aids may be disposed.

However, the above described method is not suitable for actuators that have to be mounted inside the closure member as the removal of the last mounting aid should happen after having mounted the actuator inside the closure member at which point the last mounting aid is no longer accessible. Consequently, for an actuator according to the present invention of the type disclosed in EP-A-2 208 845, this further object is achieved according to the present invention by an actuator further comprising: a first mounting aid removably interposed between said first extremity and the tubular cylinder barrel to maintain the shaft in a partially rotated position with respect to the tubular cylinder barrel, said partially rotated position corresponding to a partially opened closure system; a second mounting aid removably interposed between said second extremity and the tubular cylinder barrel to maintain the shaft in said partially rotated position with respect to the tubular cylinder barrel; and a further mounting aid configured to be removably interposed between the tubular cylinder barrel and the mechanical connector to maintain the shaft in said partially rotated position with respect to the tubular cylinder barrel when one of said first and second mounting aids has been removed. Which actuator may be mounted onto the closure system by a method comprising the steps of: a) providing the actuator with the first, second and further mounting aids; b) removing either the first mounting aid for a right-handed closure system or the second mounting aid for a left-handed closure system; c) connecting, after step b), the mechanical connector either to the first extremity of the shaft for a right-handed closure system or to the second extremity of the shaft for a left-handed closure system; d) interposing, after step c), the further mounting aid between the tubular cylinder barrel and the mechanical connector; e) removing, after step d), either the first mounting aid for a left-handed closure system or the second mounting aid for a right-handed closure system; f) irrotatably fixing, after step e), the tubular cylinder barrel to said first member with its longitudinal axis in said first orientation for a right-handed closure system or in said second orientation for a left-handed closure system; g) connecting, after step e), the mechanical connector to said second member; and h) removing, after steps f) and g), the further mounting aid.

As described above, the removably interposed mounting aids ensure that a specific predefined position of the shaft with respect to the tubular cylinder body is maintained, which specific position may be chosen to be any position of the piston between its most extreme positions. As such, when the mechanical connector is fixed to the shaft, after having removed a single one of the mounting aids, the mechanical connector is oriented based on the relative positioning between the shaft and the tubular cylinder body and may therefore also be rotated, for example over 30 degrees, with respect to its zero position when the energy storing mechanism has reached its minimum energy due to the piston being in one of its extreme positions. Once the mechanical connector, or a part thereof, has been mounted to the shaft, a further mounting aid is temporarily interposed between the mechanical connector and the tubular cylinder body, which further mounting aid also maintains the rotated position of the mechanical connector with respect to the relaxed position of the actuator. Therefore, the remaining mounting aid can now be removed before the actuator is inserted into the first member of the closure system and the relative positioning of the mechanical connector will be maintained due to the further mounting aid. As described above, this relative positioning of the mechanical connector makes it easier to mount the actuator to the closure system. Once the mechanical connector is fixed to the second member and the tubular cylinder barrel to the first member, the further mounting aid is removed and the closure system will close due to the actuator. After mounting the actuator, the first, second and further mounting aids may be disposed.

The disclosure will be further explained by means of the following description and the appended figures.

Figure 1A:
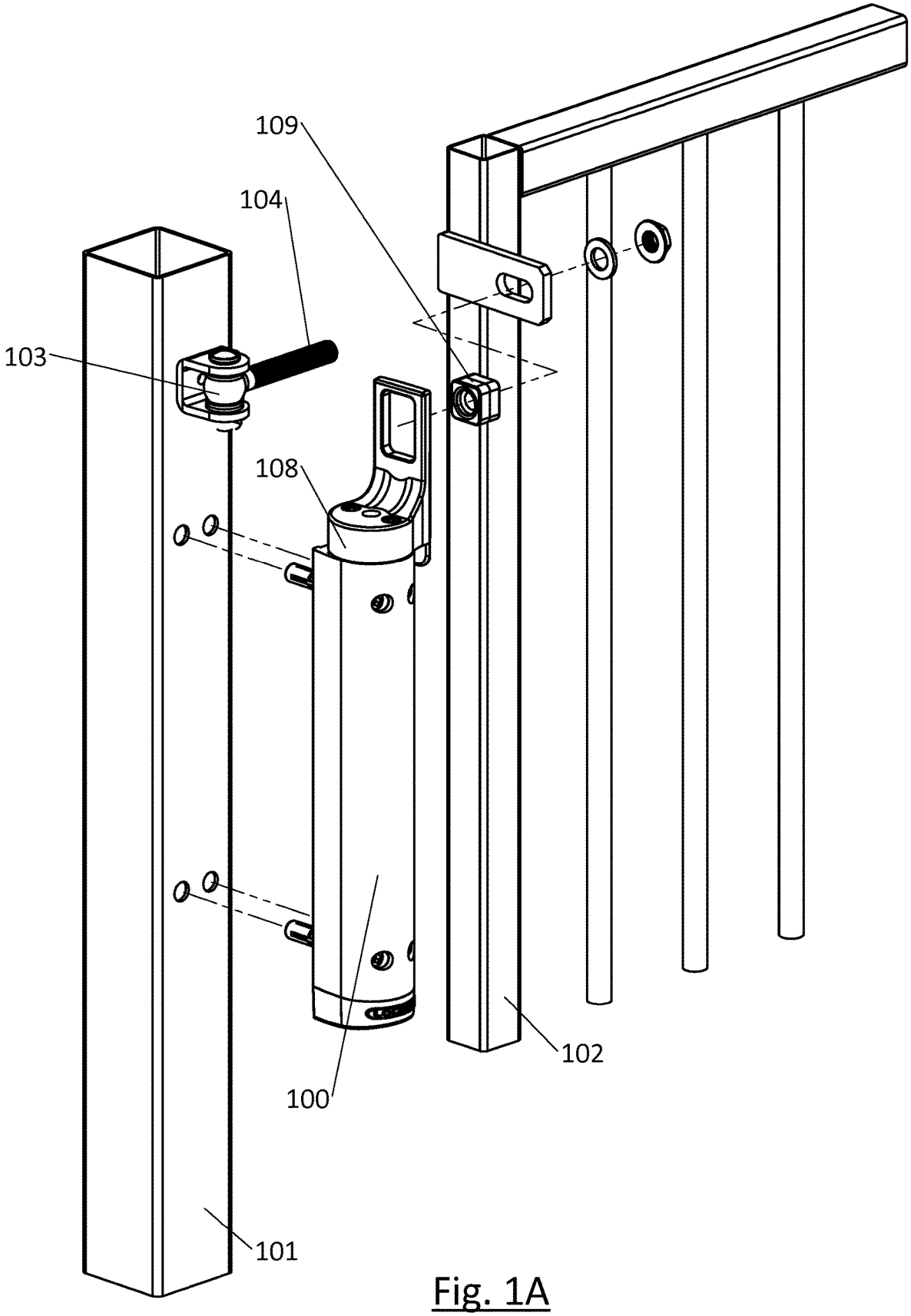
FIGS. 1A and 1B show how a hydraulically damped actuator according to an embodiment of the present invention is to be mounted onto a left-handed closure system and a right-handed closure system respectively.

The present invention will be described with respect to particular embodiments and with reference to certain drawings but the invention is not limited thereto but only by the claims.

Furthermore, the various embodiments, although referred to as "preferred" are to be construed as exemplary manners in which the invention may be implemented rather than as limiting the scope of the invention.

The invention generally relates to a hydraulically damped actuator 100 for closing a closure system having a first member and a second member that are hingedly connected to each other. The first member is typically a fixed support 101, such as a wall or a post, while the second member is typically a moveable closure member 102, such as a gate, a door, or a window. In particular, the hydraulically damped actuator 100 is designed for an outdoors closure system that may be subjected to large temperature variations. The actuator comprises an energy storing mechanism and a damping mechanism, both of which are operatively connected with the members of the closure system. The energy storing mechanism is configured for storing energy when the closure system is being opened and for restoring the energy to effect closure of the closure system. The damping mechanism is configured for damping a closing movement of the closure system and comprises a piston that is slideable along the longitudinal direction within the actuator between two extreme positions.

The main idea of the invention is to mount the actuator in differently oriented positions depending on the handedness of the closure system. Specifically, for a right-handed closure system, the actuator is mounted with its longitudinal axis in a first orientation (e.g. upright or upside down), while, for a left-handed closure system, the actuator is mounted with its longitudinal axis in a second orientation that opposite to the first orientation (e.g. upside down or upright). This enables the energy storing mechanism and the damping mechanism to operate in the same way for both a right-handed closure system and a left-handed closure system.

First Embodiment

FIGS. 1A through 7B illustrate an embodiment of a hydraulically damped actuator 100. In this embodiment, the actuator 100 is designed to be used in a closure system having a support 101 with a closure member 102 hingedly attached thereto by means of an eyebolt hinge 103. The eyebolt hinge 103 comprises a, preferably threaded, rod portion 104 which enables to adjust the distance between the closure member 102 and the support 101. More preferably, the closure member 102 is hinged to the support 101 with a hinge arranged in front of the support 201, described for example in EP-B-1 528 202.

Figure 2A:
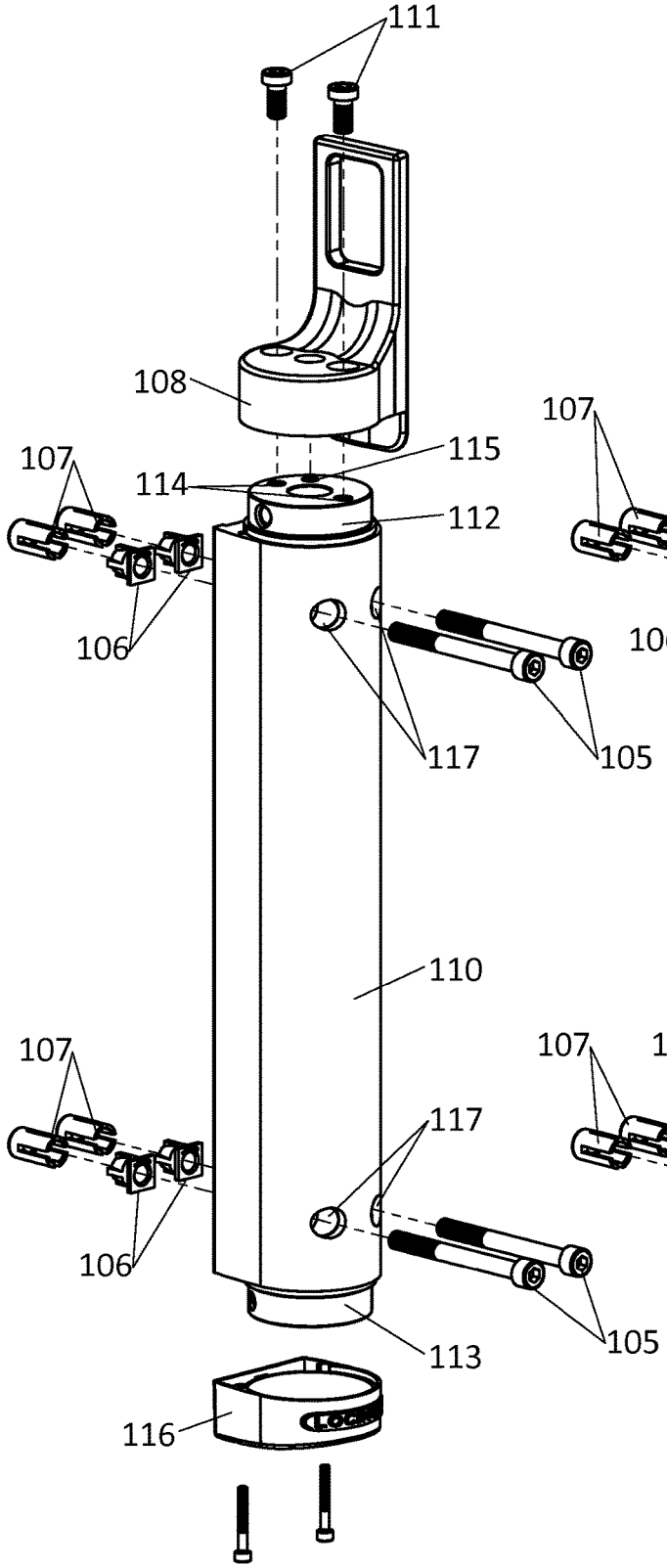
FIGS. 2A and 2B show how the mechanical connector element is mounted to the main body of the actuator of FIGS. 1A and 1B respectively.
Figure 2B:
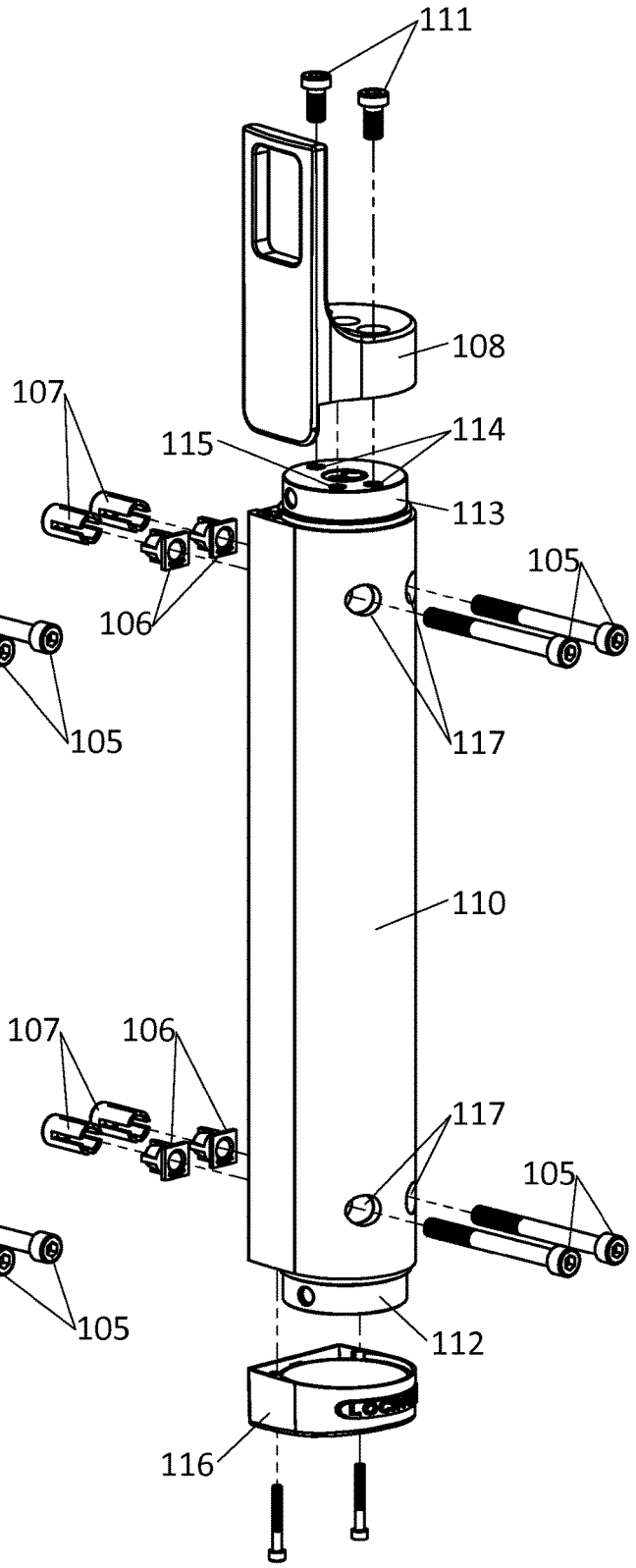

The actuator 100 is fixed to the support using four fixture sets as described in EP-B-1 907 712. In particular, as illustrated in FIGS. 2A and 2B, for each fixture set, a bolt 105 is inserted through the actuator 100 into a fixation element 106 having a square cross-section that fits into a square section (not shown) on the backside of the actuator 100. For each fixture set, the bolt 105 is screwed into an automatically fastening nut element 107 that is located inside the support 102. It will be readily appreciated that more or fewer fixture sets may also be used to fix the actuator 100 to the support 101.

Figure 1B:
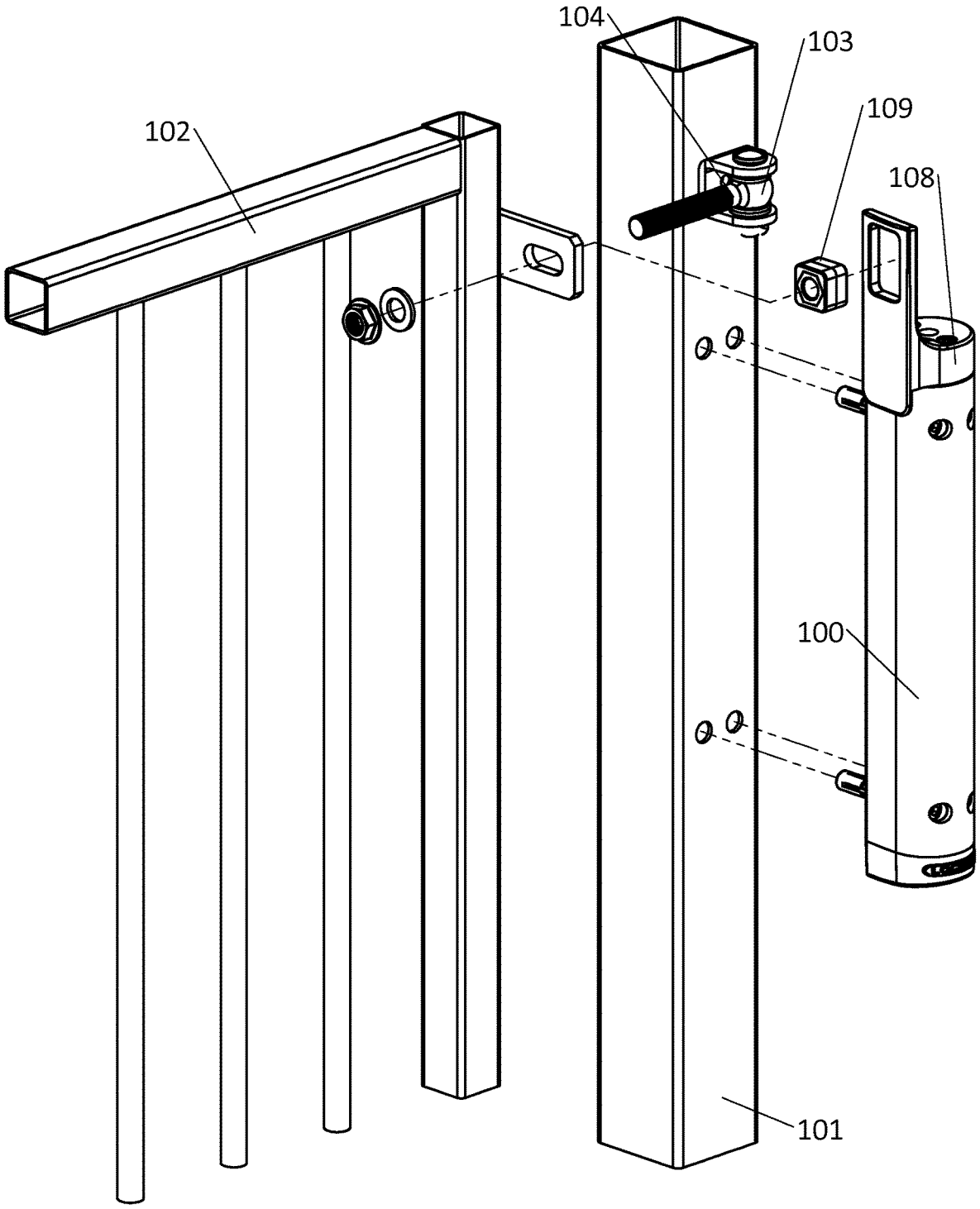

The actuator 100 further comprises a mechanical connector element 108 having an opening through which the arm of the eyebolt hinge 103 runs. Preferably, as illustrated in FIGS. 1A and 1B, a nut 109 is provided on the arm of the eyebolt hinge 103, which nut 109 is disposed in the opening of the mechanical connector element 108. As described in EP-A-3 162 997, when the closure member 102 is being opened or closed, the play of the nut 109 in the opening should preferably remain substantially constant upon rotation of the nut 109.

From FIGS. 1A and 1B, it is clear that the nut 109 is located close to the hinge axis 129 (illustrated in FIG. 3A) of the closure system. In other words, there is no long fulcrum between the nut 109, at which point forces are transmitted to and from the actuator 100, and the hinge axis 129. Moreover, the actuator 100 of the present embodiment is typically used for heavy closure members 102. Therefore, the actuator 100 of the present embodiment needs to be able to handle large forces in order to close the closure system.

Figure 3A:
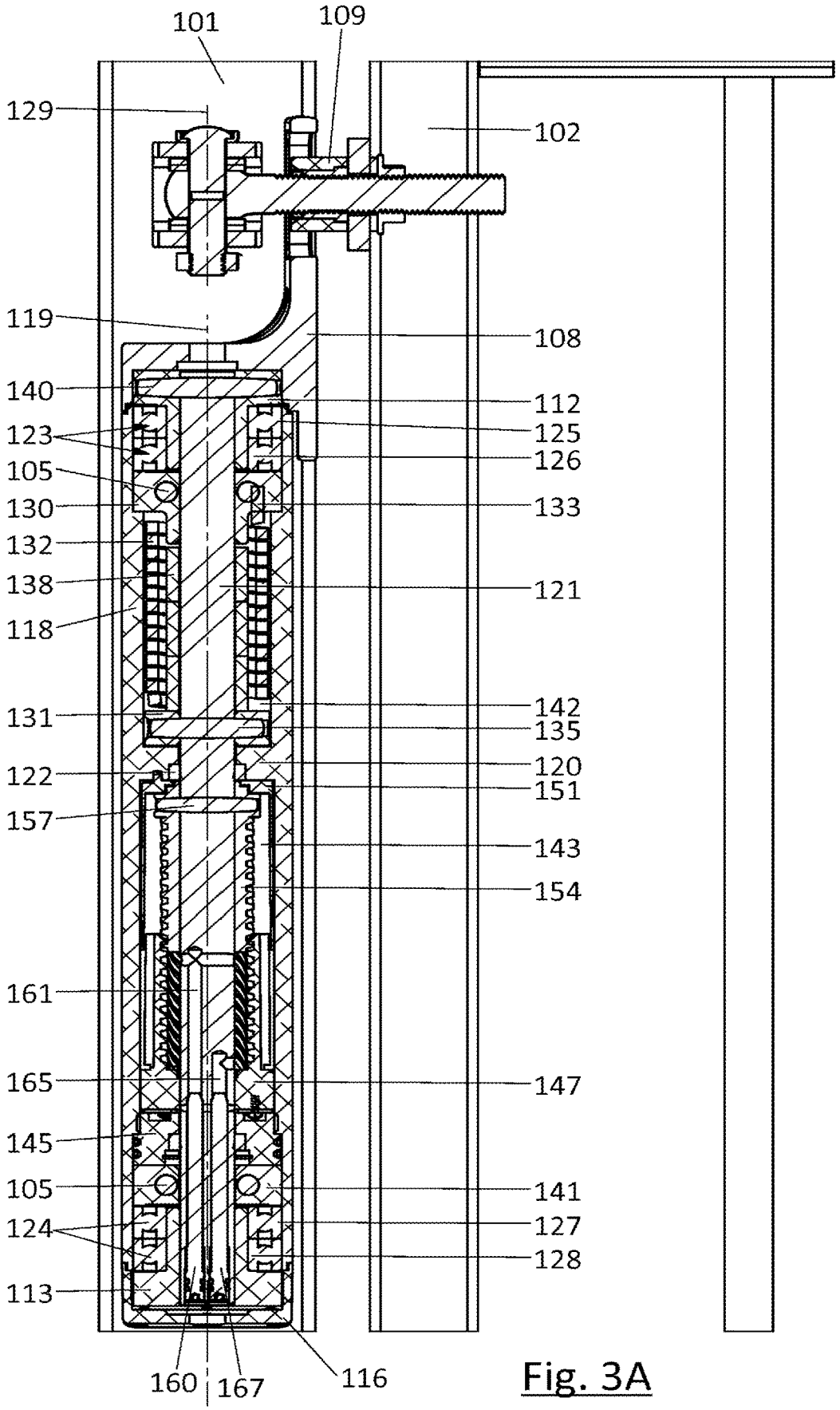
FIGS. 3A and 3B show a longitudinal cross-section through the actuator of FIGS. 1A and 1B respectively when mounted on the support.
Figure 3B:
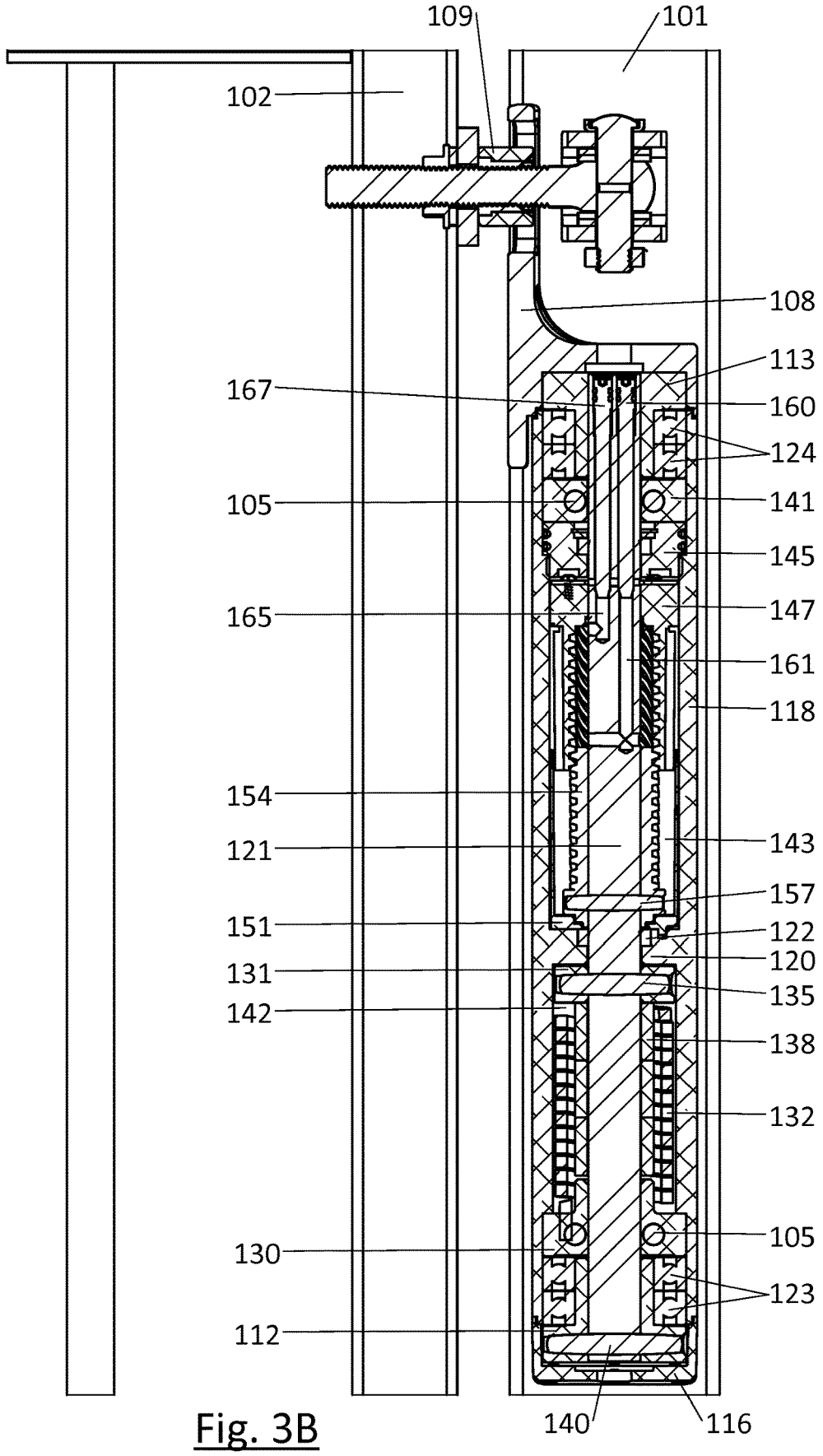

As illustrated in FIGS. 2A and 2B, the mechanical connector element 108 may be fixed to both ends of the main body 110 of the actuator 100 by using two bolts 111. Specifically, the main body 110 has two opposing ends, each being provided with a connection member 112, 113 that has two holes 114 into which the bolts 111 may be screwed. As such, the mechanical connector element 108 can be fixed to either connection member 112, 113 thereby enabling the main body 110 to be mounted in two different orientations. In particular, FIGS. 2A and 3A illustrate the main body 110 of the actuator in the first orientation, while FIGS. 2B and 3B illustrate the main body 110 of the actuator in the second orientation that is opposite to the first orientation.

It will be readily appreciated that more or fewer bolts 111 may also be used to fix the mechanical connector element 108 to the main body 110 of the actuator 100. For example, only a single bolt may be used that is bolted in the centre of the connection members 112, 113. However, especially considering the large forces in the present embodiment of the actuator 100, offsetting the bolt(s) 111 with respect to the centre of the connection members 112, 113 is advantageous to transfer the rotational motion to and from the mechanical connector element 108.

Furthermore, other means to fix the mechanical connector element 108 to the main body 110 of the actuator 100 may also be possible. For example, a pin may be placed transversally through both the mechanical connector element 108 and the connection members 112, 113.

Each of the connection members 112, 113 is also provided with an additional hole 115 that cooperates with a projection (not shown) on the bottom side of the mechanical connector element 108 thereby ensuring a unique alignment between the mechanical connector element 108 and the main body 110 of the actuator 100. In other words, there is only a single possible position to mount the mechanical connector element 108 on either of the connection members 112, 113. This is done such that the mechanical connector element 108 is mounted with the plate-like part having the opening oriented towards the closure member 102 for both a right-handed and a left-handed closure system as illustrated in FIGS. 1A and 1B.

It will be readily appreciated that alternative means may also be provided to ensure a unique alignment between the mechanical connector element 108 and the main body 110 of the actuator 100. For example, a groove along the inner side of the mechanical connector piece with a corresponding projection on the outer side of the connection members 112, 113.

The actuator 100 preferably also comprises an end-cap 116 used to cover the free connection member 112, 113, i.e. the connection member not used for mounting the mechanical connector element 108. In FIGS. 2A and 2B, the end-cap 116 is mounted to the main body 110 of the actuator 100 using two bolts, but it will be appreciated that more or fewer bolts may be used. The end-cap 116 is beneficial as it prevents dirt and/or water from entering the main body 110 of the actuator 100.

In an alternative, non-illustrated, embodiment, the end-cap 116 may directly mounted to the support 101 using a fixture set as described above. The advantage thereof is that it provides an additional fixation point of the actuator 100, which fixation point is located as far as possible from the region where rotational forces are transmitted from and to the closure member 102, i.e. near the connection member 112, 113 onto which the mechanical connector piece 108 is mounted.

Figure 4A:
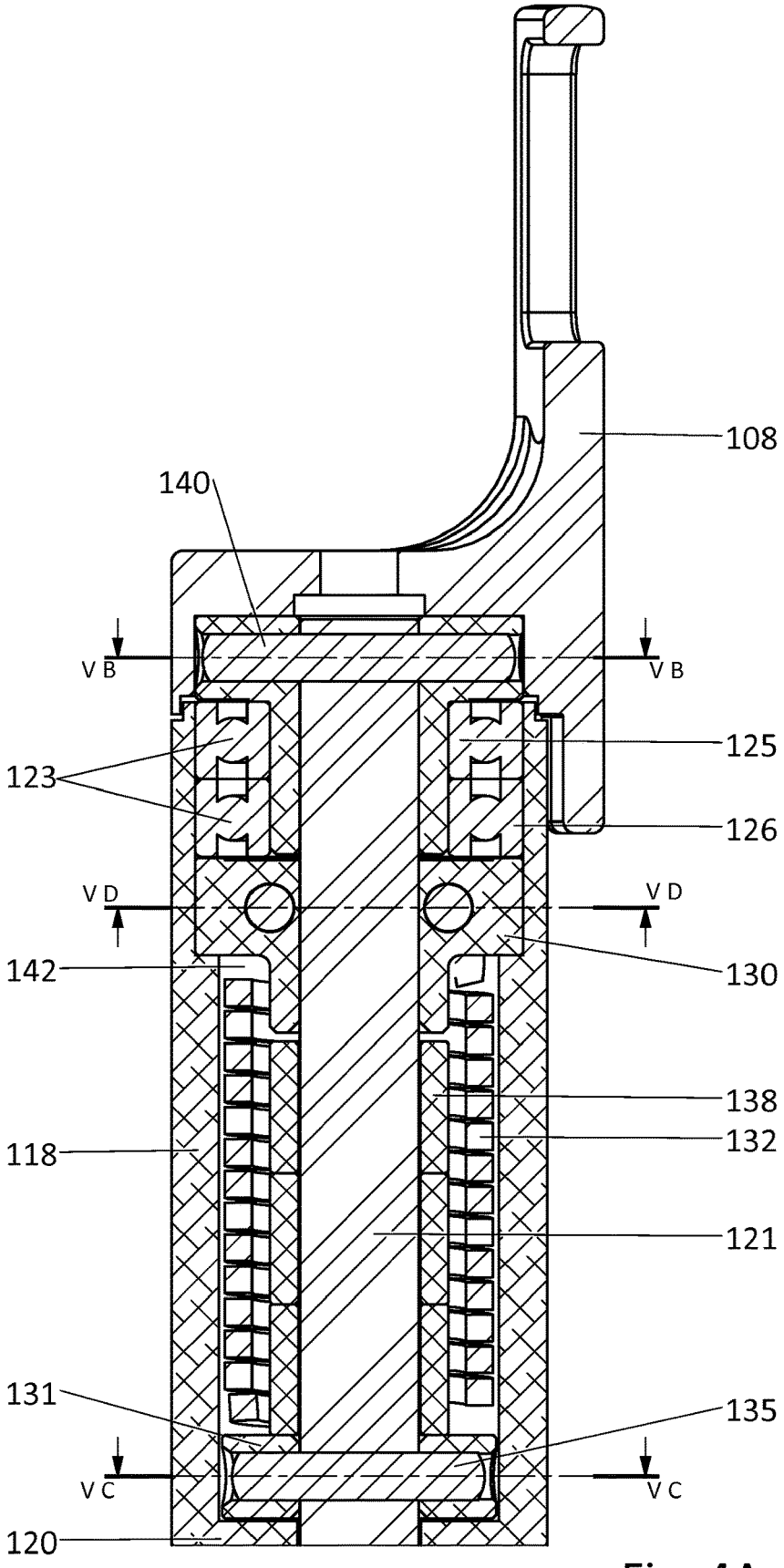
FIGS. 4A and 4B show a longitudinal cross-section through the actuator of FIG. 1A respectively for the top part and the bottom part of the actuator.
Figure 4B:
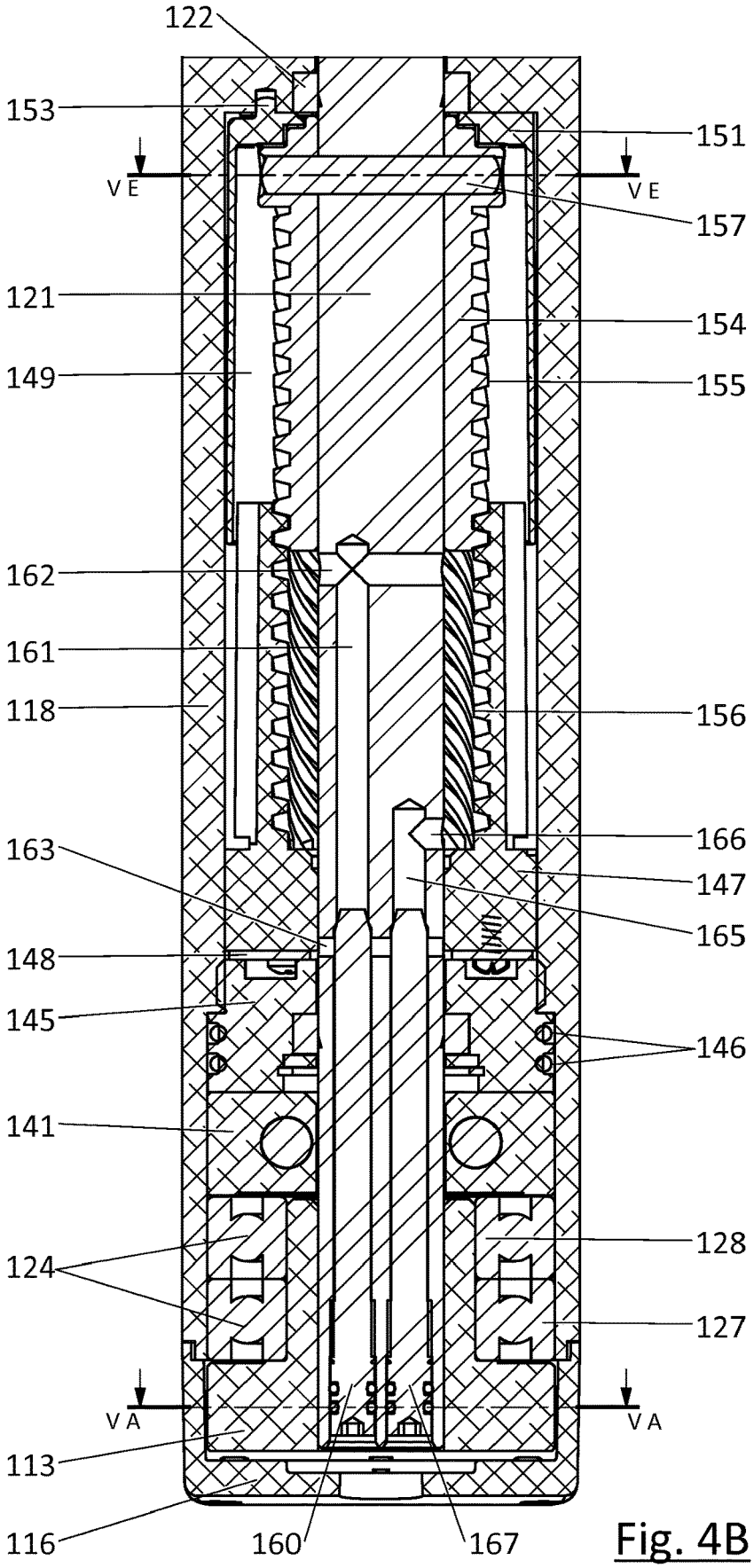

FIGS. 3A and 3B show a longitudinal cross-section through the actuator 100 of when mounted onto a right-handed and a left-handed closure system respectively. FIGS. 4A and 4B illustrate a same view as FIG. 3A but on a larger scale focussed on respectively the top half and the bottom half of the actuator 100. These Figures will be used to describe details relating to the internal mechanisms of the actuator 100.

The actuator 100 is mainly formed by a tubular cylinder barrel 118 having a longitudinal axis 119. The tubular cylinder barrel 118 has an internal collar 120 that divides the tubular cylinder barrel 118 into a first tubular part 142 housing the energy storing mechanism and a second tubular part 143 housing the hydraulic damping mechanism. The tubular cylinder barrel 118 is preferably manufactured from extruded aluminium which is less porous, and which therefore also has a larger strength, when compared with cast aluminium so that it is leak-free with respect to hydraulic fluid. Moreover, it is advantageous if the first tubular part 142 and the second tubular part 143 are bore milled from the extruded aluminium as this results in the collar 120 being integrally formed with the tubular cylinder barrel 118, which is itself also integrally formed, thereby providing a substantially leak-free barrier between the first tubular part 142 and the second tubular part 143. Advantageously, each tubular part 142, 143 has a decreasing diameter when approaching the collar 120 thereby enabling all the elements of the energy storing and damping mechanism to be inserted from either the first end or the second end of the tubular cylinder barrel 118.

The actuator comprises a first fixation member formed by a ring 130 and a second fixation member formed by a ring 141. Each of these fixation members 130, 141 has two openings 117 through which bolts 105 of the fixture sets are placed to fix the tubular cylinder barrel 118 to the support 101. It is advantageous to provide these fixation members 130, 141 as near the ends of the tubular cylinder barrel 118 as possible, because the forces generated with opening and closing the closure system will be largest near the ends of the tubular cylinder barrel 118.

The actuator 100 comprises a shaft 121 that extends along the length of the tubular cylinder barrel 118 and has a rotation axis that substantially coincides with the longitudinal axis 119 of the tubular cylinder barrel 118. As such, the shaft 121 is placed within the circular opening provided by the collar 120. Near the collar 120, a sealing ring 122 is placed around the shaft 121 to ensure that the hydraulic fluid from the hydraulic damping mechanism in the second tubular part 143 does not enter the first tubular part 142 that houses the energy storing mechanism, especially when the actuator 100 is mounted in its second orientation as illustrated in FIG. 3B. The shaft 121 has a first extremity onto which the first connection member 112 is mounted and a second extremity onto which the second connection member 113 is mounted. The shaft 121 is preferably manufactured from steel, preferably stainless steel, but it will be appreciated that other materials may be used.

Figure 5A:
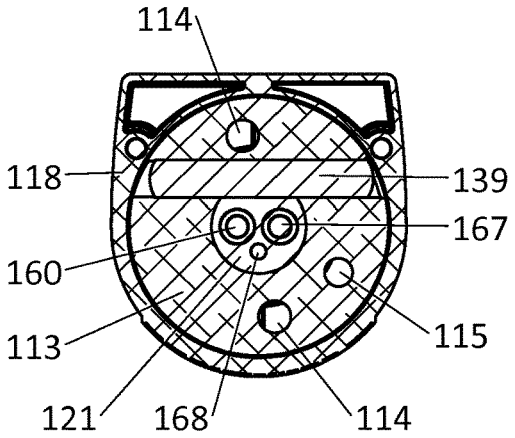
FIGS. 5A to 5E show horizontal cross-sections through the actuator along the planes "vA" to "vE" indicated in FIGS. 4A and 4B.

FIG. 5A shows a horizontal cross-section through the actuator 100 along line "vA" indicated in FIG. 4B. FIG. 5A illustrates how the second connection member 113 is fixed the second extremity of the shaft 121. Specifically, a pin 139 is inserted transversally through the second connection member 113 and partly through the shaft 121 thereby irrotatably locking the second connection member 113 to the shaft 121. In the illustrated embodiment, the pin 139 is offset with respect to the longitudinal axis 119. This is advantageous as it enables providing adjustable valves for the hydraulic damping mechanism centrally in the shaft 121.

Figure 5B:
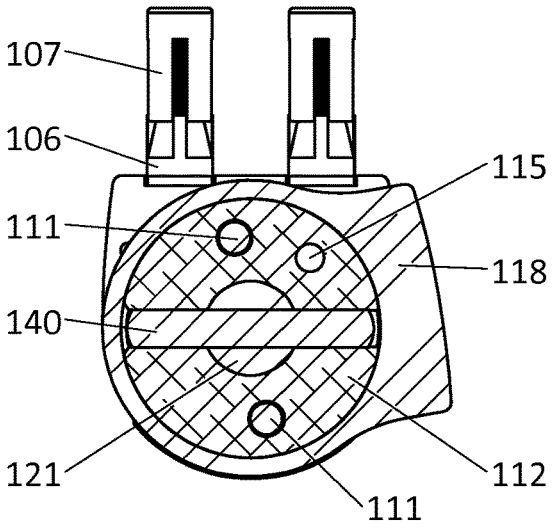

FIG. 5B shows a horizontal cross-section through an alternative actuator 100 along line "vB" indicated in FIG. 4A. This horizontal cross-section illustrates that a pin 140 is provided to fix the first connection member 112 to the first extremity of the shaft 121. Contrary to the pin 139, the pin 140 is placed centrally through the shaft 121 and the first actuation member 130. The advantage of a central pin 140 is that it provides a more robust connection between the shaft 121 and the first connection member 112.

It will be readily appreciated that, such a central pin may also be used for the second connection member 113 in an embodiment of the actuator 100 that does not include adjustable valves in the shaft 121. Furthermore, the pin 140 may also be offset with respect to the longitudinal axis 119. Moreover, the pins 139, 140 may be threaded to provide a more secure connection.

Returning to FIGS. 3A to 4B, two roller bearings 123, in particular steel roller bearings, are provided between the tubular cylinder barrel 118 and the first connection member 112 and another two roller bearings 124, in particular steel roller bearings, are provided between the tubular cylinder barrel 118 and the second connection member 113. Hereinafter, the term "double roller bearing" may also be used to describe the stacked roller bearings 123 and/or the stacked roller bearings 124. Both of the roller bearings 123 have an outer race 125 that radially engages an inner surface of the tubular cylinder barrel 118 and an inner race 126 that radially engages an outer surface of the first connection member 112, in particular an outer surface of an annular sleeve portion of the first connection member 112. Both of the roller bearings 124 have an outer race 127 that radially engages an inner surface of the tubular cylinder barrel 118 and an inner race 128 that radially engages an outer surface of the second connection member 113, in particular an outer surface of an annular sleeve portion of the second connection member 113. These roller bearings 123, 124 enable an almost frictionless relative rotation of the shaft 121 with respect to the tubular cylinder barrel 118.

FIGS. 3A to 4B also illustrate that the outer races 125 of the first roller bearings 123 axially engage the first connection member 112, while the inner races 126 of the first roller bearings 123 axially engage a transverse surface formed by the first fixation member 130. FIGS. 3A and 3B further illustrate that the outer races 127 of the second roller bearings 124 axially engage the second connection member 113, while the inner races 128 of the second roller bearings 124 axially engage a transverse surface formed by the second fixation member 141. Such a configuration is advantageous when considering that the shaft 121 may be subjected to a force in the direction of the longitudinal axis 119, such a force may be generated by the damping mechanism. Such a force will either pull the first connection member 112 towards the first roller bearings 123 or the second connection member 113 towards the second roller bearings 124. In both of these cases, the roller bearings 123, 124 will transmit, via the inner races 126, 128 to the outer races 125, 127, this longitudinally oriented force to respective ones of the first and second fixation members 130, 141, which are directly fixed to the support 101. In other words, the configuration of the roller bearings 123, 124 ensures that the shaft 121 is securely fixed in the direction of the longitudinal axis 119. Preferably, the double roller bearings 123, 124 are ball bearings, in particular steel ball bearings, as these are more suited to transmit forces in the axial direction.

It will be readily appreciated that only a single roller bearing 123, 124 could be provided between each connection member 112, 113 and the tubular cylinder barrel 118. However, as described above, the actuator 100 of the present embodiment needs to handle large forces, therefore, providing two roller bearings 123, 124 is advantageous.

Moreover, the double roller bearings 123, 124 could also be placed with their inner race 126, 128 directly contacting the shaft 121. This could be achieved by having connection members 112, 113 that do not include the annular sleeve portion and by providing roller bearings 123, 124 having a smaller diameter. However, as described above, the double roller bearings 123, 124 need to transfer longitudinally directed forces, therefore, providing roller bearings 123, 124 having a larger diameter, i.e. having a larger surface area of the races 125, 126, 127, 128, is clearly advantageous.

The energy storing mechanism in the first tubular part 142 of the tubular cylinder barrel 118 is shown in FIGS. 3A to 4A. The energy storing mechanism comprises a first actuation member formed by the ring 130 (which ring 130 also forms the first fixation member in this embodiment), a second actuation member formed by a ring 131 and a torsion spring 132 connected with a first end 133 (shown in FIG. 5D) to the first actuation member 130 and with a second end 134 to the second actuation member 131. Both actuation members 130, 131 are annular and are placed around the shaft 121. The torsion spring 132 is preferably pre-tensioned during assembly of the actuator 100 in the sense that, irrespective of the relative positions of the actuation members 130, 131, the torsion spring 132 always has a minimum amount of energy stored. This ensures that the closure system will be properly closed.

It will be readily appreciated that, although the ring 130 in the illustrated embodiment has a double function, two rings may also be provided, a first of these rings forming the first fixation member and a second of these rings forming the first actuation member.

It will be appreciated that, in an alternative, non-illustrated embodiment, the energy storing mechanism may also be provided with a compression spring and a sliding piston.

Figure 5C:
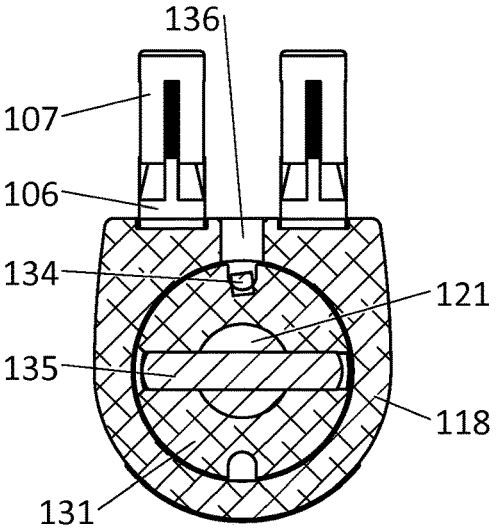

FIG. 5C shows a horizontal cross-section through the actuator 100 along line "vC" indicated in FIG. 4A. During assembly of the actuator 100, a pin 135 is transversely inserted through the opening 136 in the back of the tubular cylinder barrel 118 into openings provided in the second actuation member 131 and the shaft 121. As such, the second actuation member 131 is irrotatably fixed to the shaft 121. FIG. 5C also illustrates that the second end 134 of the torsion spring 132 is placed into a hole provided in the second actuation member 131. As such, the second end 134 of the torsion spring 132 is also irrotatably fixed to the shaft 121.

Figure 5D:
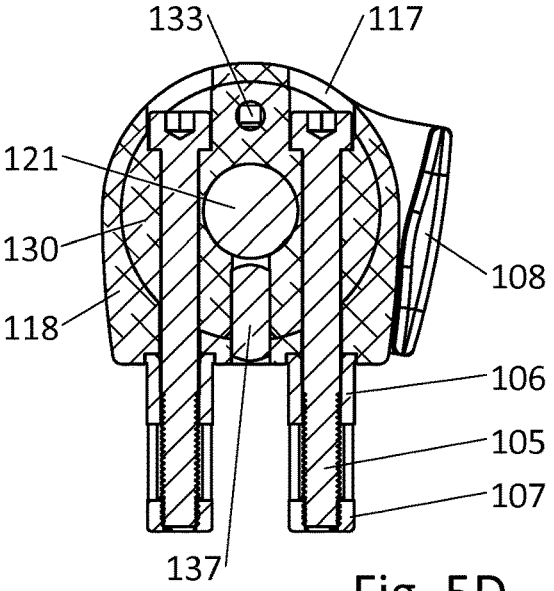

FIG. 5D shows a horizontal cross-section through the actuator 100 along line "vD" indicated in FIG. 4A. During assembly of the actuator 100, a pin 137 is transversely inserted through an opening in the back of the tubular cylinder barrel 118 into an opening provided in the first actuation member 130. As such, the first actuation member 130 is irrotatably fixed to the tubular cylinder barrel 118. FIG. 5C also illustrates that the first end 133 of the torsion spring 132 is placed into a hole provided in the first actuation member 130. As such, the first end 133 of the torsion spring 132 is also irrotatably fixed to the tubular cylinder barrel 118.

It will be readily appreciated that the pins 135, 137 may be threaded to provide a more secure connection.

FIG. 5D further illustrates that the ring 130 acts both as the first actuation member and as the first fixation member with bolts 105 of the fixture sets being inserted through both the tubular cylinder barrel 118 and the first actuation member. Therefore, when the actuator 100 is mounted to the support 101, the pin 137 no longer serves a purpose. However, before the actuator 100 is mounted to the support 101, the pin 137 is advantageous as it enables the torsion spring 132 to be pre-tensioned.

Returning to FIGS. 3A to 4B, in a preferred embodiment, the energy storage mechanism also comprises padding 138 to prevent the torsion spring 132 from buckling due to the large forces exerted thereon. In the illustrated embodiments, the padding 138 comprises three rings placed around the shaft 121 in the space between the shaft 121 and the torsion spring 132. The padding 138 is free to rotate with the shaft 121 and does not contact the torsion spring 132 thus causing no significant friction.

FIGS. 3A to 4B further provide details on the hydraulic damping mechanism. The shaft 121 provides the coupling between the energy storing mechanism and the damping mechanism, and more generally, transfers the opening and closing movement of the closure system to the damping mechanism.

The hydraulic damping mechanism comprises a closed cylinder cavity 144 formed inside the second tubular part 143. The closed cylinder cavity 144 is closed at one end by the collar 120, preferably in combination with the sealing ring 122, and at the other end by an annular closing member 145. This annular closing member 145 is preferably screwed in the tubular cylinder barrel 118 and includes at least one additional sealing ring 146 to ensure a leak-tight connection between the tubular cylinder barrel 118 and the annular closing member 145. The closed cylinder cavity 144 has a longitudinal direction which is the same as the direction of the longitudinal axis 119. The closed cylinder cavity 144 is filled with a hydraulic fluid.

The damping mechanism further comprises a piston 147 placed in the closed cylinder cavity 144 to divide the closed cylinder cavity 144 into a high pressure compartment 148 and a low pressure compartment 149 (illustrated in FIG. 4B). The piston 147 is preferably made from a synthetic material, in particular a thermoplastic material and is more preferably injection moulded.

Figure 5E:
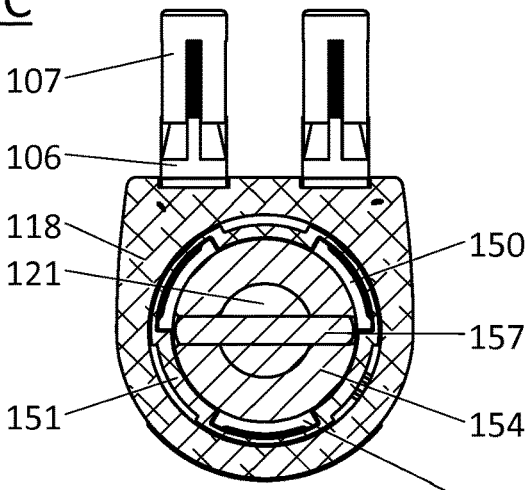

As illustrated in the horizontal cross-section in FIG. 5E, which cross-section runs along the line "vE" indicated in FIG. 4B, the piston 147 has three outward projections 150 which are guided in three grooves in a guiding element 151 which is also arranged in the closed cylinder cavity 144. As illustrated in FIGS. 3A to 4B, the guiding element 151 fits in the second tubular part 143 and is irrotatably locked therein by means of at least one bolt (not shown in the Figures illustrating this embodiment, but shown indicated in FIG. 10B with reference number 252), which is bolted into at least one corresponding hole in the collar 120. FIG. 4B further illustrates that the guiding element 151 also has at least one projection 153 that fits into a recess in the collar 120, which projection 153 further ensures that the guiding element 151 is irrotatably fixed to the tubular cylinder barrel 118. By such a configuration, the piston 147 can substantially not rotate within the closed cylinder cavity 144 and is slidable in the longitudinal direction of the closed cylinder cavity 144 between two extreme positions, namely a closed position and an open position.

It will be readily appreciated that, in other embodiments, more bolts and/or projections 153 may be used, or that only bolts or only projections 153 may be used to irrotatably lock the guiding element 151 in the second tubular part 143. Moreover, other means may be suitable to irrotatably lock the guiding element 151 in the second tubular part 143. For example, bolts may be inserted transversally through the tubular cylinder barrel 118 into the guiding element 151. However, this would result in at least one opening in the closed cylinder cavity 144, which opening is used to insert the bolt, which may lead to a leak of hydraulic fluid. In an alternative embodiment, the guiding element itself could be fixed to the tubular cylinder barrel and could form an annular element forming the collar 120. This annular element can form a seal, or a seal can be applied between the annular element (collar) and the tubular cylinder barrel 118, so that no hydraulic fluid can leak from the closed cylinder cavity 144 into the second tubular part 142 of the cylinder barrel 118.

It will be further appreciated that more or less grooves may be provided in the guiding element 151. The guiding element 151 is preferably made from a synthetic material, in particular a thermoplastic material. Furthermore, the guiding element 151 is preferably injection moulded.

The hydraulic damping mechanism further comprises the rotatable shaft 121, which runs through both the high pressure and the low pressure compartments 148, 149 of the closed cylinder cavity 144.

In order to convert the rotational motion of the shaft 121 into a translational motion of the piston 147, a spindle 154 is provided between the shaft 121 and the piston 147. In particular, the spindle 154 is made, preferably injection moulded, of a synthetic material, preferably a thermoplastic material, which can easily be moulded into the required shape. As illustrated in FIG. 5E, during assembly of the actuator 100, a pin 157 is transversely inserted through the spindle 154 and through the shaft 121. In order to convert the rotational motion of the spindle 154 into a translational motion of the piston 147, the spindle 154 is provided with an outer threaded portion 155 that engages an inner threaded portion 156 on the piston 147. In particular, the outer threaded portion 155 is provided with a first, external (male) screw thread which has a screw axis which substantially coincides with the longitudinal axis 119 and which co-operates with an internal (female) screw thread on the piston 147. Since the piston 147 is irrotatably positioned within the closed cylinder cavity 144, the piston 147 slides with respect to the closed cylinder cavity 144. In particular, the piston 147 moves towards the collar 120 when the closure system is being opened and it moves away from the collar 120 when the closure system is being closed. In the illustrated embodiments, the screw threads are therefore right-handed screw threads.

It will be readily appreciated that the pin 157 may be threaded to provide a more secure connection.

It will be readily appreciated that the spindle 154 may also be integrally formed with the shaft 121 as illustrated in the embodiment of the present invention described below with respect to FIGS. 12A to 17B. In other words, the shaft 121 may be provided with the outer threaded portion 155.

To keep the actuator 100 as compact as possible, no gearing or reduction is provided between the shaft 121 and the piston 147. As such, the threaded portions 155, 156 have a screw thread with a high lead angle. Preferably, the outer threaded portion 155 has a lead angle of at least 45° and more preferably at least 55° and most preferably at least 60°. In the illustrated embodiment, the lead angle is equal to about 66°. Moreover, the outer threaded portion 155 preferably has at least 5 starts and more preferably at least 7 starts and 10 starts in the illustrated embodiments.

The hydraulic damping mechanism further comprises a one-way valve (not shown in the Figures illustrating this embodiment, but indicated in FIG. 10B with reference number 258) which allows the hydraulic fluid to flow from the low pressure compartment 149 of the closed cylinder cavity 144 to the high pressure compartment 148 thereof when the closure system is being opened. The opening movement of the closure system is therefore not damped or at least to a smaller extent than the closing movement. This one-way valve 158 is typically provided in the piston 147.

To achieve the damping action upon closing of the closure system by the energy storing mechanism, at least one restricted fluid passage is provided between the two compartments 148, 149 of the closed cylinder cavity 144. One restricted fluid passage is formed by a channel connecting, in all the possible positions of the piston 147, i.e. in all positions between its two extreme positions, the low pressure compartment 149 with the high pressure compartment 148. This channel is provided with an adjustable valve 160, in particular a needle valve, so that the flow of hydraulic liquid through this channel can be controlled. In this embodiment, the channel is provided in by at least three bores in the shaft 121 (as detailed in FIG. 4B), i.e. a first bore 161 in the direction of the longitudinal axis 119, a second bore 163 transverse to the direction of the longitudinal axis 119 at the extremity of the low pressure compartment 148, and a third bore 162 transverse to the direction of the longitudinal axis 119 at the extremity of the high pressure compartment 148. The needle of the adjustable valve 160 is screwed into the extension of the first bore 161 that runs to the end face of the second extremity of the shaft 121 so that the adjustable valve 160 is adjustable from the outside when the actuator is mounted on the support 101.

The shaft further comprises a second restricted fluid passage formed by channel that also comprises three bores as detailed in FIG. 4B. Specifically, a first bore 165 in the direction of the longitudinal axis 119, a second bore 162 transverse to the direction of the longitudinal axis 119 just above the piston 147, when the piston 147 is in its closed position, and a third bore corresponding to the third bore 163 of channel, i.e. at the extremity of the high pressure compartment 148. As such, the second channel forms a by-pass which causes an increase of the closing speed at the end of the closing movement, i.e. a final snap, to ensure that the closure system is reliably closed. A second adjustable valve 167, in particular a needle valve, is provided so that the flow of hydraulic liquid through the channel can be controlled to control the closing speed of the closure system during the final snap. Again, the needle of the adjustable valve 167 is screwed into the extension of the first bore 165 that runs to the end face of the second extremity of the shaft 121 so that the adjustable valve 167 is adjustable from the outside when the actuator is mounted on the support 101.

As illustrated in FIG. 5A, a hole 168 is provided in the second extremity of the shaft 121 near the adjustable valves 160, 167. This hole 168 is provided to insert a fixation element 169, e.g. a bolt, pin, etc., (illustrated in FIG. 6) having a flattened head to ensure that the adjustable valves 160, 167 are securely inserted in their respective bore 161, 165.

It will be appreciated that the restricted fluid passages may also be provided in the wall of the tubular cylinder barrel 118 with the adjustable valves 160, 167 being provided in the collar 120 as will be described below with respect to the embodiment of the present invention illustrated in FIGS. 12A to 17B.

The operation of the energy storing mechanism and the damping mechanism will be explained with respect to FIG. 3A for a right-handed closure system and with respect to FIG. 3B for a left-handed closure system.

In FIG. 3A, the actuator 100 is mounted on a right-handed closed closure system with the tubular cylinder barrel 118 fixed to the support 101 and with the shaft 121 being coupled to the closure member 102 via the mechanical connector element 108 and the first connection member 112. When the closure member 102 is being opened, the closure member 102 will rotate in a first direction, which rotation is transferred, via the mechanical connector 108, to the shaft 121 which will also rotate in the first direction. The first actuation member 130 is fixed to the support 101 and will therefore remain stationary, while the second actuation member 131 is fixed to the shaft 121 and will also rotate in the first direction, thereby tensioning the torsion spring 132, i.e. storing energy therein. Concurrently, the shaft 121 has transferred the same rotation to the damping mechanism causing the piston 147 to move towards the collar 120. As the closed cylinder cavity 144 is filled with hydraulic fluid, the motion of the piston 147 results in a motion of the hydraulic fluid across the one-way valve from the low pressure compartment 149 to the high pressure compartment 148. It will be appreciated that the hydraulic fluid may also pass to some extent via the restricted fluid passage formed by channel. These motions may continue until the closure system is fully opened.

When the closure system is fully or partially opened and no force is applied to the closure system, the energy storing mechanism will release its energy to close the closure system. Specifically, the torsion spring 132 will try to relax, thereby rotating the second actuation member 131 in a second direction, opposite to the first direction. Because the second actuation member 131 is fixed to the shaft 121 and the closure member 102, via the mechanical connector 108, these are also urged to rotate. The shaft 121 also transfers this rotation to the piston 147 which is now moved away from the collar 120. The one-way valve is now shut and the hydraulic fluid is forced through the restricted fluid passage in the shaft 121. This restricted flow thus damps the closing movement. When the closure system is almost closed, the piston 147 will no longer block the second bore 166 thus allowing hydraulic fluid to flow from the high pressure compartment 148 to the low pressure compartment 148 via both restricted fluid passage to decrease the damping rate thereby reliably closing the closure system.

In FIG. 3B, the actuator 100 is mounted on a left-handed closed closure system with the tubular cylinder barrel 118 fixed to the support 101 and with the shaft 121 being coupled to the closure member 102 via the mechanical connector element 108 and the second connection member 113. The operation of the actuator 100 is identical because the upside down orientation of the actuator 100 compensates for the difference in rotation of a left-handed closure system. In other words, both the energy storing mechanism and the damping mechanism operate in the exact same manner for both a right-handed and a left-handed closure system.

The actuator 100 described above is mainly used outdoors where large temperature variations are not uncommon. For example, summer temperatures up to 70° C. when the actuator 100 is exposed to sunlight and winter temperatures below −30° C. are not uncommon, i.e. temperature variations up to and possibly even exceeding 100° C. are possible. Moreover, there are also daily temperature variations between night and day which can easily exceed 30° C. when the actuator 100 is subjected to direct sunshine. These temperature variations cause expansion, and also contraction, of the hydraulic fluid, which could affect the operation of the damping mechanism. In particular, the expansion due to temperature variations can be up to 1% of the volume of hydraulic fluid for a temperature variation of 10° C., depending on the expansion coefficient of the hydraulic fluid. As such, an expansion of, for example, up to 3 ml for a temperature difference of 50° C. is possible.

To counter this expansion, a small amount of gas such as air could be provided in the hydraulic fluid itself. However, it has been found that this gas may interfere with the good working of the actuator 100, especially when gas bubbles, or an emulsion of the gas in the hydraulic fluid, passes through the restricted flow passage(s) and provides a smaller damping effect than pure hydraulic fluid. Consequently, the hydraulic fluid is preferably free of gas bubbles.

Figure 6:
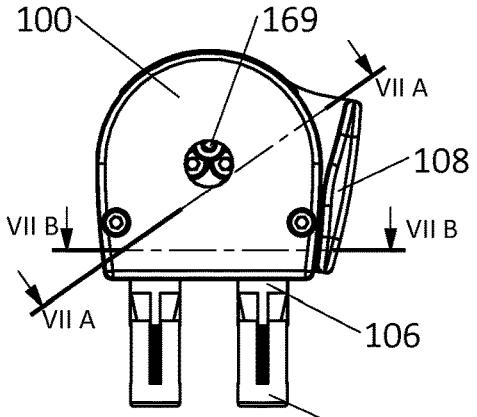
FIG. 6 shows a top view of the actuator illustrated in FIGS. 1A and 1B.
Figure 7A:
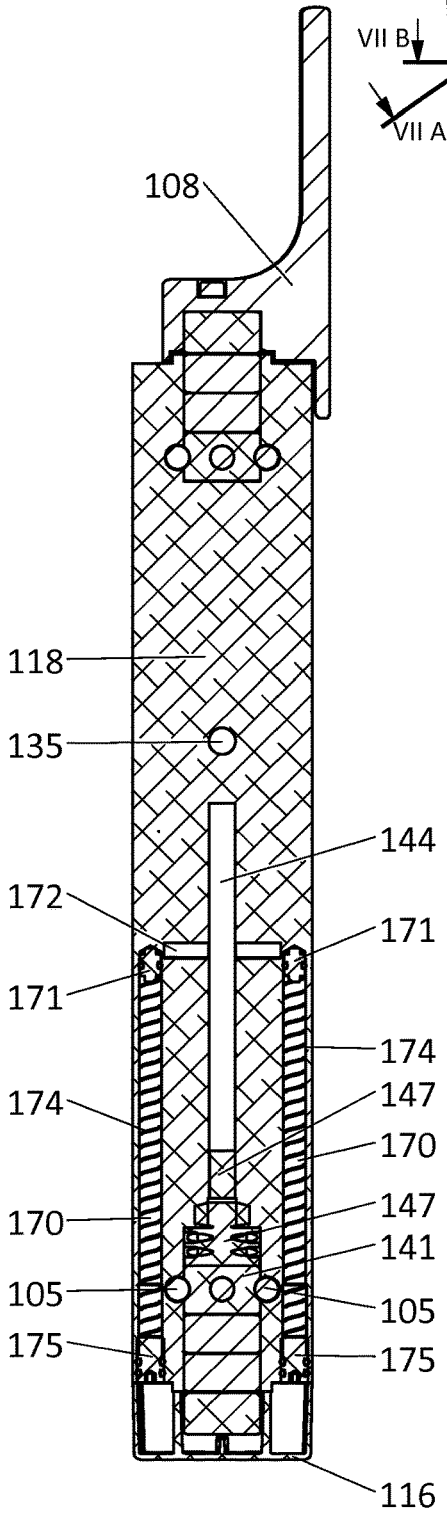
FIGS. 7A and 7B show a longitudinal cross-section along the lines "viiA" and "viiB" indicated in FIG. 6.

In the actuator 100 illustrated in the drawings, expansion of the hydraulic fluid is countered by means of two expansion channels 170 that are provided in two bores in the tubular cylinder barrel as illustrated in FIG. 7A which shows a longitudinal cross-section along line "viiA" in FIG. 6. The expansion channels 170 each have a moveable plunger 171 inserted therein. The plunger 171 divides the expansion channel 170 into a hydraulic fluid compartment having a first volume that is in fluid communication with the closed cylinder cavity 144 via a channel 172 and a pressure relief compartment having a second volume. The plunger 171 has a ring-shaped seal 173 on its outside to prevent leaks between the hydraulic fluid and the pressure relief compartments. It will be readily appreciated that multiple ring-shaped seals 173 may also be provided. When the actuator 100 is exposed to a temperature increase, the volume of the hydraulic fluid increases pushing the plungers 171 deeper into the expansion channels 170 and when the volume of the hydraulic fluid decreases, the plungers 171 are sucked back thereby closing the expansion channels 170.

Figure 7B:
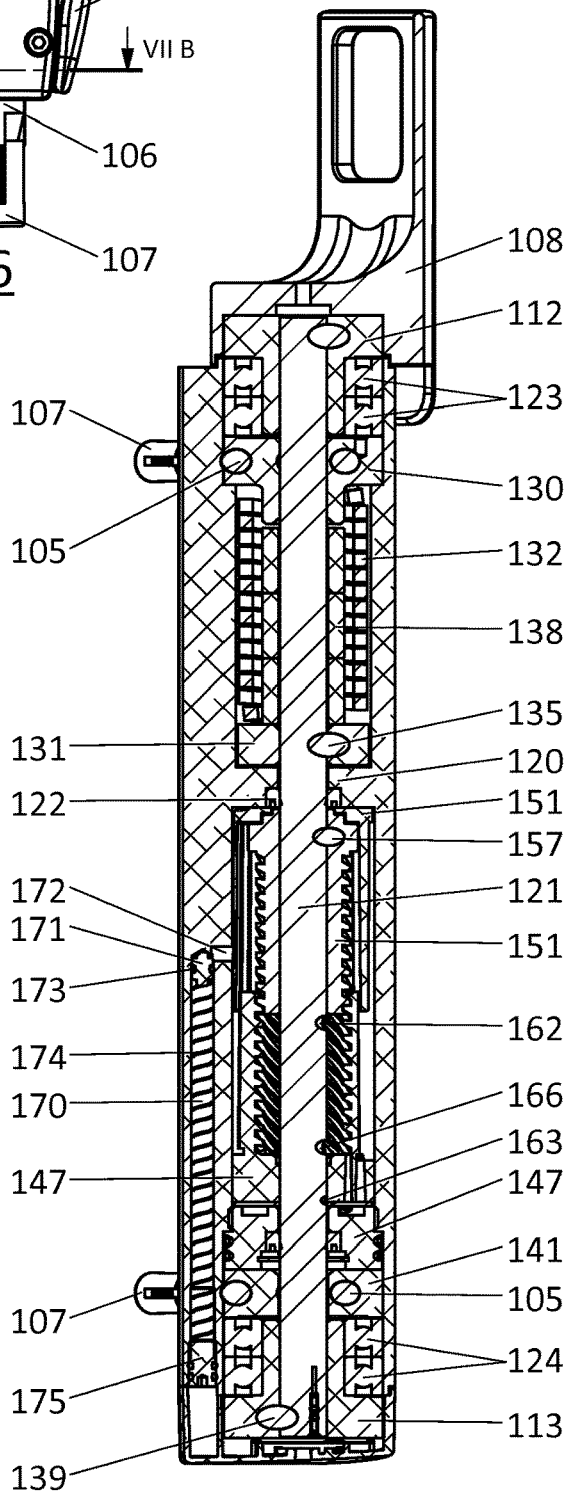
Figure 8:
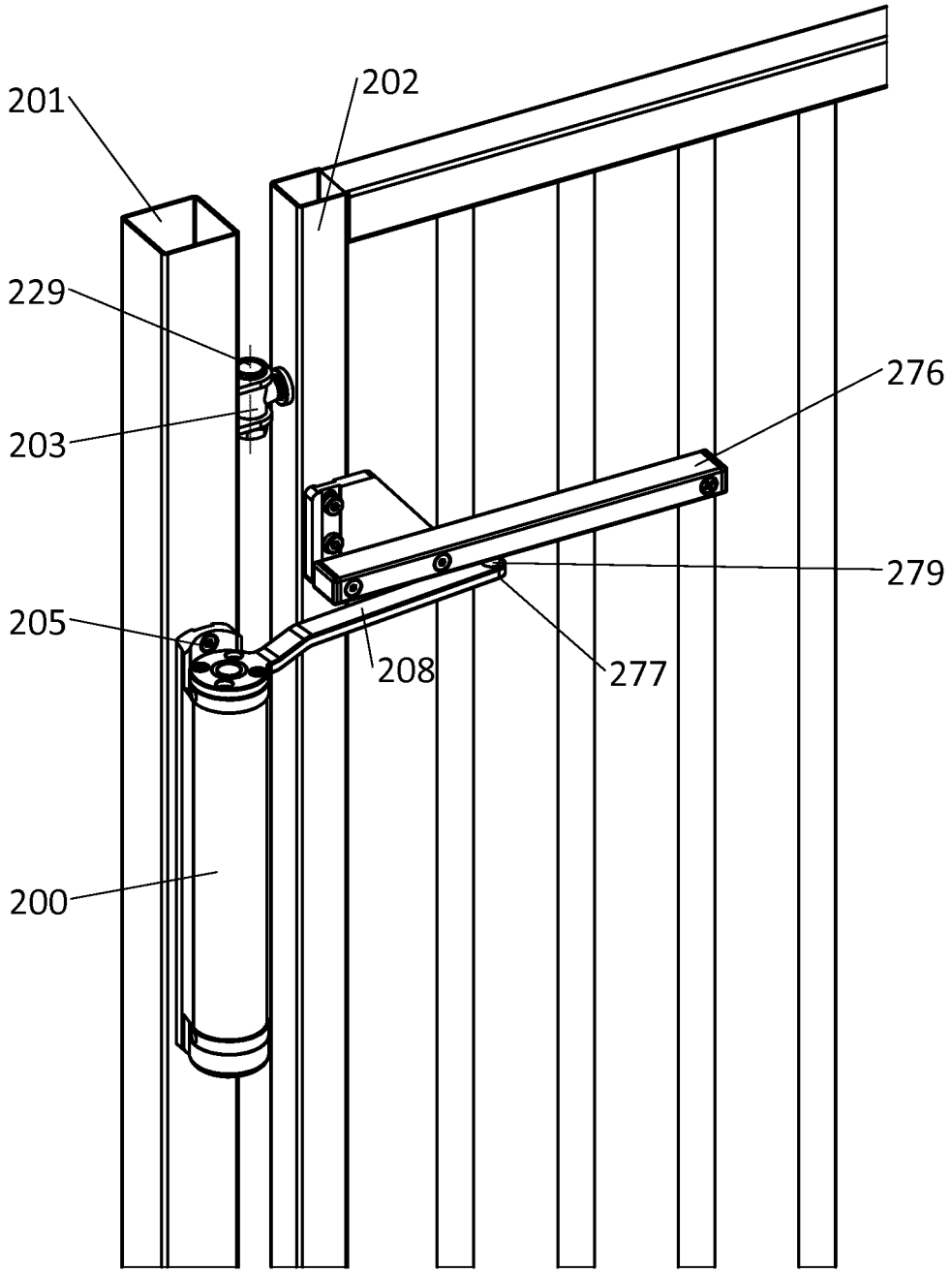
FIG. 8 shows a hydraulically damped actuator according to another embodiment of the present invention mounted on a right-handed closure system.

As illustrated in FIG. 7B which shows a longitudinal cross-section along line "viiB" in FIG. 6, the hydraulic fluid compartment is in fluid communication with the low pressure compartment 149 of the closed cylinder cavity 144. As such, the plunger 171 is not exposed to the high pressures that result from the normal operation of the damping mechanism. This is advantageous as, exposing the hydraulic fluid compartment to the high pressure compartment 149 would affect the closing movement of the closure system, i.e. the hydraulic fluid would not only flow via the channel but would also enter the hydraulic fluid compartment of the expansion channel 170 by displacing the plunger 171.

In the illustrated embodiment, the pressure relief compartment is also provided with a biasing member formed by a compression spring 174 and an end cap 175 that seals off the expansion channel 170 from the outside and that urges the plunger 171 towards the channel 172. The effect of this spring 174 is that the hydraulic fluid is pressurised so that negative pressures in the hydraulic fluid are alleviated. Specifically, the hydraulic fluid is usually added at room temperature, e.g. near 20° C. When the hinge is exposed to temperatures down to −30° C. a negative pressure would occur in the hydraulic fluid in the absence of the compression spring 174. Furthermore, when the actuator 100 is first exposed to temperatures up to 70° C., and then cooled down to a lower temperature, the increased friction between the ring-shaped seal 173 and the expansion channel 170 (as a result of the fact that the seal 173 becomes less flexible at lower temperatures) could result, in absence of the compression spring 174, in an additional negative pressure in the hydraulic fluid which could result in air getting sucked into the closed cylinder cavity 144 via the sealing ring 122 around the shaft 121 or via the seal 173 on the plunger 171. This problem is solved by the compression spring 174 which pressurizes the hydraulic fluid, even at low temperatures, so that any risk of air being sucked into the cylinder cavity being avoided.

In the illustrated embodiments, the pressure relief compartment is filled, besides with the compression spring 174, with air and is closed off by the end cap 175. When, the end cap 175 provides an airtight seal, the gas in the pressure relief compartment may be pressurised to assist or replace the compression spring 174.

The volume of the expansion channels 170 and their first and second volumes are mainly determined in function of the expected increase in volume of the hydraulic fluid. In the illustrated embodiments, the first volume is preferably at least 1.5 ml, more preferably at least 2 ml, advantageously at least 2.5 ml and more advantageously at least 3 ml when the plunger 171 is pushed as far back as possible into the expansion channel 170, i.e. when the first volume is maximal. The maximal second volume is preferably substantially the same as the maximal first volume to provide enough space for the compression spring 174.

It will be readily appreciated that, in other embodiments, only a single expansion channel 170 may be provided when the expected expansion and/or contraction of the hydraulic fluid may be compensated by the available volume of a single expansion channel 170.

Second Embodiment

FIGS. 8 to 10C illustrate another embodiment of an actuator 200 according to the present invention. Elements or components previously described with reference to FIGS. 1A to 7B bear the same last two digits but preceded by a '2'.

The actuator 200 is designed to be used in a closure system having a support 201 with a closure member 202 hingedly attached thereto by means of an eyebolt hinge 203. A main difference with respect to the first embodiment is that the actuator 200 is not placed in line with the hinge axis 229 of the closure system. As such, the closure system may only be rotated about 90°, while the closure system used in conjunction with the actuator 100 may be rotated about 180°. In particular, the closure member 202 is hinged to the support 201 with a hinge arranged inbetween the support 201 and the closure member 202, as disclosed for example in EP-B-2 778 330.

Furthermore, the mechanical connector element of the first embodiment has been replaced by an extended arm 208 that is slidably mounted to a rail 276 that is fixed to the closure member 202. Specifically, a distal part 277 of the extended arm 208 is provided with a projection 279 that is slideably received in the rail 276. The advantage of the extended arm 208 is that there is a relative long fulcrum between the distal part of the extended arm 208, at which point forces are transmitted to and from the actuator 200, and the hinge axis 229. Therefore, the actuator 200 of the present embodiment does not need to be able to handle the same large forces as the actuator 100 of the previous embodiment.

It will be readily appreciated that other types of extended arms may be suitable to transfer the rotational motion to and from the actuator 200. For example, the extended arm 208 may also comprises multiple sections that are pivotable with respect to one another, with the most distal section being fixedly connected to the closure member 202. Another example may be that the extended arm 208 is provided with a rail into which an element is slideably received, which element is fixedly connected to the closure member 202.

Figure 9:
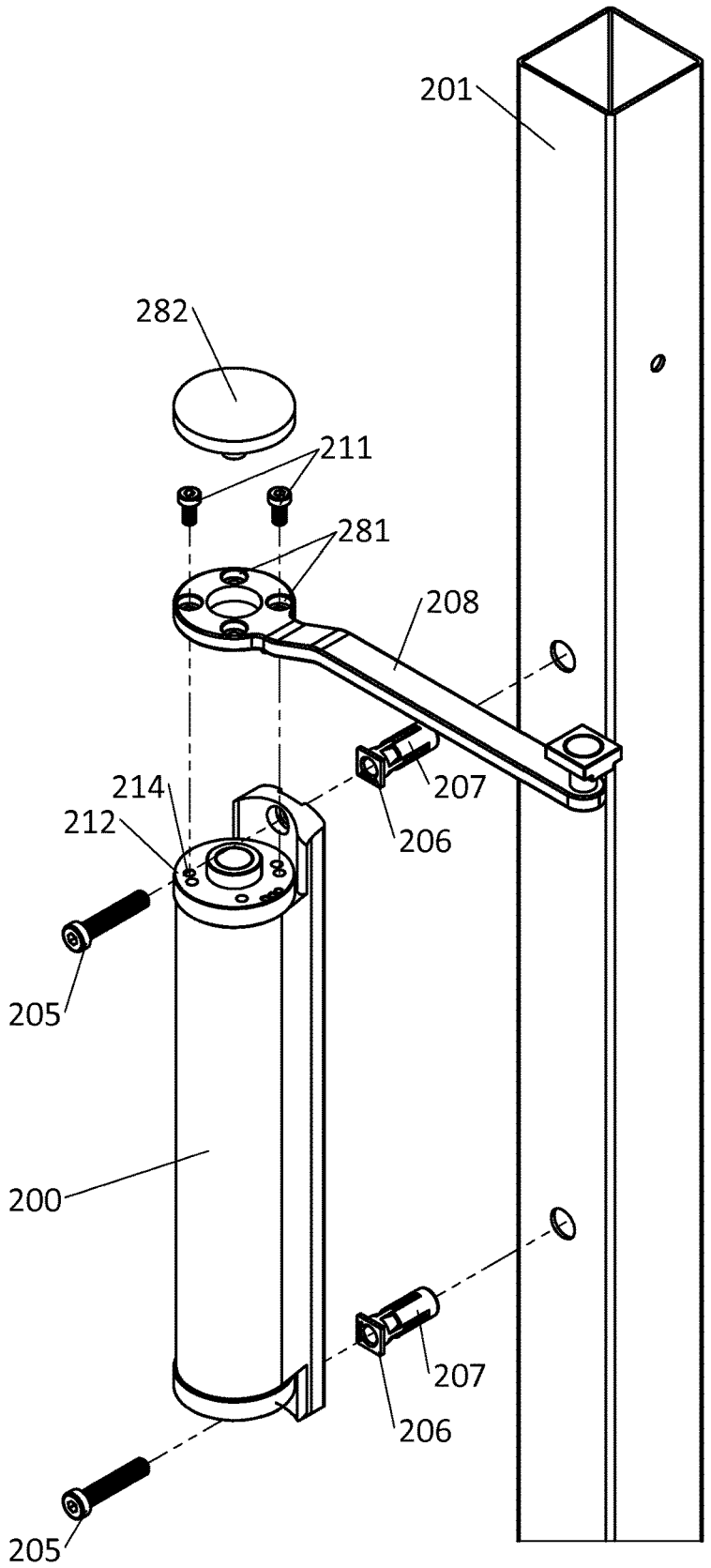
FIG. 9 shows how the actuator of FIG. 8 is mounted to the support.

FIG. 9 shows how the actuator 200 is mounted to the support 201 for a right-handed closure system. As illustrated, two fixture sets 205, 206, 207 are used that are inserted through openings above and beneath the connection members 212, 213 thereby fixing the main body 210, i.e. the tubular cylinder barrel 218, to the support 201. For a left-handed closure system, the main body 210 of the actuator 200 is inverted. In this embodiment, only two fixture sets are needed because the extended arm 208 decreases the magnitude of the force that the actuator 200 has to handle.

After the main body 210 has been securely fixed to the support 201, the extended arm 208 is fixed to either the first connection member 212 (as illustrated in FIG. 9) or the second connection member 213 depending on the orientation of the main body 210. Specifically, the extended arm 208 is provided with an annular portion 280 at its proximal end, which annular portion 280 has four openings 281 that may be aligned with six openings 214 in one of both connection members 212, 213. Two bolts 211 are then used to securely fix the extended arm 208 to one of the connection members 212, 213. The four openings 281 together with the six holes 214 enable the extended arm 208 to be mounted in three different positions, each position having a different orientation of the extended arm 208 with respect to the main body 210 of the actuator 200. This is advantageous as it enables to compensate for changes in the relative positioning of the support 201 and the closure member 202. Preferably, the three positions differ from one another by at least 5°, preferably at least 10° and most preferably at least 15°. Finally, an end-cap 282 is placed to conceal the connection between the extended arm 208 and the connection member 212, 213.

It will be readily appreciated that more or fewer bolts 211 may also be used to fix the extended arm 208 to the main body 210 of the actuator 200. For example, only a single bolt may be used that is bolted in the centre of the connection members 212, 213. However, a centrally placed bolt 211 also means that the one or more adjustable valves 260, 267 cannot be placed centrally in the shaft 221.

It will be readily appreciated that other means may be used to enable adjusting the relative orientation of the extended arm 208 with respect to the main body 210 of the actuator 200. For example, the annular portion 280 may have a larger internal diameter than the connection members 212, 213, in which case the annular portion 280 may be slid around the connection members 212, 213. When the inner surface of the annular portion 280 is provided with a plurality of projections that cooperate with multiple grooves on the outside surface of the connection members 212, 213, this will also enable adjusting the orientation of the extended arm 208 with respect to the main body 210 of the actuator 200.

Figure 10A:
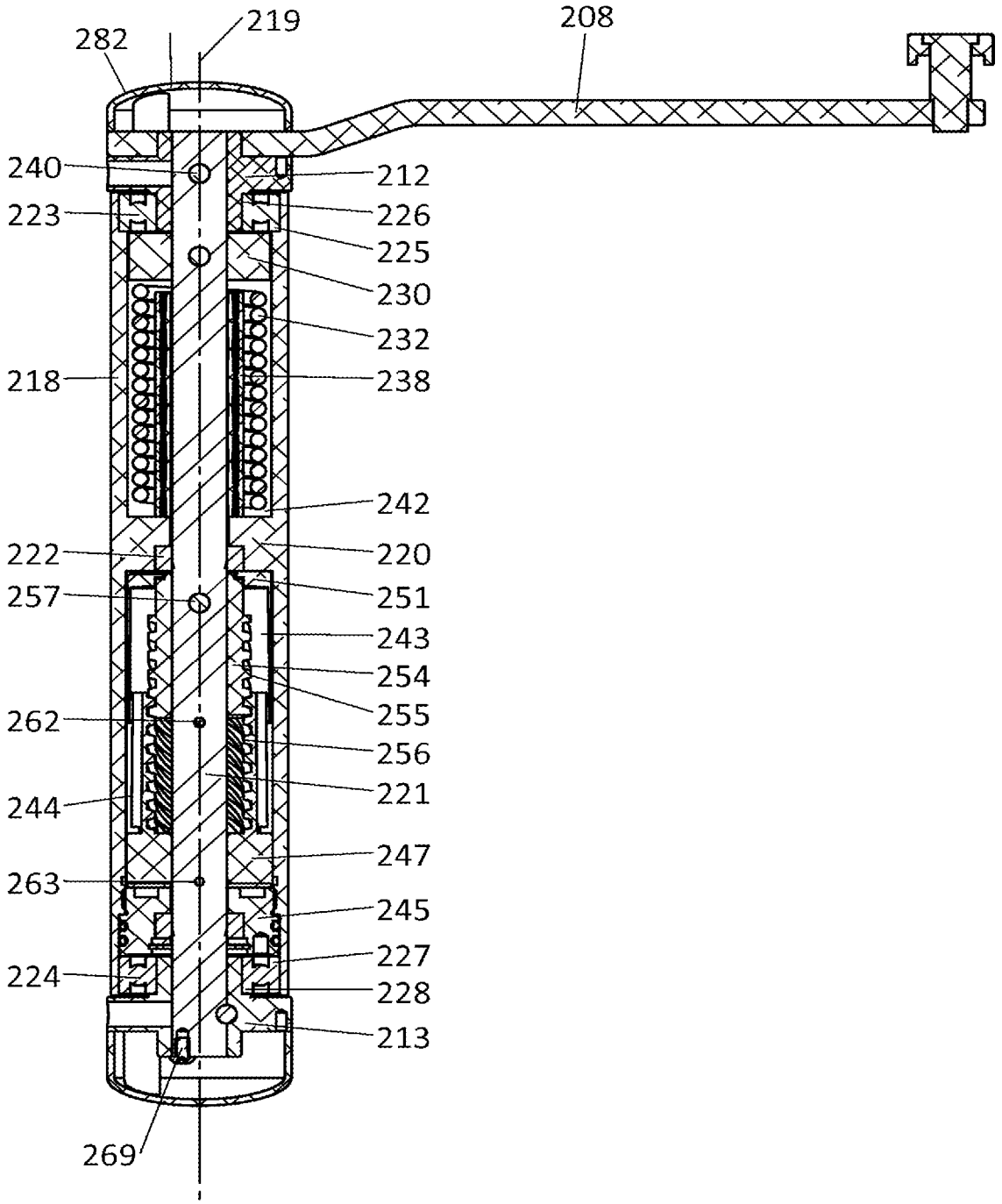
FIG. 10A to 10C show longitudinal cross-sections through the actuator of FIG. 8.
Figure 10B:
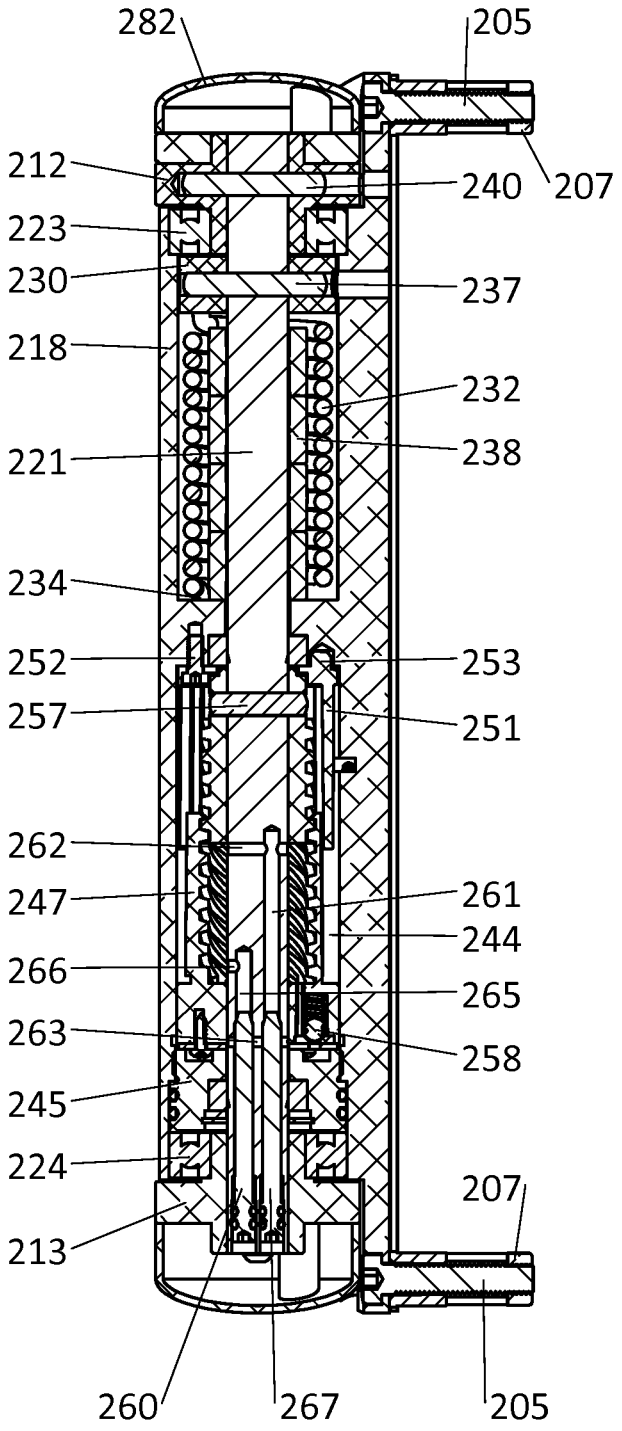

FIGS. 10A and 10B show two longitudinal cross-sections through the actuator 200. Generally, the actuator 200 has a similar internal structure as the actuator 100. Specifically, the actuator 200 also comprises a damping mechanism having a closed cylinder cavity 244 with a guiding element 251 bolted into the collar 220, by at least one bolt 252, preventing rotation of the piston 247, a spindle 254 that drives a piston 247 to slideably move inside the closed cylinder cavity 244, a one-way valve 258 enabling hydraulic fluid to flow from the high pressure compartment to the low pressure compartment when opening the closure system, and restricted fluid passages formed in the shaft 221 with the adjustable valves 260, 267 positioned in the shaft 221 to be accessible when the actuator 200 is mounted onto the support 201.

The main difference with the actuator 100 will now be described, which main difference is mainly due to the strength of the actuator 200, as it does not need to handle as large a force as the actuator 100. Therefore, fewer fixture sets 205, 206, 207 may be used, which also do not need to be inserted through the actuator 200 in the region between the roller bearings 223, 224. Therefore, there are no fixation members 130, 141 in the actuator 200 and only a single roller bearing 123, 124 is provided between each connection member 212, 213 and the tubular cylinder barrel 218.

Moreover, since the ring 230 only functions as the first actuation member and not, contrary to actuator 100, as a fixation member, it is possible to interchange the roles of the actuation members 230, 231. As such, the first actuation member 230 may be coupled to the shaft 221 with the second actuation member being formed by the collar 220, thereby reducing the total height of the actuator 200.

It will be readily appreciated that, in other embodiments, the collar 220 does not form the second actuation member, but a separate ring 231 is provided that is irrotatably fixed to the tubular cylinder barrel 218 by a pin 237. Moreover, the roles of the actuation members 230, 231 may also be interchanged thereby forming an energy storing mechanism that is identical to the one in the actuator 100.

As with the actuator 100, the roller bearings 223, 224 are axially fixed. Specifically, the outer race 225 axially engages a transverse surface formed on the tubular cylinder barrel 218, the inner race 226 axially engages a transverse surface formed by the first connection member 212, the outer race 227 axially engages a transverse surface formed by the second connection member 213, and the inner race 228 axially engages a transverse surface formed by the annular closing member 245, which is preferably screwed in the tubular cylinder barrel 218. This, as described above, is an advantageous configuration as it enables the bearings 223, 224 to transfer longitudinally directed forces from the shaft 221 to the tubular cylinder barrel 218.

Figure 10C:
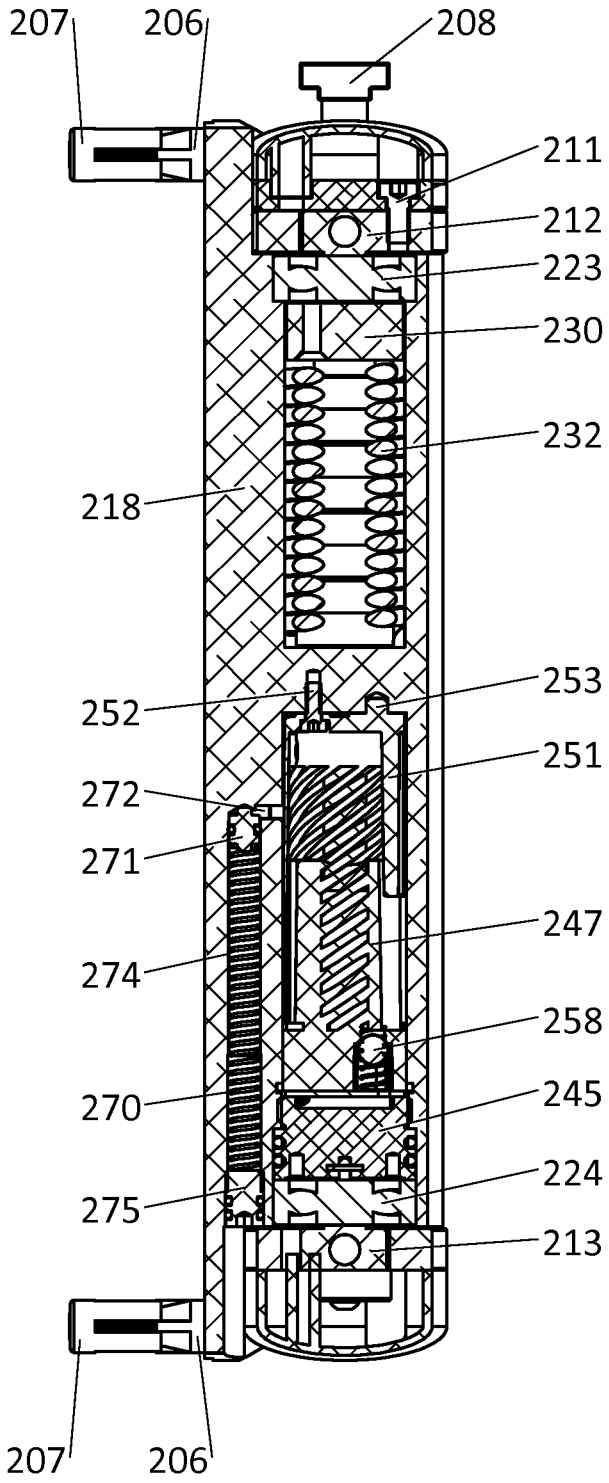

FIG. 10C shows another longitudinal cross-section through the actuator 200, illustrating one of the expansion channels 270. Specifically, the expansion channel 270 is connected to the low pressure compartment of the closed cylinder cavity 244 via a channel 272. The expansion channel 270 comprises a compression spring 274 and a slideable piston 271 and is closed of by the end cap 275. The expansion channels 270 operate in an identical fashion as described above for actuator 100.

Third Embodiment

Figure 11A:
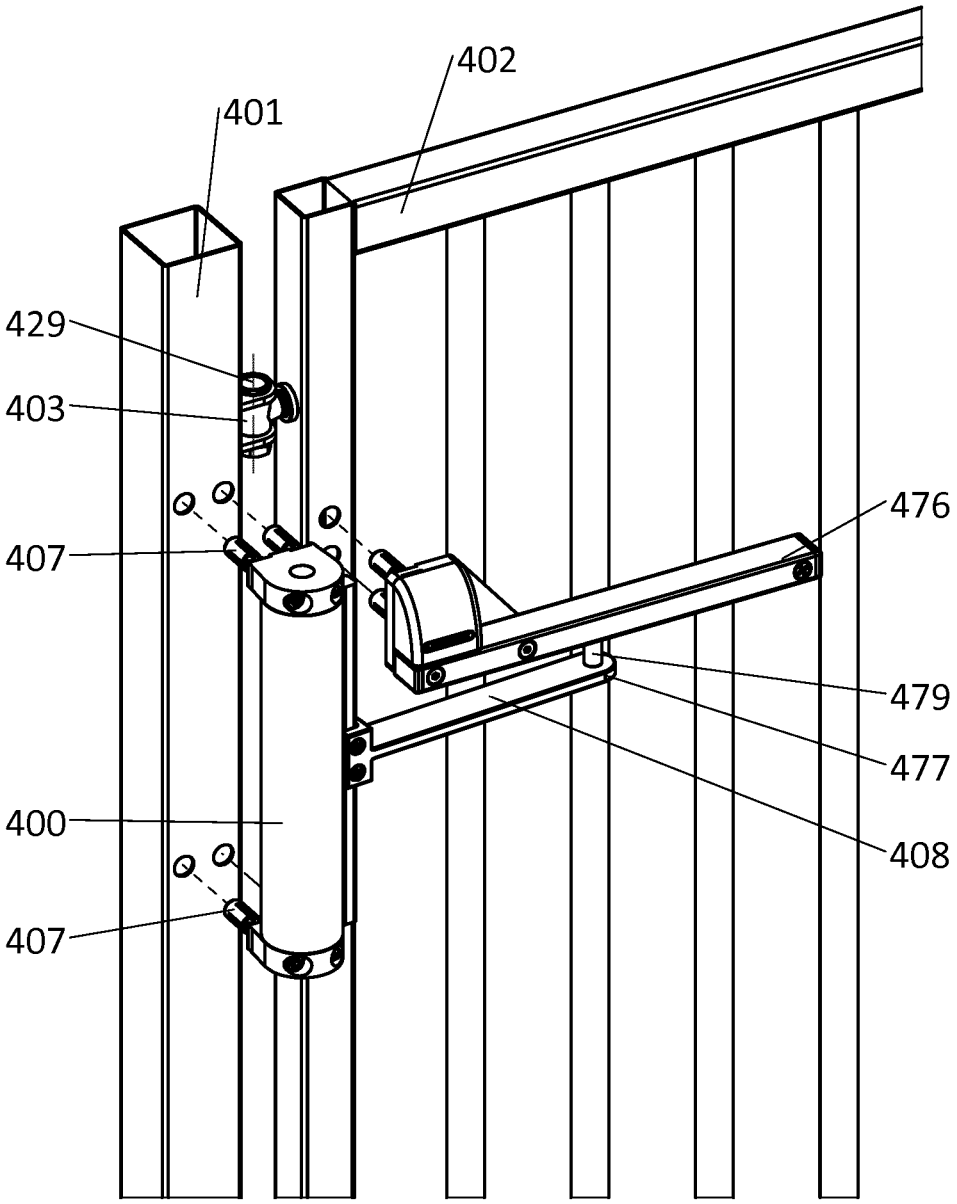
FIG. 11A shows a variant of the actuator of FIG. 8.
Figure 11B:
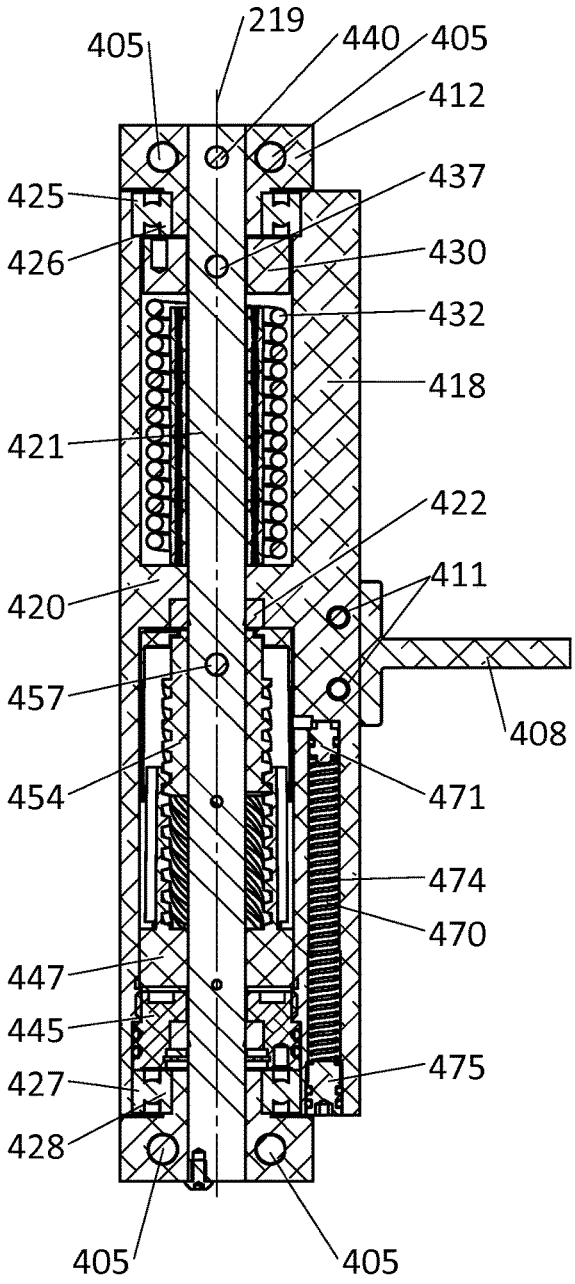
FIGS. 11B and 11C show longitudinal cross-sections through the actuator of FIG. 11A.
Figure 11C:
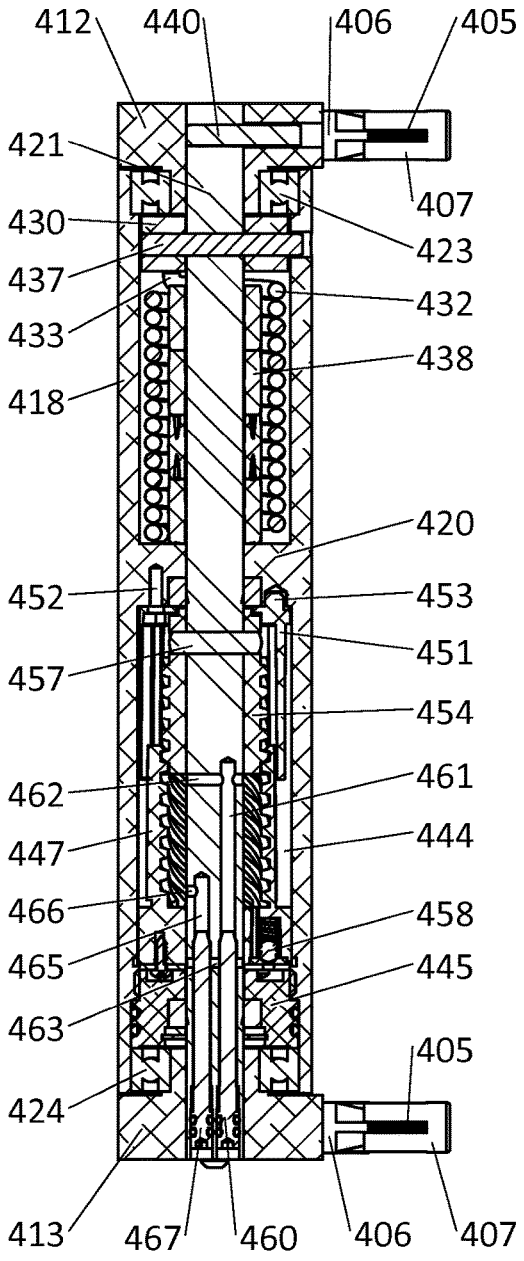

FIGS. 11A to 11C illustrate another embodiment of an actuator 400 according to the present invention. Elements or components previously described with reference to FIGS.

1A to 10C bear the same last two digits but preceded by a '4'. In particular, the actuator 400 is a variant of the actuator 200. In this actuator 400, the shaft 421 is fixed to the support 401 and the extended arm 408 irrotatably fixes the tubular cylinder barrel 418 to the closure member 401. More generally, in this actuator 400, the first member of the closure system is the closure member 402 and the second member of the closure system is the support 401.

FIGS. 11B and 11C show longitudinal cross-sections through the actuator 400. The main difference with actuator 200 is that the connection members 412, 413 are now directly bolted to the support 401 using four fixture sets 405, 406, 407, while the extended arm 408 is fixed to the outside of the tubular cylinder barrel 408 by bolts 411. Both the energy storing mechanism and the damping mechanism are identical to actuator 200 as the shaft 421, although being fixed, will still be relatively rotating with respect to the tubular cylinder barrel 418, that will rotate upon opening or closing the closure system.

Fourth Embodiment

FIGS. 12A to 17B illustrate another embodiment of an actuator 300 according to the present invention. Elements or components previously described with reference to FIGS. 1A to 11C bear the same last two digits but preceded by a '3'.

The actuator 300 is designed to be used as a hinge in a closure system having a support 301 with a closure member 302. Specifically, the actuator 300 is designed to be inserted in the closure member 302 with the mechanical connector 308 comprising multiple components. The tubular cylinder barrel 318 is irrotatably fixed to the closure member 302 due to its rectangular, in particular square, shape and is preferably also bolted thereto by at least one, preferably at least two, bolts 399. As such, as with the actuator 400 described with respect to FIGS. 11A to 11C, the first member of the closure system is the closure member 302 and the second member of the closure system is the support 301.

The mechanical connector 308 comprises a support element 383 that is fixedly connected to the support 301 using two fixture sets 305, 306, 307. The mechanical connector 308 further comprises a connection element 384 in which an extremity of the shaft 321 is securely fixed by a bolt 385, the connection element 384 being securely fixed to the support element 383 as described below. The support element 383, the connection element 384, and the bolt 385 thus act similar to the connection members 112, 113, 212, 213 and the bolts 111, 211 of the actuators 100, 200, i.e. to fix the shaft 321 to one of the members 301, 302 of the closure system. It will be readily appreciated that the support element 383 and the connection element 384 may be integrally formed.

It will be further appreciated that the support element 383 may be omitted from the mechanical connector 308, especially in an embodiment where the closure member 302 is mounted directly to a ground surface. In such a case, the connection element 384 may be fitted into a corresponding hole in the ground surface, in which case the ground directly forms the support 301 and there is no need for a support element 383. As such, in this embodiment, the mechanical connector comprises the connection element 384 and the bolt 385.

It will also be appreciated that the extremities of the shaft 321 may have a non-circular horizontal cross-section that matches a non-circular opening in the connection element 384. These non-circular cross-sections then also irrotatably fix the connection element 384 to the shaft 321. In other words, the bolt 385 is also not necessarily provided as a part of the mechanical connector 308.

In the illustrated embodiment, see in particular FIGS. 13A to 14B, hinge elements are provided between the mechanical connector 308 and the closure member 302 thereby enabling a smooth rotation of the closure member 302, including the tubular cylinder barrel 318, with respect to the shaft 321 that is fixedly connected to the support 301. The hinge elements include a roller bearing 386, in particular a steel roller bearing, that is mounted in a support member 387 that is bolted to the support element 383 by a bolt 388. The support member 387 is shaped such that the connection element 384 fits therein and is thereby fixed between the support member 387 and the support element 383 that are fixedly connected by the bolt 388. The roller bearing 386 has an outer race 391 that is supported by the support member 387, i.e. the outer race 391 both radially and axially engages the support member 387. Moreover, in the illustrated embodiment, see in particular FIGS. 13A to 14B, a connection member 389 is also provided that is fixedly connected to the closure member 302 by a fixture set 305, 306, 307. This connection member 389 is also placed around the shaft 321 and is free to rotate with respect to the shaft 321. Specifically, the connection member 389 is designed such that the inner race 390 of the roller bearing 386 is both radially and axially engaged by the connection member 389.

The configuration of the roller bearing 386 with the connection member 389 and the support member 387 ensures that the longitudinal, i.e. axially directed, forces generated by, in particular the weight of, the closure member 302 are transmitted from the connection member 389 via the roller bearing 386, in particular from the inner race 390 to the outer race 391, to the support member 387 that is fixedly connected to the support 301. Preferably, the roller bearing 386 is a ball bearing, in particular a steel ball bearing, as this is more suited to transmit forces in the axial direction.

It will be readily appreciated that the hinge elements 386, 387, 388, 389 may be omitted, in which case the weight of the closure member 302 will be borne by the roller bearings 323, 324 inside the actuator 300.

It will be appreciated that, as with the actuator 100, the longitudinal axis 319 of the actuator 300 is also in line with the hinge axis 329, specifically, both axes 319, 329 are identical, because, the actuator 300 acts as the hinge for the closure system.

Moreover, the roller bearing 386 could also be placed with its inner race 390 directly contacting the shaft 321 and its outer race 391 engaging the connection member 389. This could be achieved by providing a connection member 389 that does not include the annular sleeve portion and by providing a roller bearing 386 having a smaller diameter. However, as described above for actuator 100, the roller bearing 386 needs to transfer longitudinally directed forces, therefore, providing a roller bearing 386 having a larger diameter, i.e. having a larger surface area of the races 390, 391, is clearly advantageous.

Figure 12A:
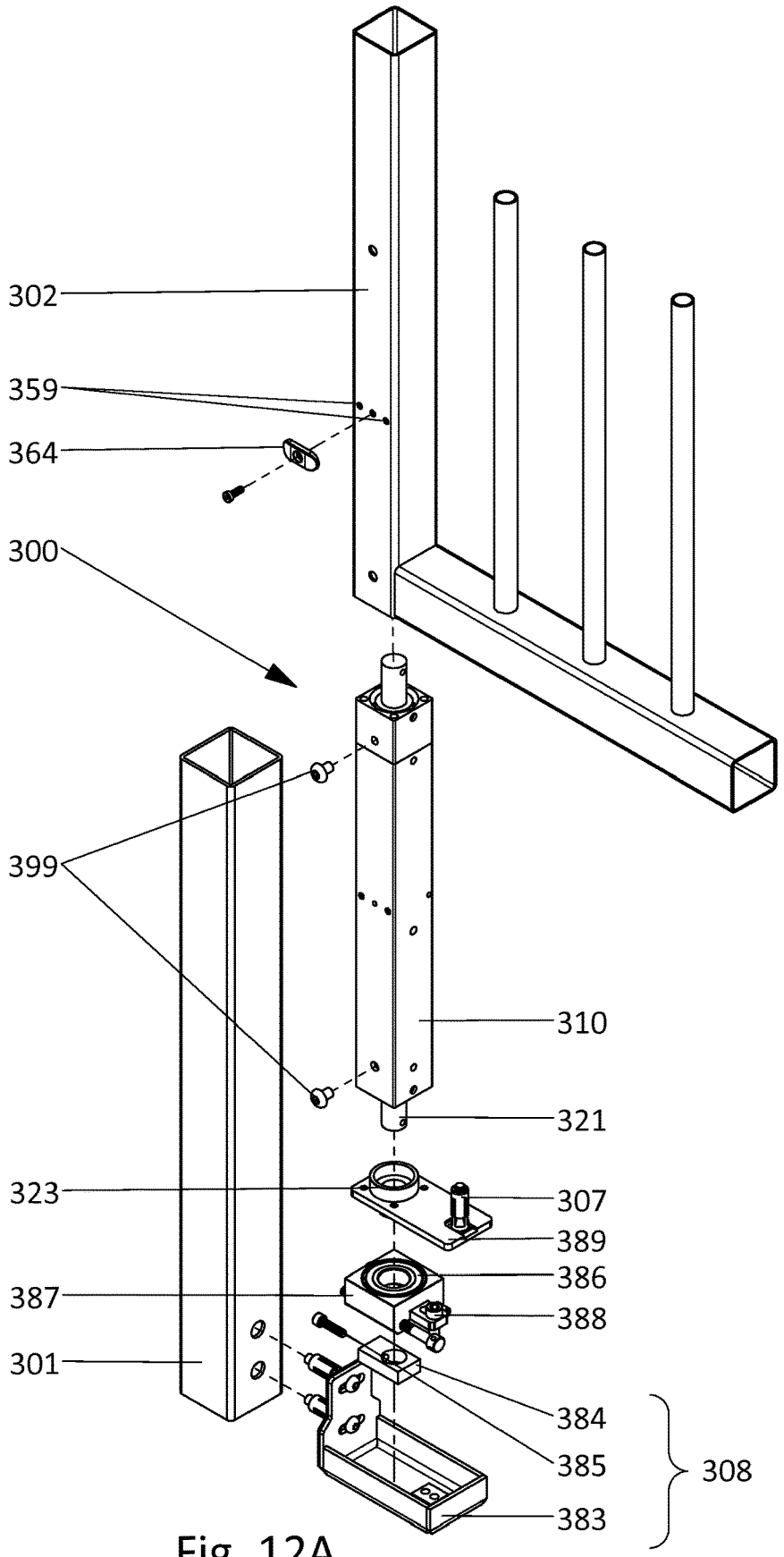
FIGS. 12A and 12B show how a hydraulically damped actuator according to yet another embodiment of the present invention is to be mounted into a closure member of a left-handed closure system and into a closure member of a right-handed closure system respectively.
Figure 12B:
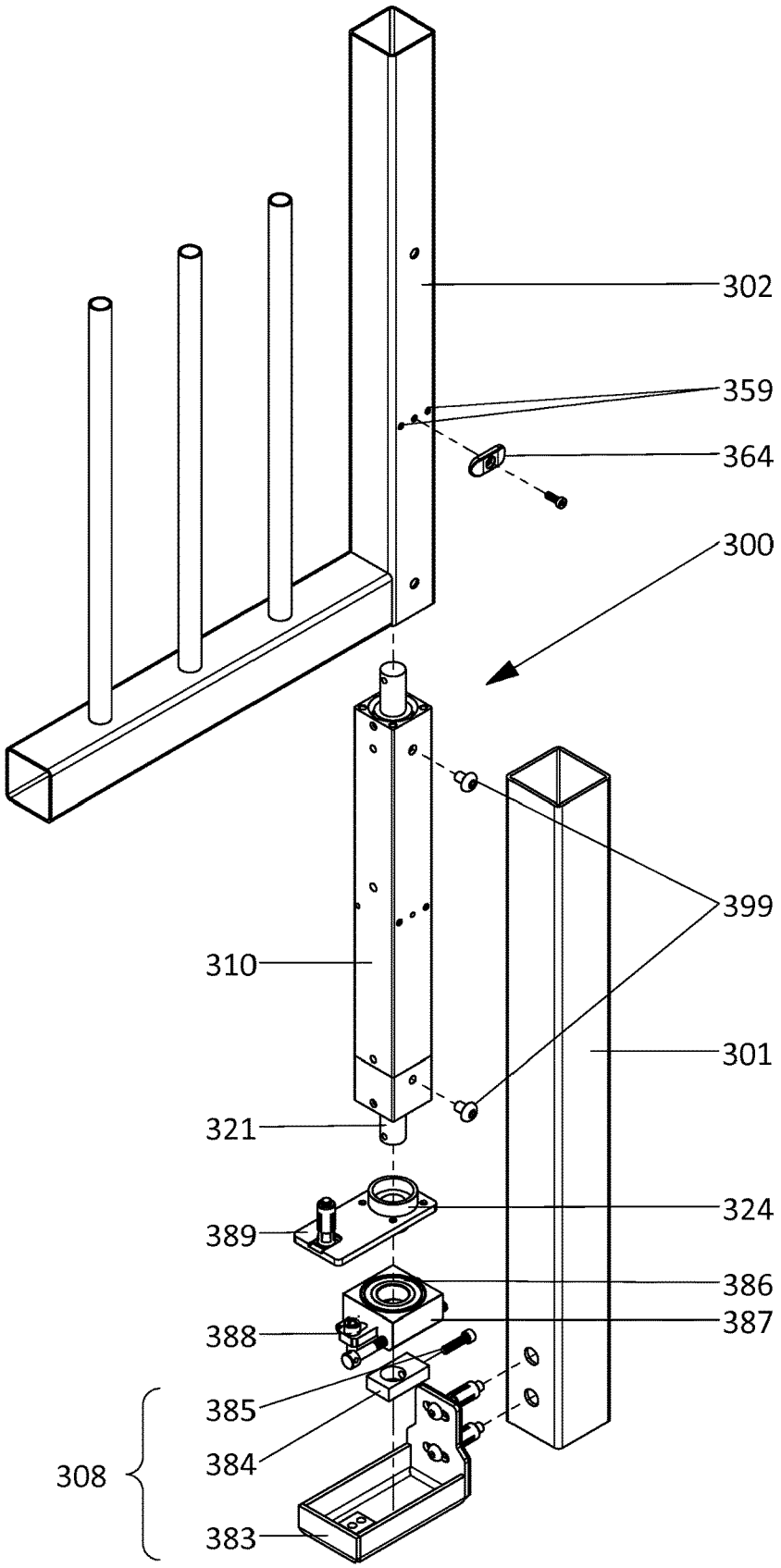

FIG. 12A shows how the actuator 300 is mounted for a right-handed closure system, while FIG. 12B shows how the actuator 300 is mounted for a left-handed closure system. The main difference is that the main body 310 of the actuator 300 is mounted in opposite orientations, as is clearly visible in the longitudinal cross-sections in FIGS. 13A to 14B.

Figure 13A:
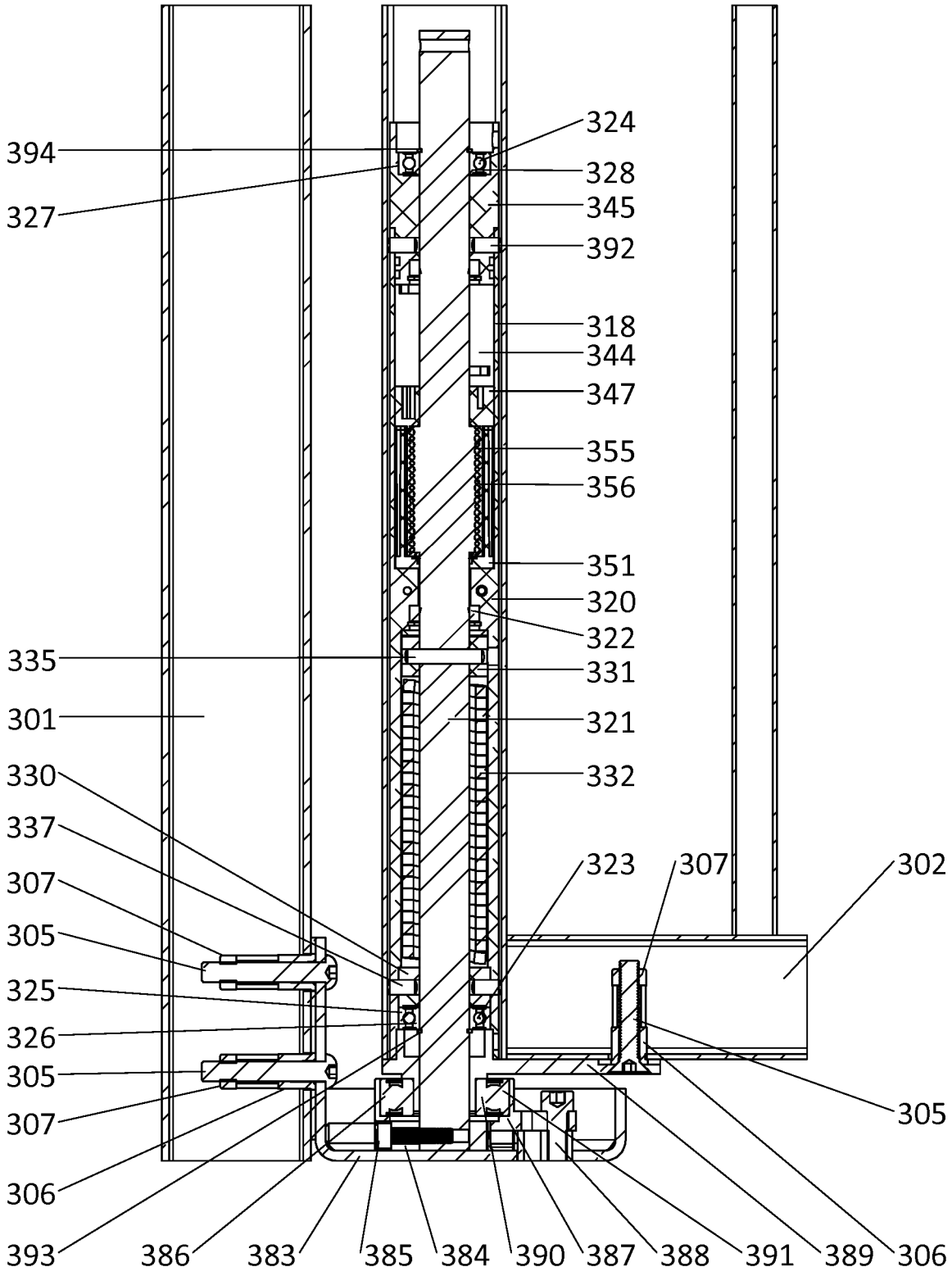
FIGS. 13A and 13B show a longitudinal cross-section through the actuator of FIGS. 12A and 12B respectively when mounted in the closure member.
Figure 13B:
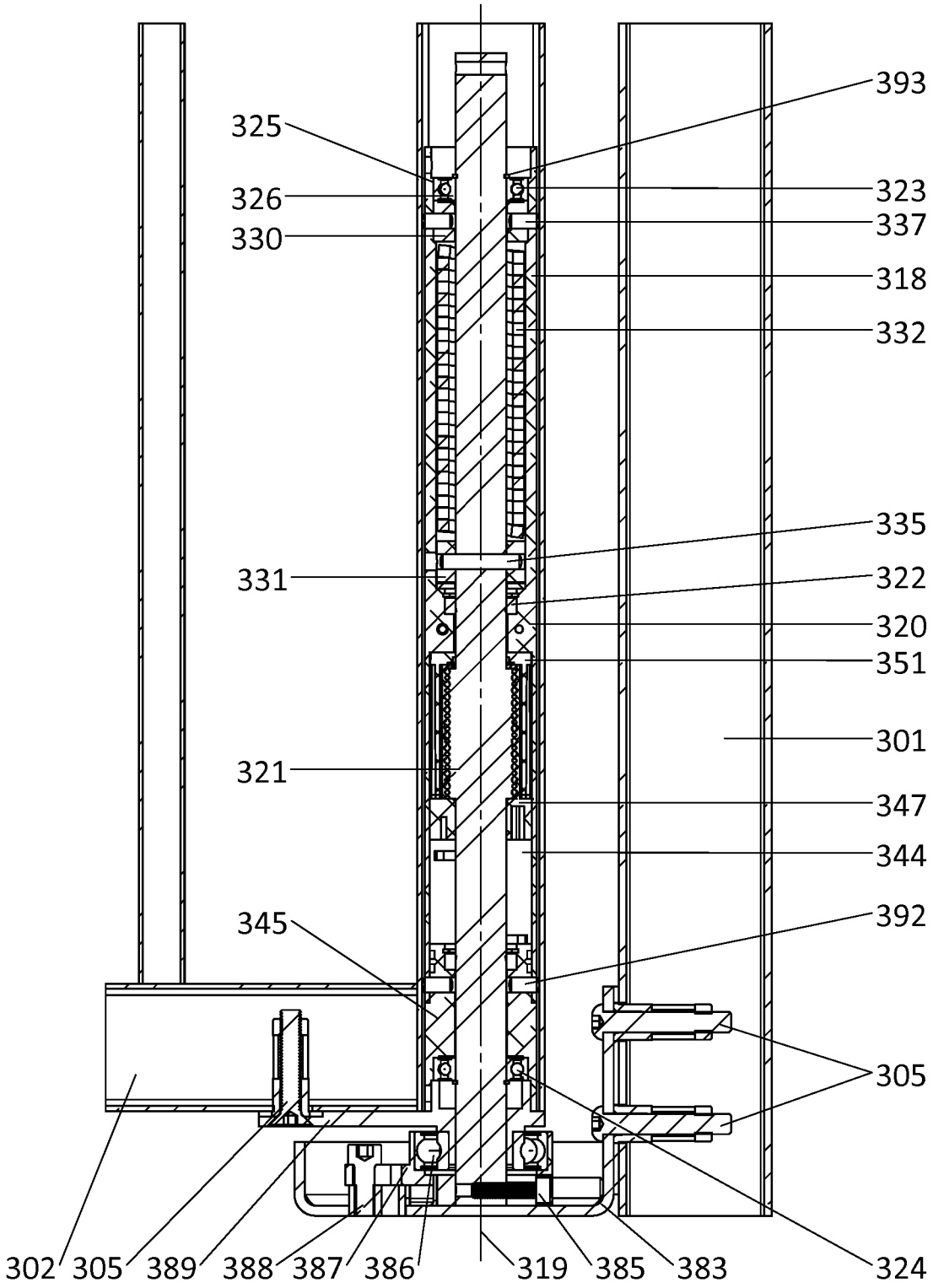

FIGS. 13A and 13B show two longitudinal cross-sections through the actuator 300. Generally, the actuator 300 has a similar internal structure as the actuators 100, 200, 400. Specifically, the energy storing mechanism also comprises two actuation members 330, 331 with a torsion spring 332 between them, one of the actuation members 330, 331 being fixed to the shaft 321 by a pin 335 and the other one to the tubular cylinder barrel 318 by a pin 337, in particular two such pins. In the illustrated embodiment, no padding 338 is provided between the torsion spring 132 and the shaft 321, but it will be appreciated that this may be included. As with the actuators 200, 400, the roles of the actuation members 330, 331 may be interchanged, i.e. the first actuation member 330 may be coupled to the shaft 321 with the second actuation member 331 being coupled to the tubular cylinder barrel 318. Advantageously, because the second actuation member 331 is located adjacent to the collar 320, it is also possible that the collar 320 acts as the second actuation member 331 thereby reducing the total height of the actuator 300 as illustrated for actuator 200 in FIGS. 10A and 10B and for actuator 400 in FIGS. 11B and 11C.

Furthermore, as in the actuators 100, 200, 400, the roller bearings 323, 324 also ensure that the shaft 321 cannot move in the direction along the longitudinal axis 319. Specifically, both of the roller bearings 323, 324 are radially engaged with their outer races 325, 327 to the tubular cylinder barrel 318 and are axially engaged with their outer races 325, 327 against an element that is fixed to the tubular cylinder barrel 318, i.e. the first actuation member 330 for roller bearing 323 and the annular closing member 345 for the roller bearing 324. Moreover, both of the roller bearings 323, 324 are radially engaged with their inner races 326, 328 to the shaft 321 and are axially engaged with their inner races 326, 328 against a fastening ring 393, 394 that is fixed in a groove in the shaft 321 as illustrated in FIGS. 13A and 13B.

Figure 14A:
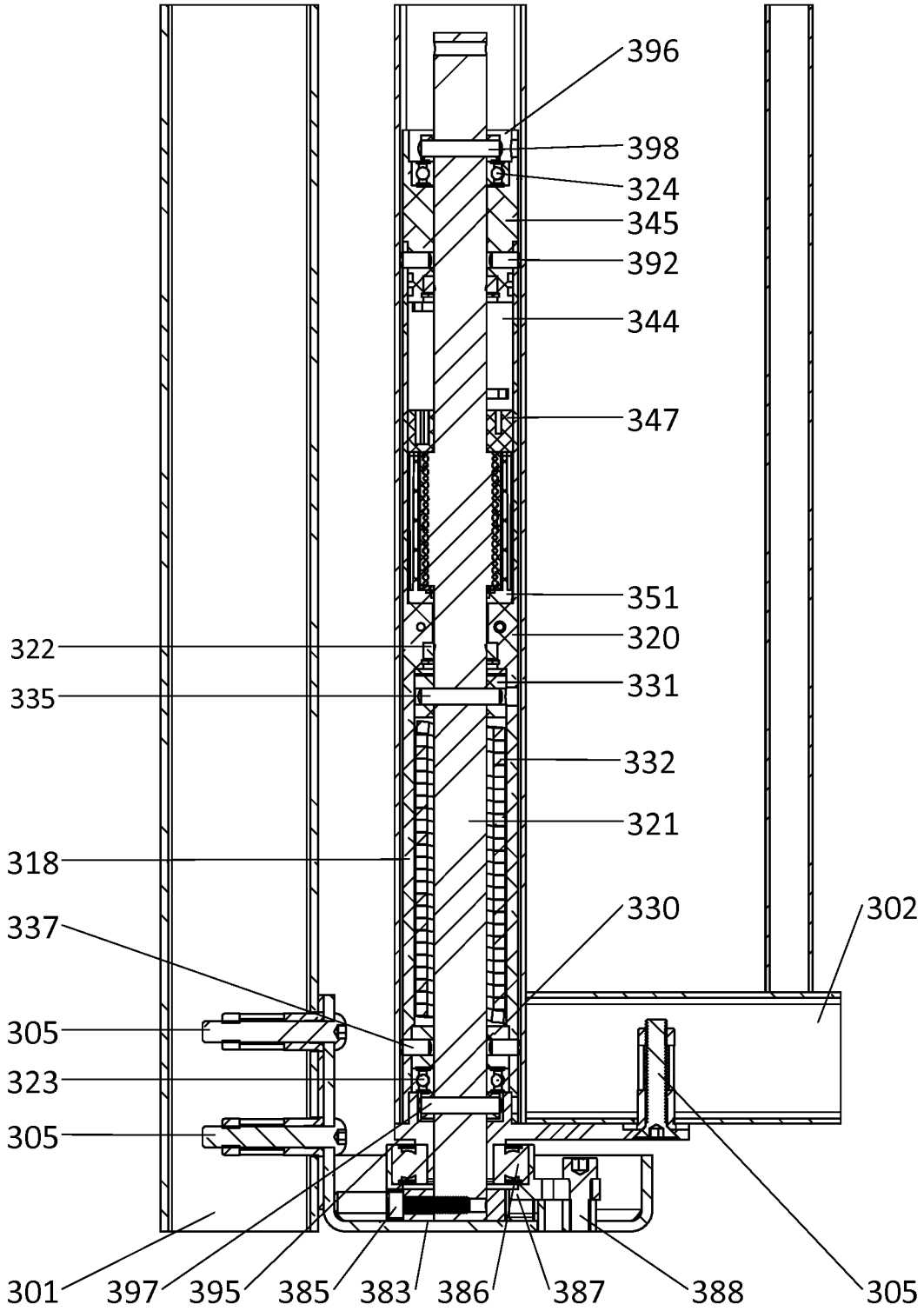
FIGS. 14A and 14B show a longitudinal cross-section through a minor variation of the actuator of FIGS. 12A and 12B respectively when mounted in the closure member.
Figure 14B:
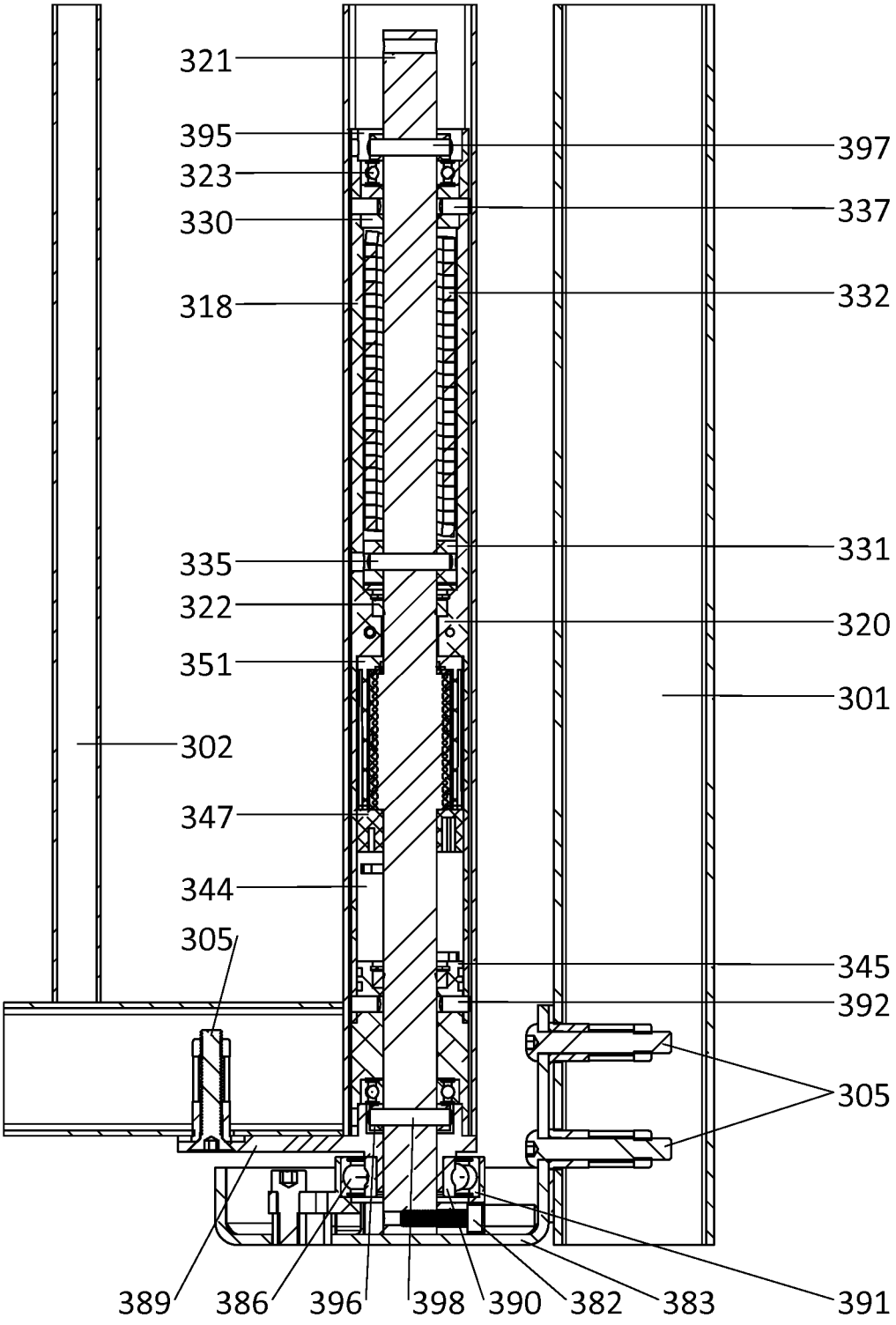

FIGS. 14A and 14B show a minor variation by replacing the fastening rings 393, 394 with rings 395, 396 that are fixed to the shaft 321 with transversally inserted pins 397, 398. This is advantageous as the rings 395, 396 are more securely fixed to the shaft 321.

The actuator 300 also comprises a damping mechanism having a closed cylinder cavity 344 with a guiding element 351 bolted into the collar 320 preventing rotation of the piston 347. Contrary to the actuators 100, 200, 400, there is no separate spindle, rather this is integrally formed with the shaft 321. In other words, the shaft 321 is provided with the outer threaded portion 355 that cooperates with the inner threaded portion 356 on the piston 347. Therefore, the shaft 321 directly drives the piston 347 to slideably move inside the closed cylinder cavity 344. The damping mechanism further comprises a one-way valve enabling hydraulic fluid to flow from the high pressure compartment to the low pressure compartment when opening the closure system.

Figure 15:
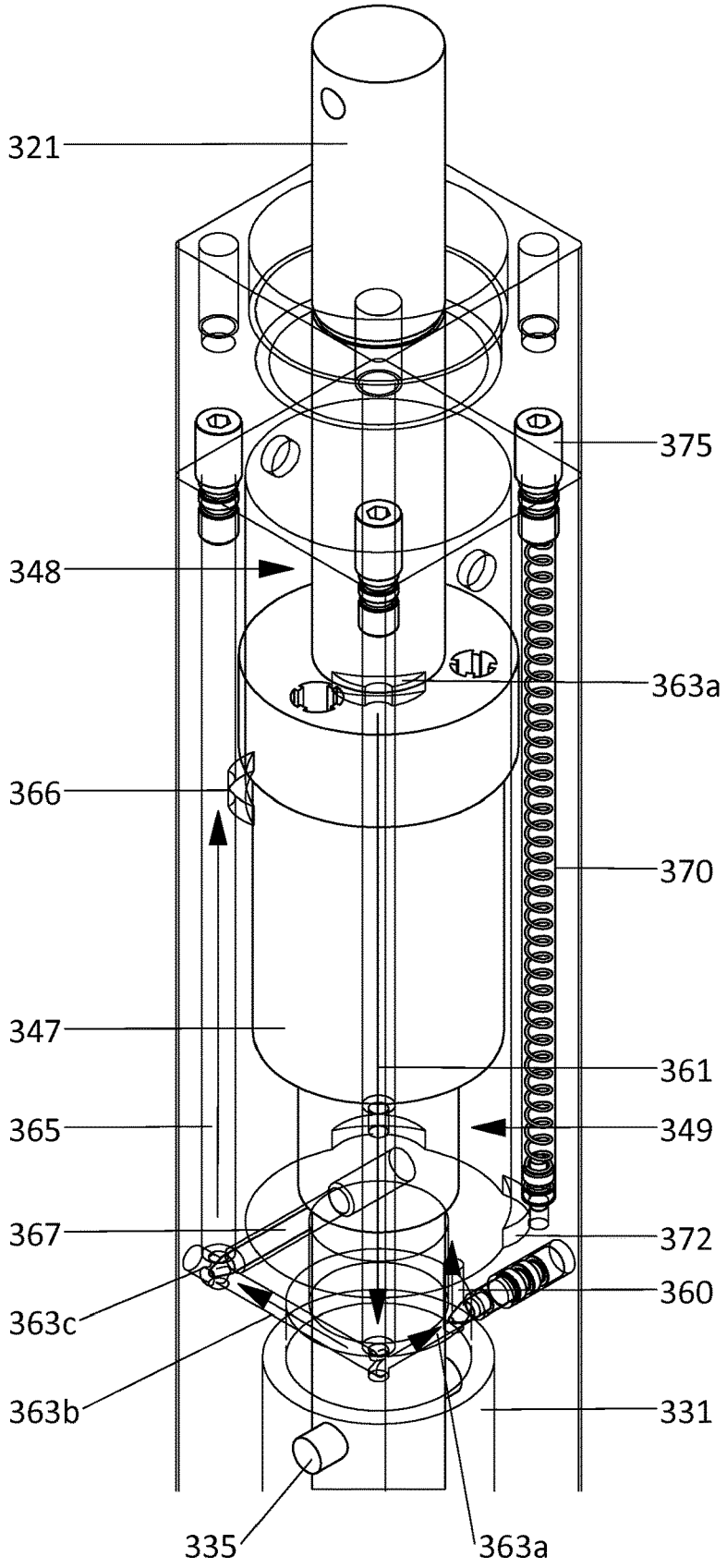
FIG. 15 shows a perspective view of the damping mechanism illustrating the restricted fluid passages.

One of the main differences of the actuator 300 with respect to the actuators 100, 200, 400 is that the second extremity of the shaft 321 is not necessarily readily accessible when the actuator 300 is mounted in the closure member 302. As such, it is not convenient to provide the adjustable valves 360, 367 inside the shaft 321. To overcome this problem, the damping mechanism in actuator 300 is provided with restricted fluid passages formed in the tubular cylinder barrel 318 as illustrated in FIG. 15 which shows a perspective view of the damping mechanism with the piston 347 in its nearly closed position such that hydraulic fluid may flow through both restricted fluid passages from the high pressure compartment 348 to the low pressure compartment 349 of the closed cylinder cavity 344 as indicated by the black arrows.

A first restricted fluid passage is formed by an inlet bore 363*a*, formed by a hole in the interior wall of the tubular cylinder barrel 318. The inlet bore 363*a* connects the high pressure compartment 348 to bore 361 in the tubular cylinder barrel 318 that extends in the direction of the longitudinal axis 319 and ends near the middle of the collar 320 in a bore 363*d* that runs transversally through the collar 320. The adjustable valve 360 is inserted in the bore 363*a* and is, as such, accessible from the outside of the actuator 300. Near the tip of the adjustable valve 360 a bore 362 is provided in the collar 320, which bore 362 extends in the direction of the longitudinal axis 319 and connects the bore 363*d*, and thus the high pressure compartment 348, to the low pressure compartment 349.

A second restricted fluid passage is formed by the same inlet bore 363*a* and the same bore 361 that ends near the middle of the collar 320 and connects with a bore 363*b* that runs transversally through the collar 320. The bore 363*b* intersects with a bore 363*c* which also runs transversally through the collar 320 and in which the adjustable valve 367 is inserted. As such, the adjustable valve 367 is accessible from the outside of the actuator 300. At the intersection of the bores 363*b*, 363*c*, another bore 365 is provided that extends in the direction of the longitudinal axis 319 and connects to an outlet bore 366 formed by a hole in the interior wall of the tubular cylinder barrel 318 located above the piston 347, when the piston 347 is almost in its most extended position.

Figure 16A:
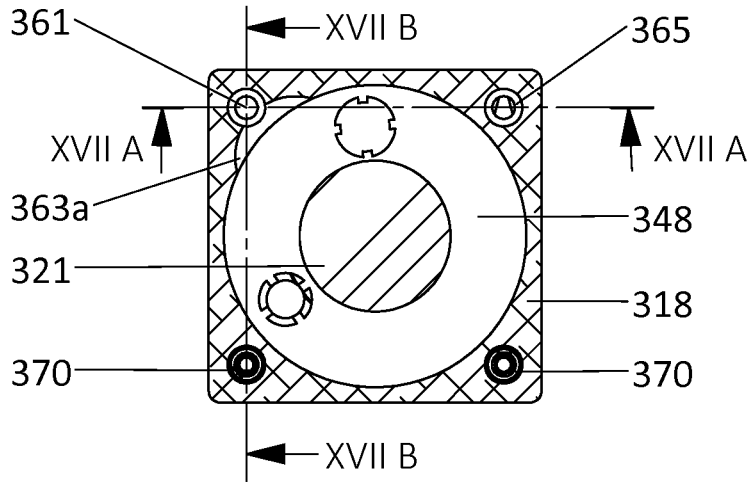
FIGS. 16A to 16C show horizontal cross-sections through the damping mechanism illustrated in FIG. 15.
Figure 16B:
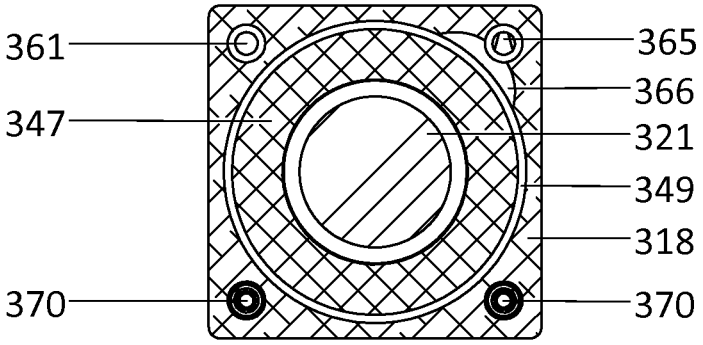
Figure 16C:
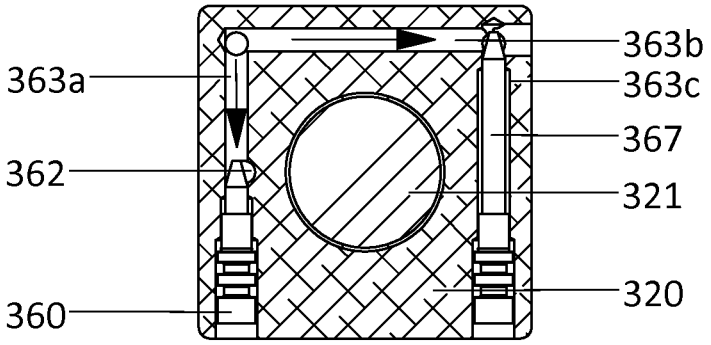
Figure 17A:
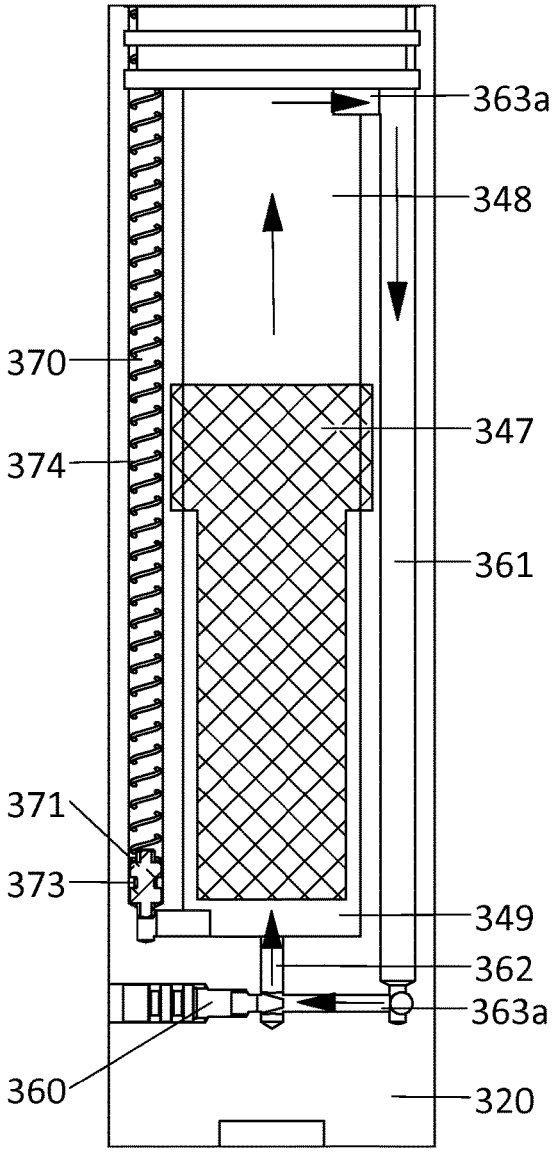
FIGS. 17A and 17B show longitudinal cross-sections through the damping mechanism along the planes "xviiA" and "xviiB" indicated in FIG. 16A.
Figure 17B:
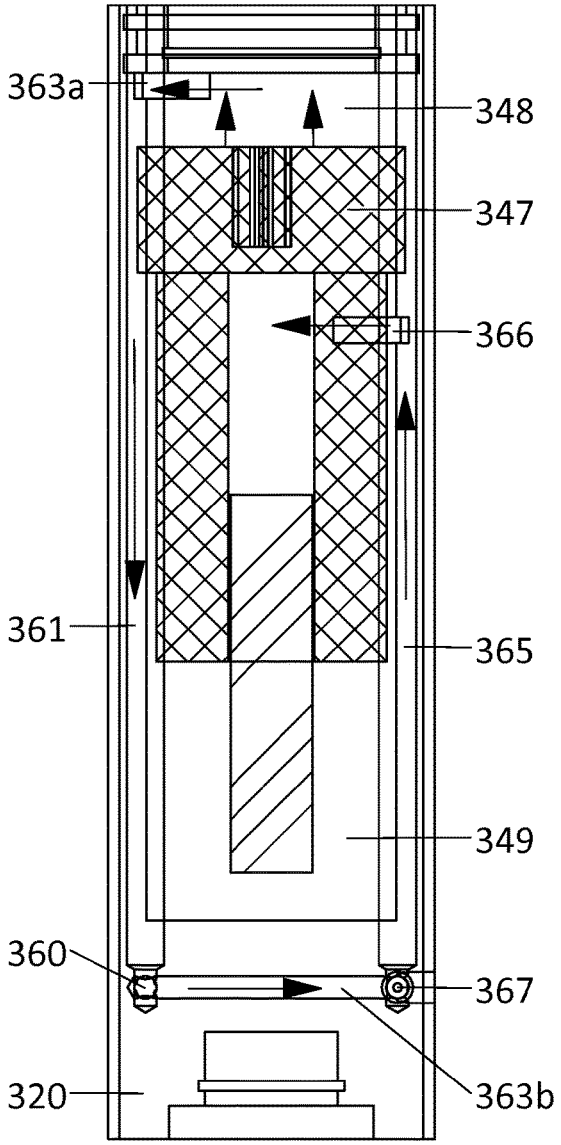
Figure 18A:
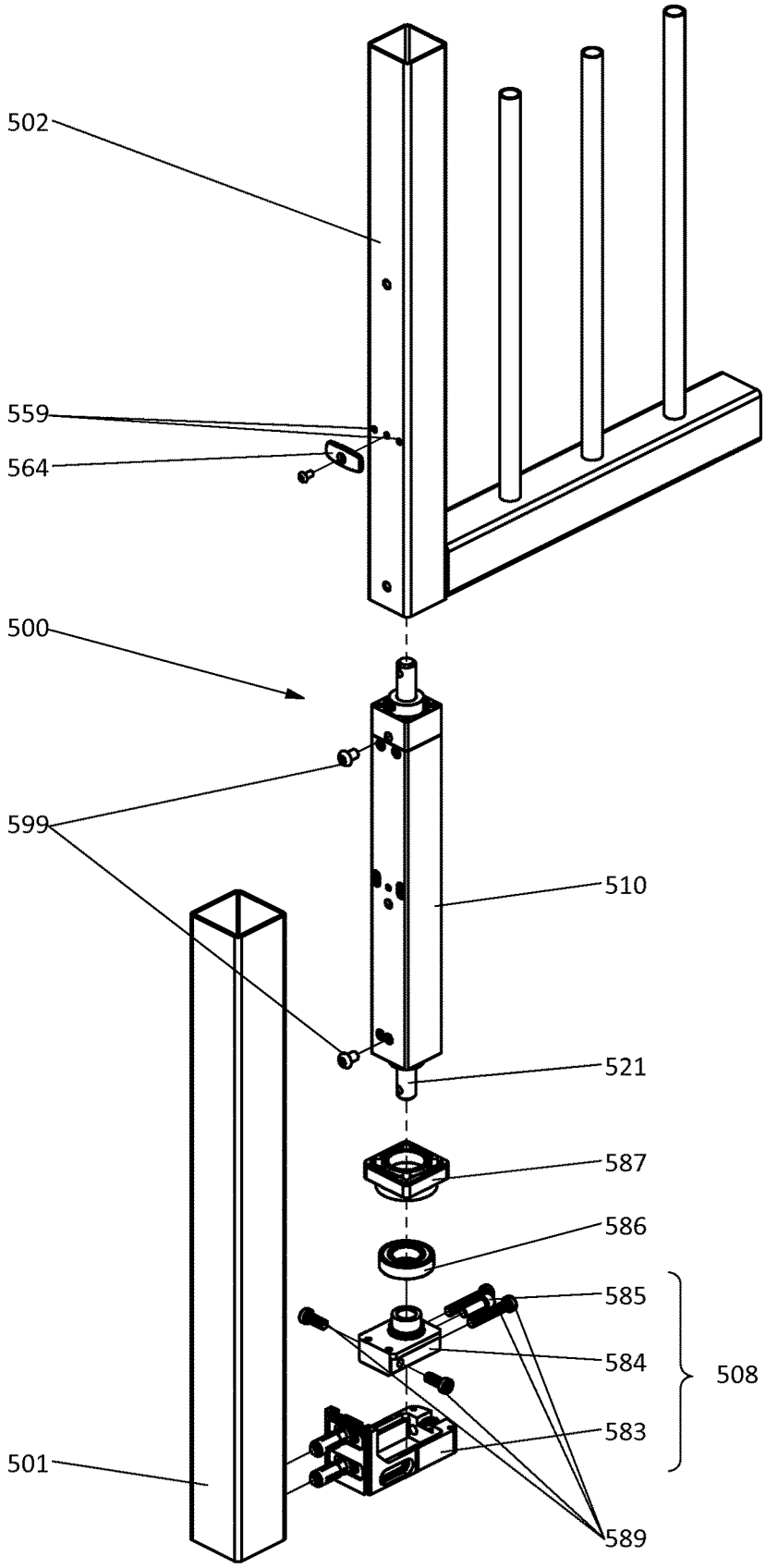
FIGS. 18A and 18B show a variation in mounting the hydraulically damped actuator of FIGS. 12A and 12B into a closure member of a left-handed closure system and into a closure member of a right-handed closure system respectively.
Figure 18B:
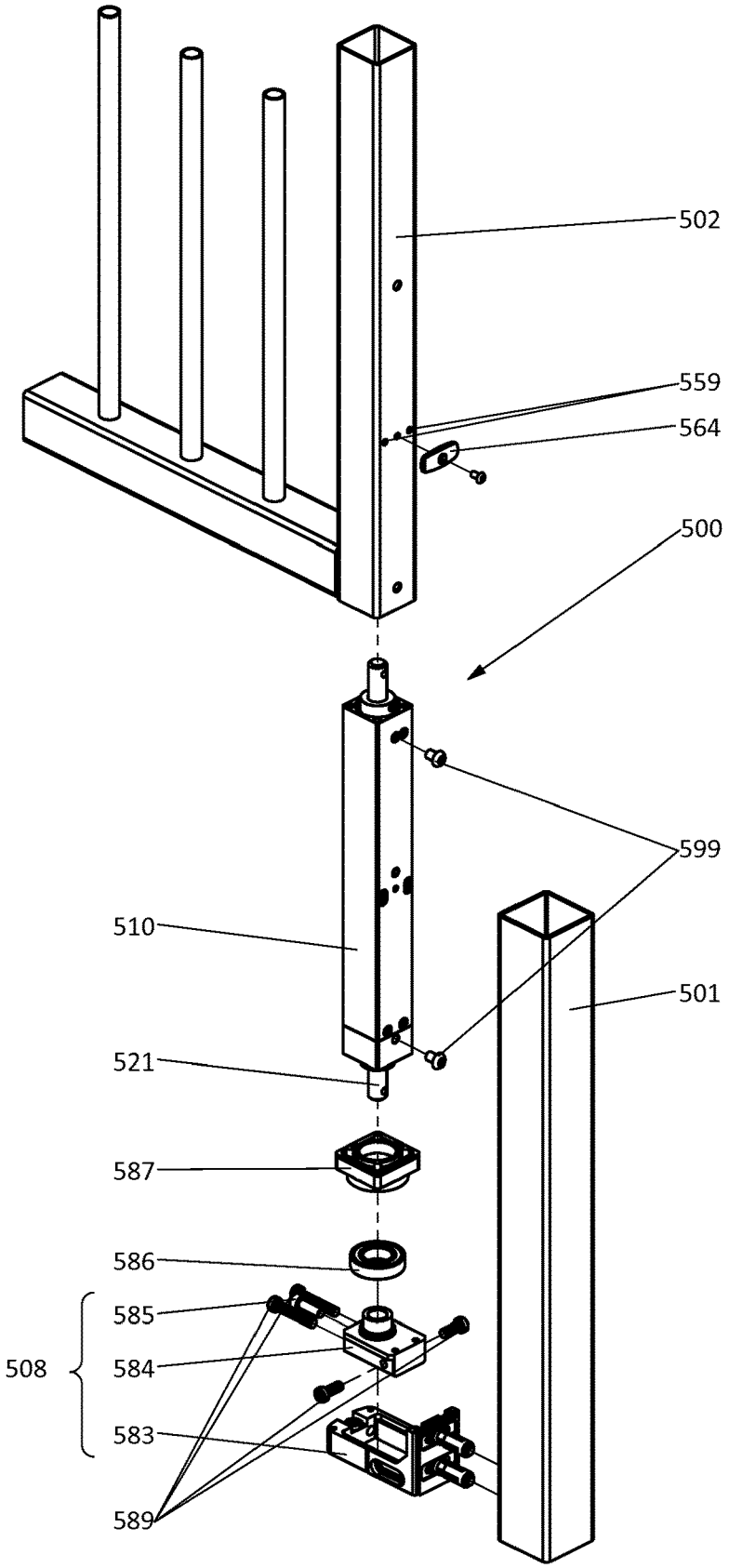
Figure 19A:
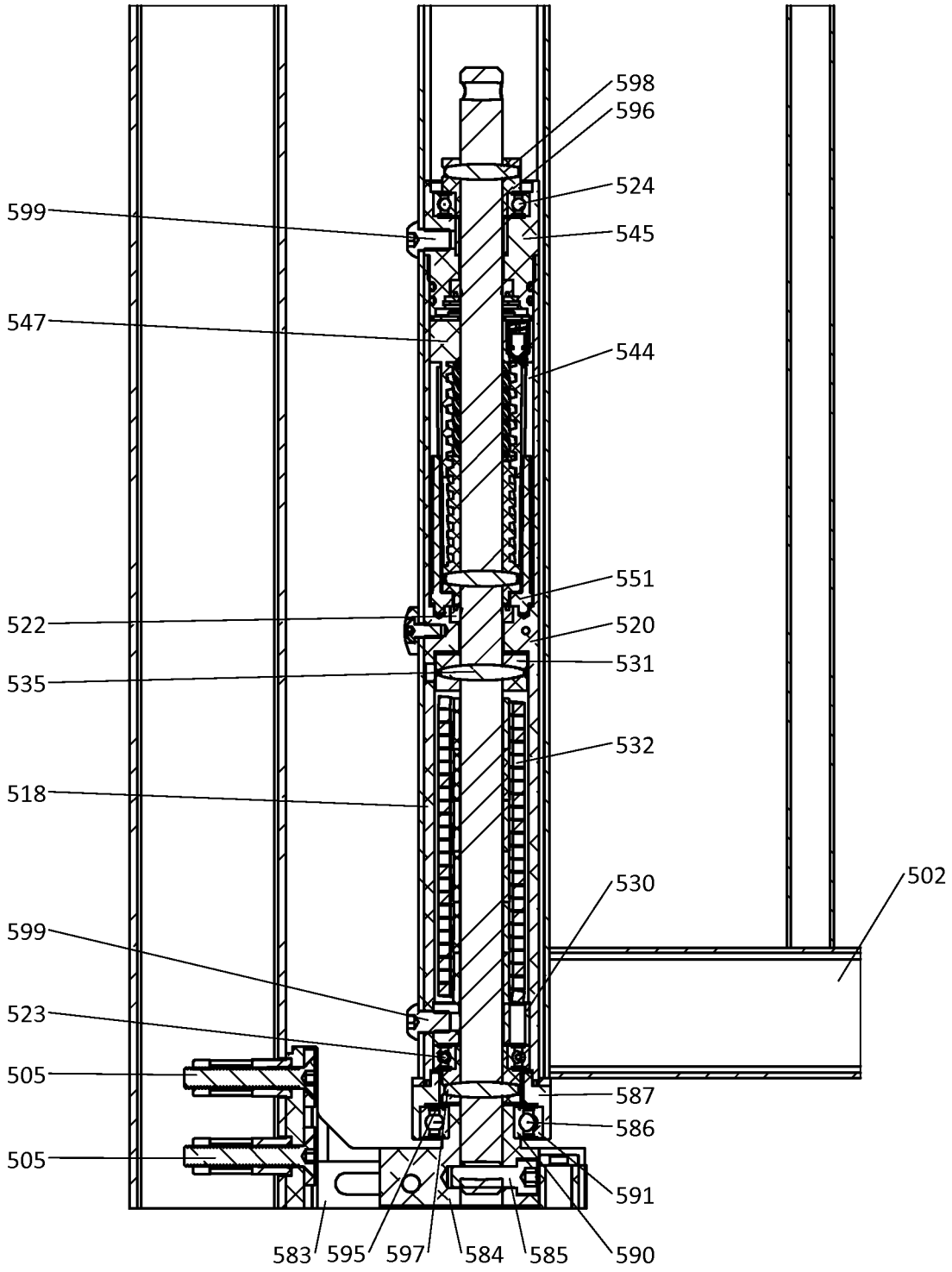
FIGS. 19A and 19B show a longitudinal cross-section through the actuator of FIGS. 18A and 18B respectively when mounted in the closure member.
Figure 19B:
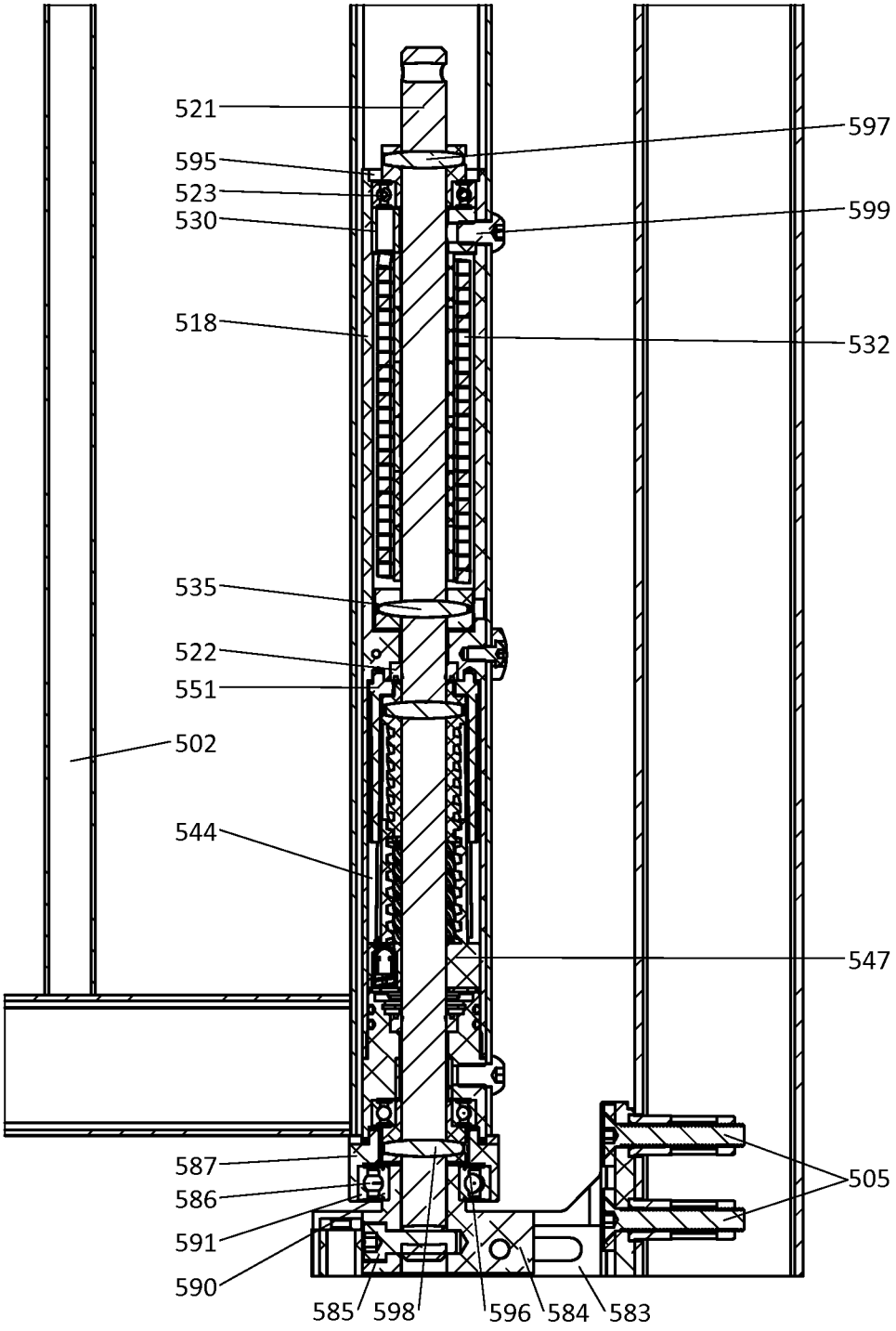

This configuration is shown in more detail in FIGS. 16A to 17B. FIGS. 16A to 16C show three horizontal cross-sections through the damping mechanism. FIG. 16A is taken at the height of the inlet bore 363*a*, FIG. 16B is taken at the height of the outlet bore 366, and FIG. 16C is taken at the height of the collar 320. FIGS. 17A and 17B show longitudinal cross-sections through the damping mechanism along the lines "xviiA" and "xviiB" respectively in FIG. 16A with the piston 347 at different positions.

The main advantage of providing the adjustable valves 360, 367 in the bore 320 is that the bore 320 is centrally located with respect to the actuator 300. As such, irrespective of the orientation of the longitudinal axis 319 of the actuator 300, e.g. upright or upside down, the adjustable valves 360, 367 are positioned at the same height enabling openings 359 (see FIGS. 12A and 12B) to be provided in the closure member 302 to access the adjustable valves 360, 367 thereby enabling adjustment of the adjustable valves 360, 367. As illustrated in FIGS. 12A and 12B a cover 364 is preferably provided that is bolted to the closure member 302 to cover the openings 359 thereby preventing water and/or dirt from entering the openings 359 and preventing access to the adjustable valves 360, 367.

It will be readily appreciated that the restricted fluid passages may also be provided in the shaft 321 as in the actuators 100, 200, 400, especially when there are no adjustable valves 360, 367.

FIGS. 15 to 17B also illustrate the expansion channels 370. Specifically, the expansion channels 370 are connected to the low pressure compartment of the closed cylinder cavity 344 via a channel 372. The expansion channels 370 comprises a compression spring 374 and a slideable piston 371 and are closed of by the end cap 375. The expansion channels 370 operate in an identical fashion as described above for actuators 100, 200, 400.

Fifth Embodiment

FIGS. 18A to 19B illustrate another embodiment of an actuator 500 according to the present invention. Elements or components previously described with reference to FIGS. 1A to 17C bear the same last two digits but preceded by a '5', with the exception of reference number 589. In particular, the actuator 500 is a variant of the actuator 300 with a revised mechanical connector 508. In other words, the actuator 500 is designed to be inserted in the closure member 502 with the mechanical connector 508 comprising multiple components. A main difference with respect to the actuator 300 is that there is no connection member 389 present in the actuator 500.

The mechanical connector 508 comprises a support element 583 that is fixedly connected to the support 501 using two fixture sets 505, 506, 507. The mechanical connector 508 further comprises a connection element 584 in which an extremity of the shaft 521 is securely fixed by a bolt 585, the connection element 584 being securely fixed to the support element 583 by means of four bolts 589 that are inserted through openings in the connection element 584 into holes in the support element 583. The support element 583, the connection element 584, and the bolt 585 thus act similar to the connection members 112, 113, 212, 213 and the bolts 111, 211 of the actuators 100, 200, i.e. to fix the shaft 521 to one of the members 501, 502 of the closure system. It will be readily appreciated that the support element 583 and the connection element 584 may be integrally formed. It will also be readily appreciated that more or fewer bolts 589 may be used to fix the connection element 584 to the support element 583.

In the illustrated embodiment, see in particular FIGS. 18A to 19B, hinge elements are provided between the mechanical connector 508 and the closure member 502 thereby enabling a smooth rotation of the closure member 502, including the tubular cylinder barrel 518, with respect to the shaft 521 that is fixedly connected to the support 501 through the intermediaries of the connection element 584 and the support element 583. The hinge elements include a roller bearing 586, in particular a steel roller bearing, that is mounted in a support member 587 that is placed on the connection element 584. The roller bearing 586 has an inner race 590 that is supported by the connection element 584, i.e. the inner race 590 both radially and axially engages the connection element 584. The roller bearing 586 has an outer race 591 that supports the support member 587, i.e. the outer race 591 both radially and axially engages the support member 587.

Mounting Aids

Figure 20:
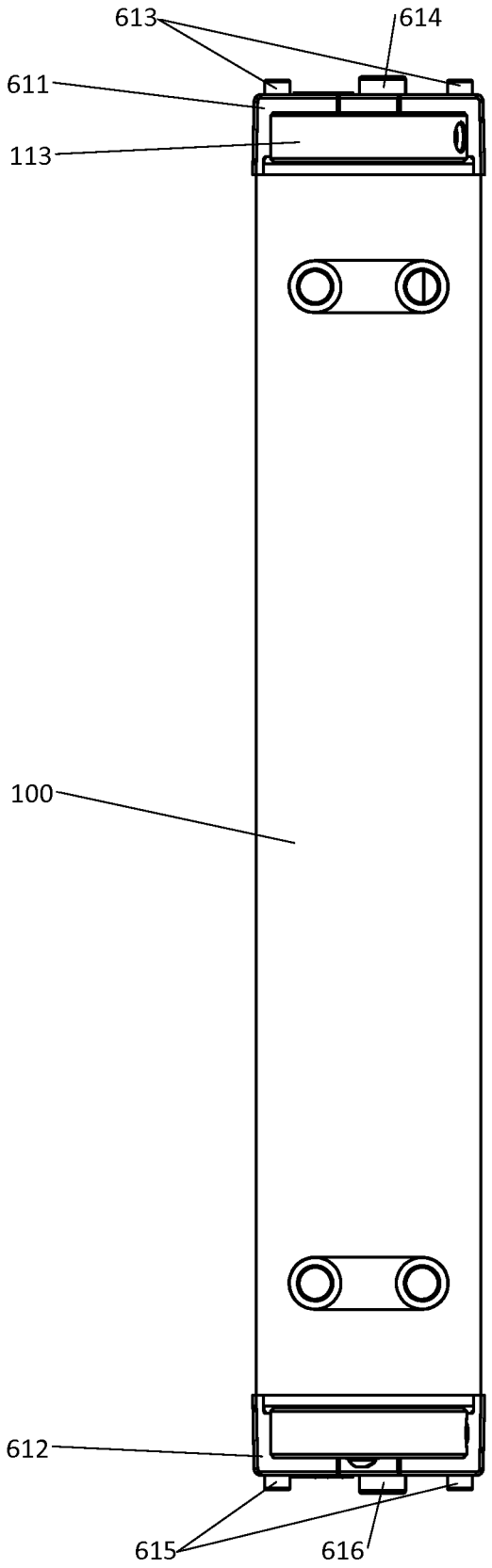
FIG. 20 shows a side view of the actuator in FIGS. 1A and 1B with mounting aids according to the present invention.
Figure 21A:
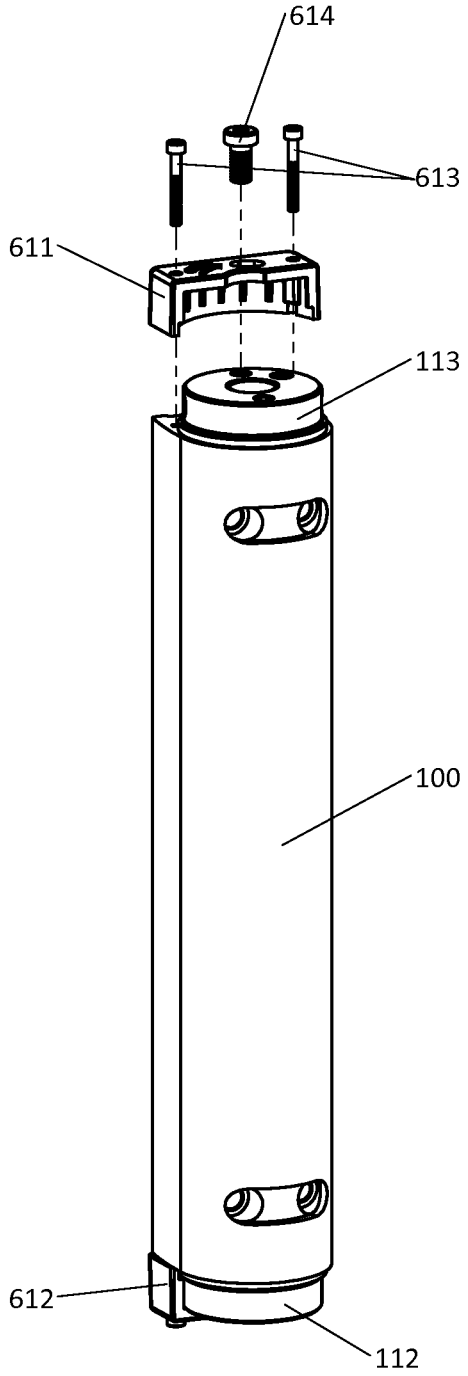
FIGS. 21A to 21C illustrate the various steps in mounting the actuator of FIG. 18 to the closure system.
Figure 21B:
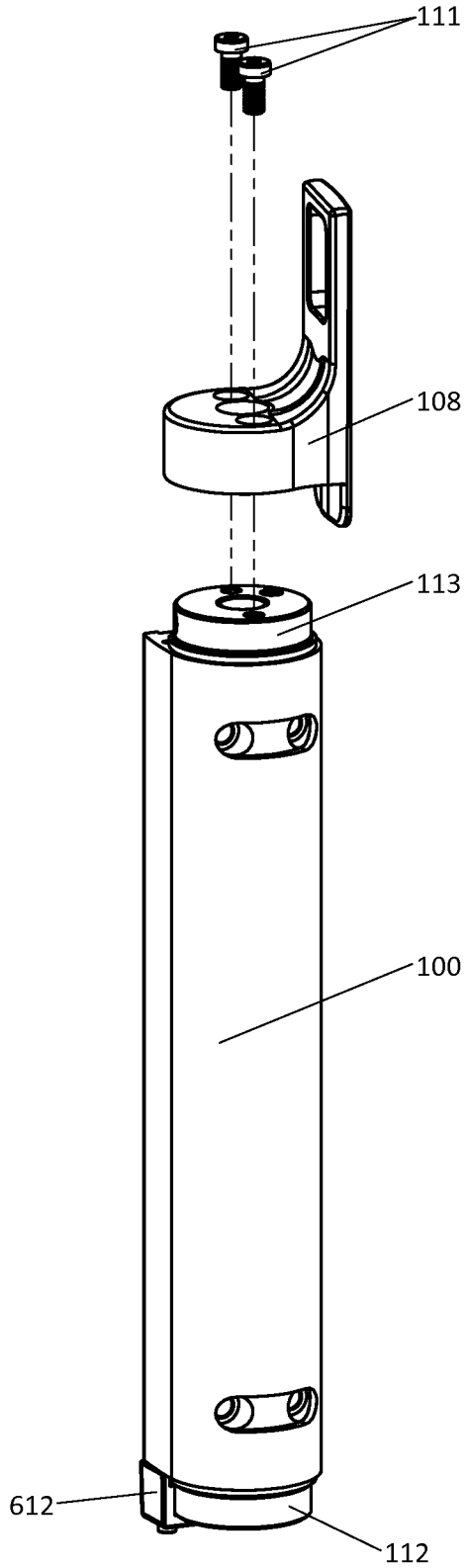
Figure 21C:
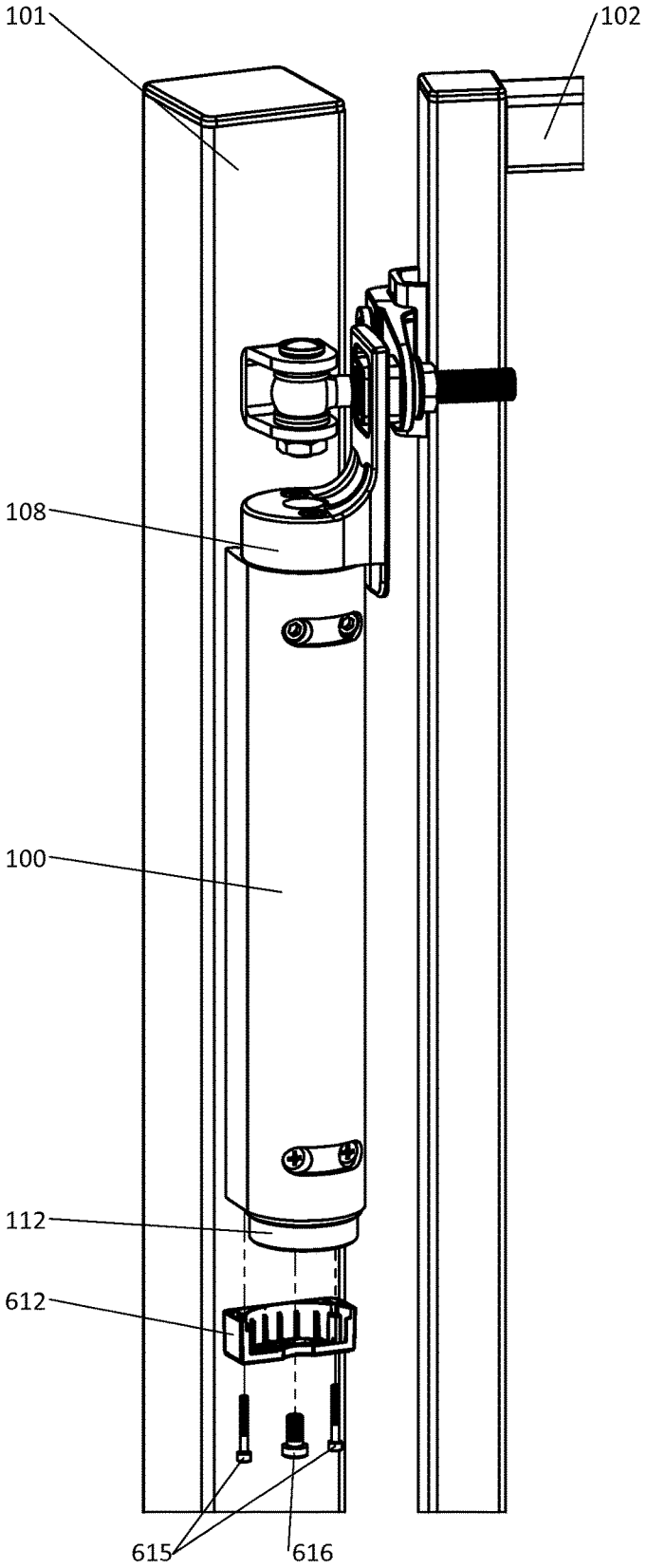
Figure 22:
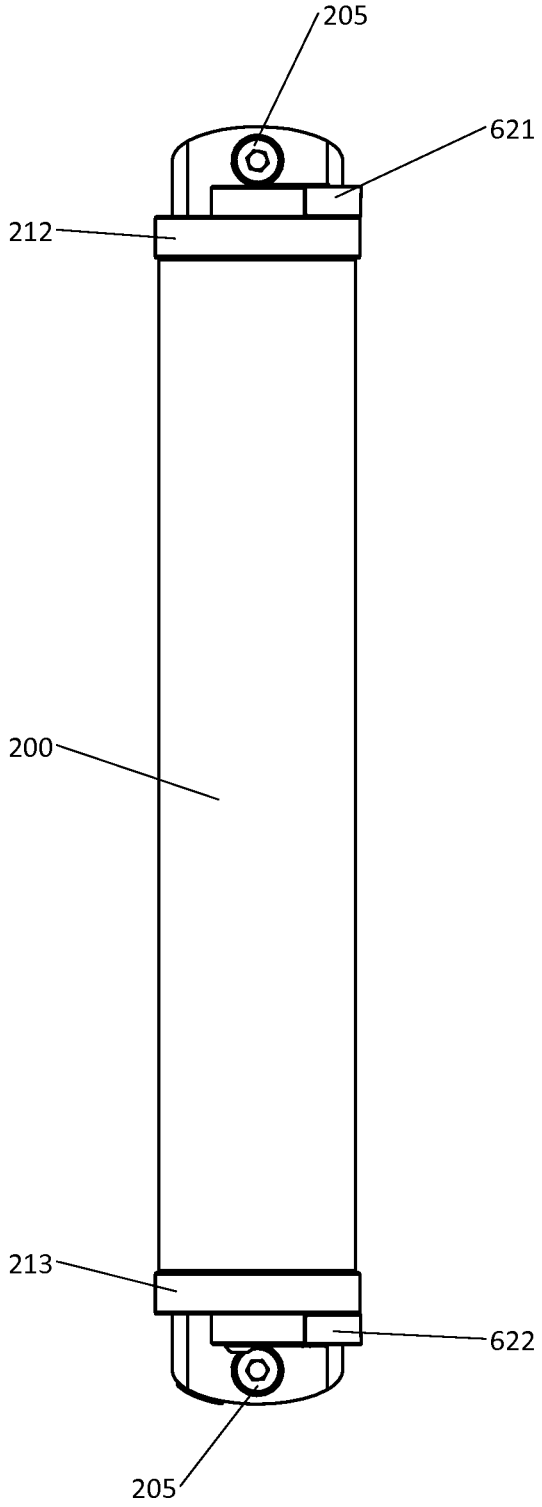
FIG. 22 shows a side view of the actuator of FIG. 8 with mounting aids according to the present invention.
Figure 23A:
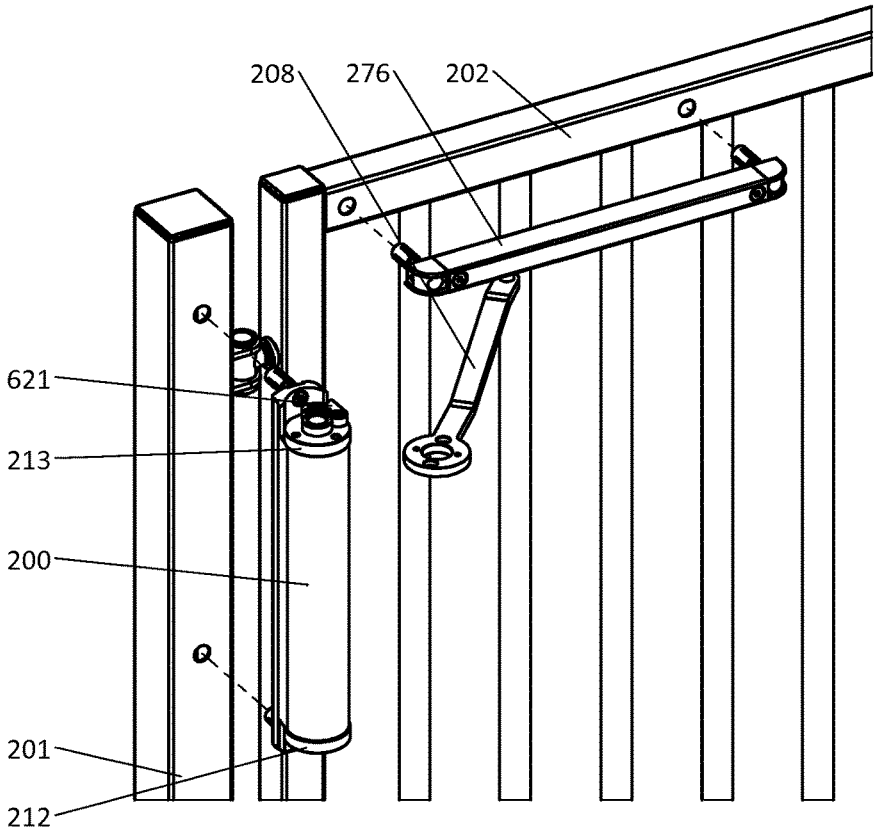
FIGS. 23A to 23D illustrate the various steps in mounting the actuator of FIG. 20 to the closure system.
Figure 23B:
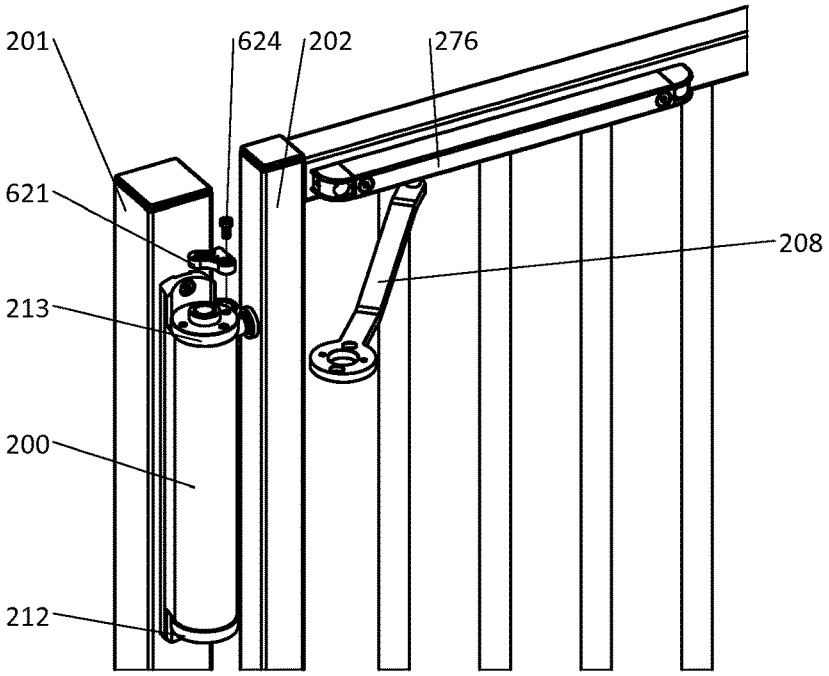
Figure 23C:
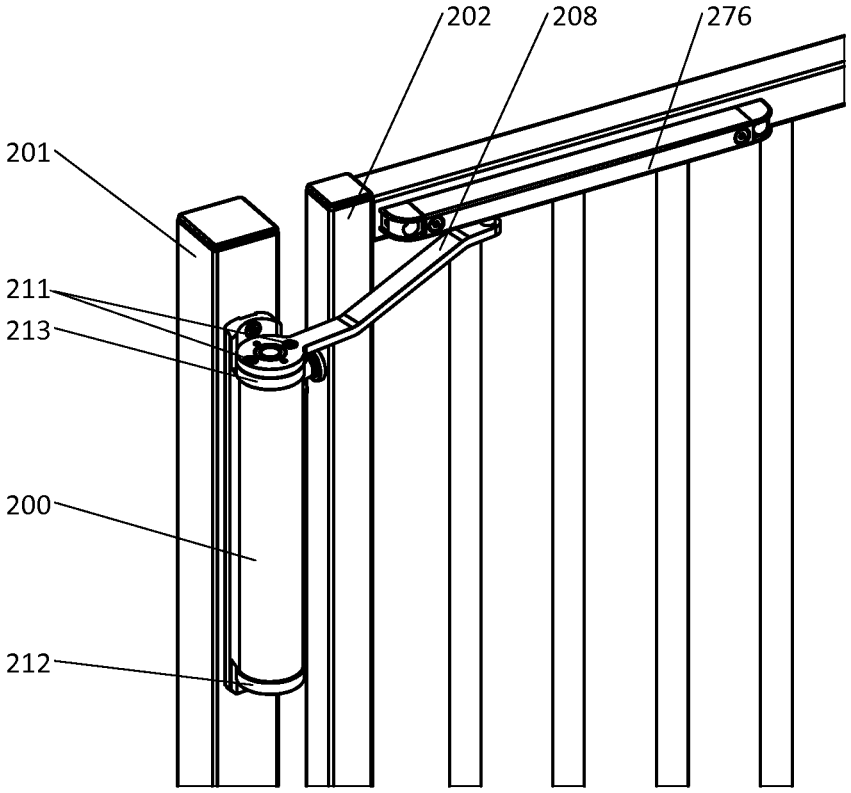
Figure 23D:
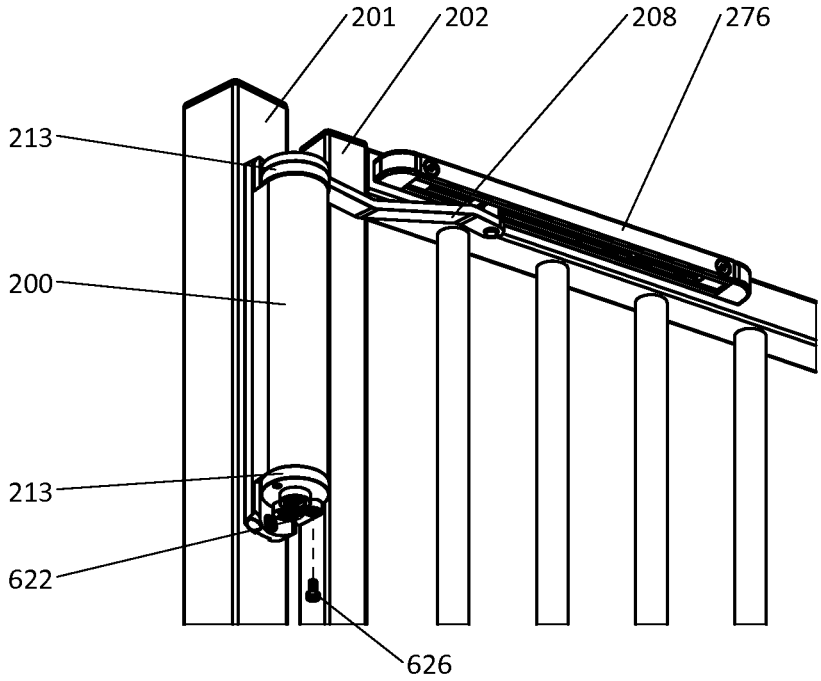
Figure 24:
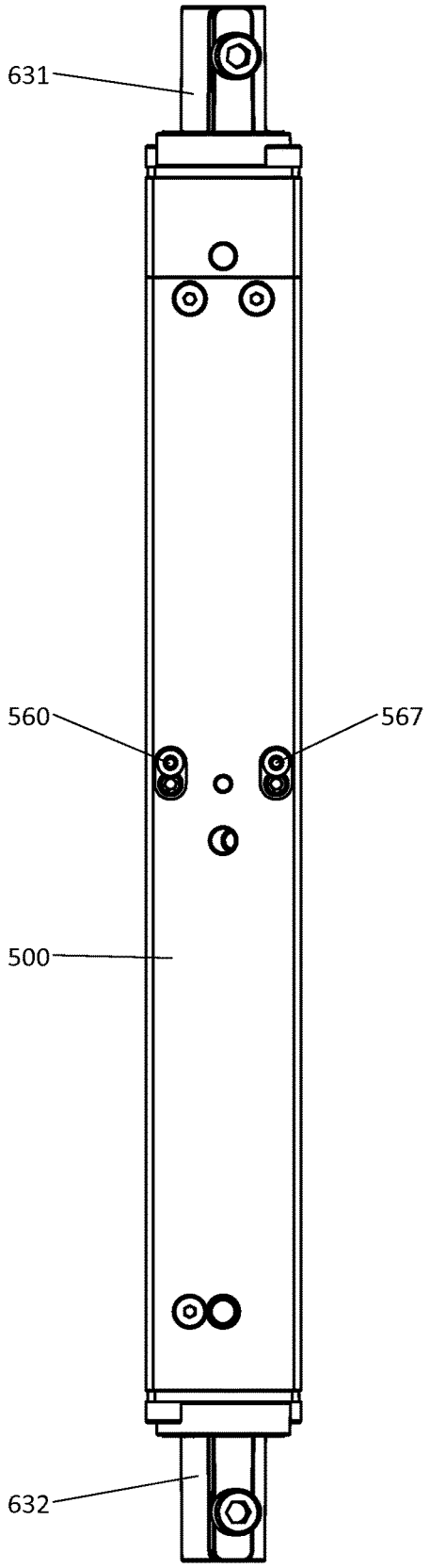
FIG. 24 shows a side view of the actuator of FIG. 8 with mounting aids according to the present invention.
Figure 25A:
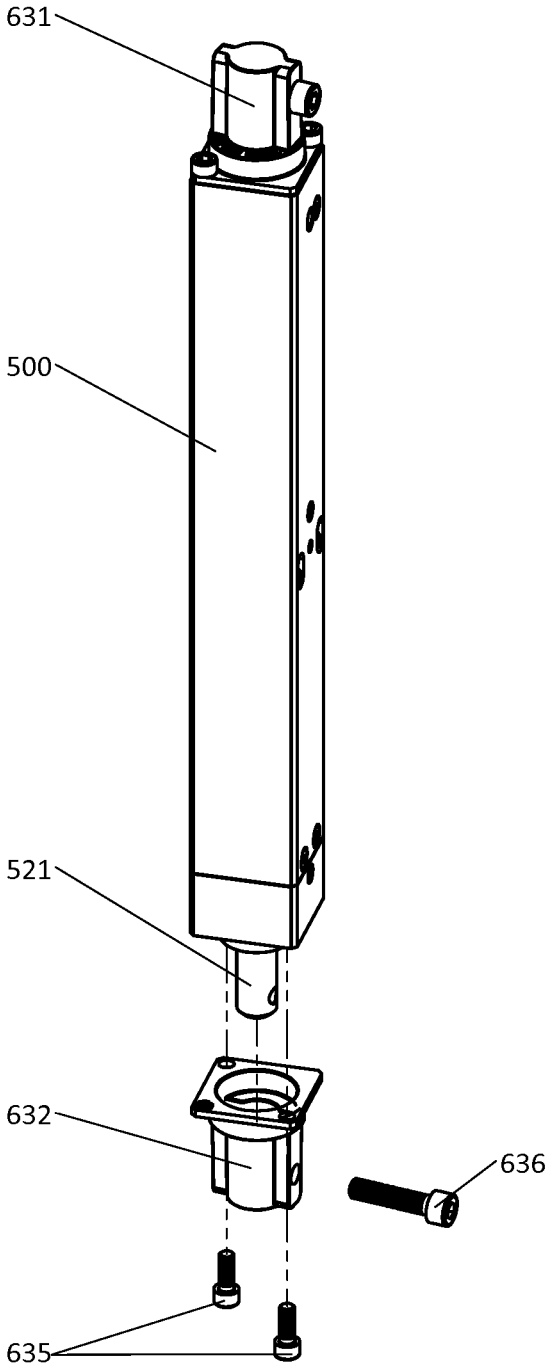
FIGS. 25A to 25E illustrate the various steps in mounting the actuator of FIG. 24 to the closure system.
Figure 25B:
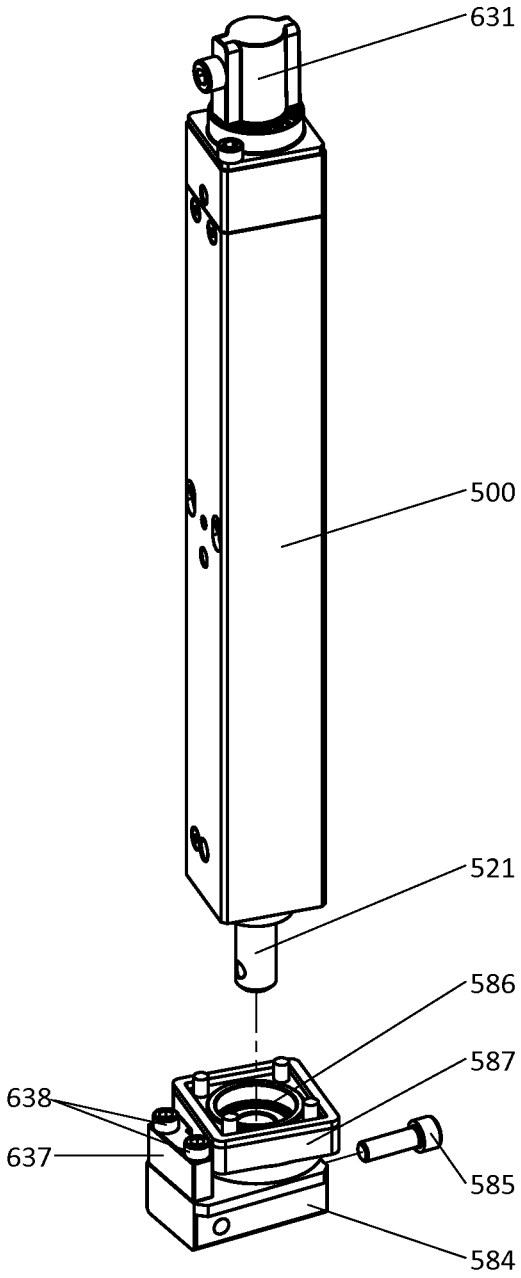
Figure 25C:
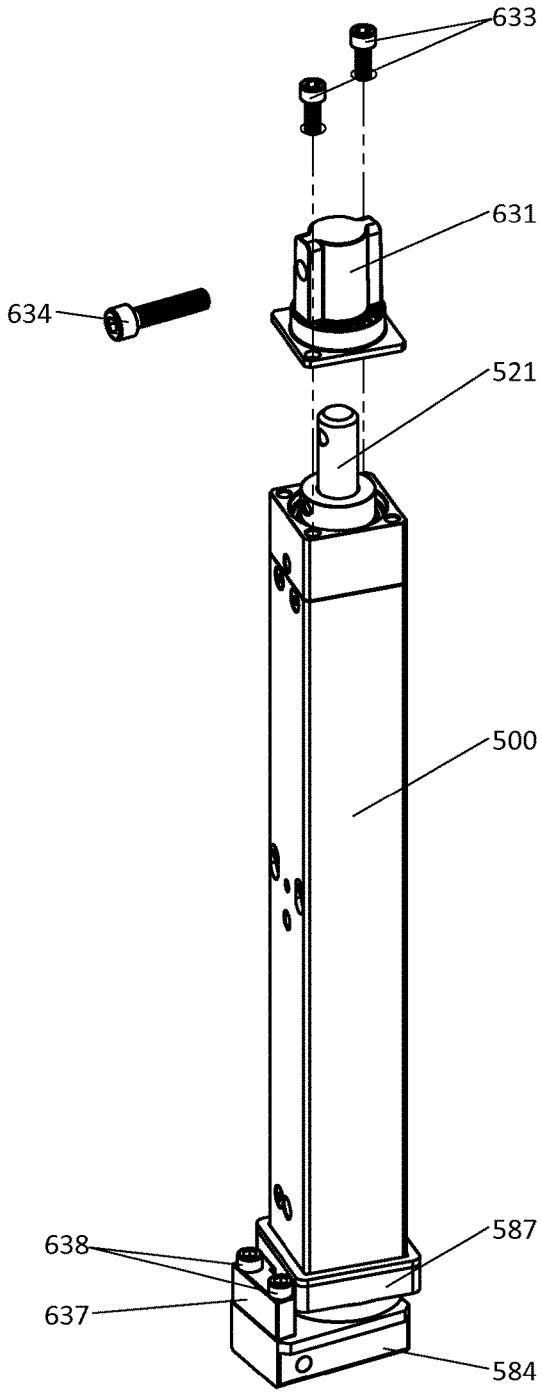
Figure 25D:
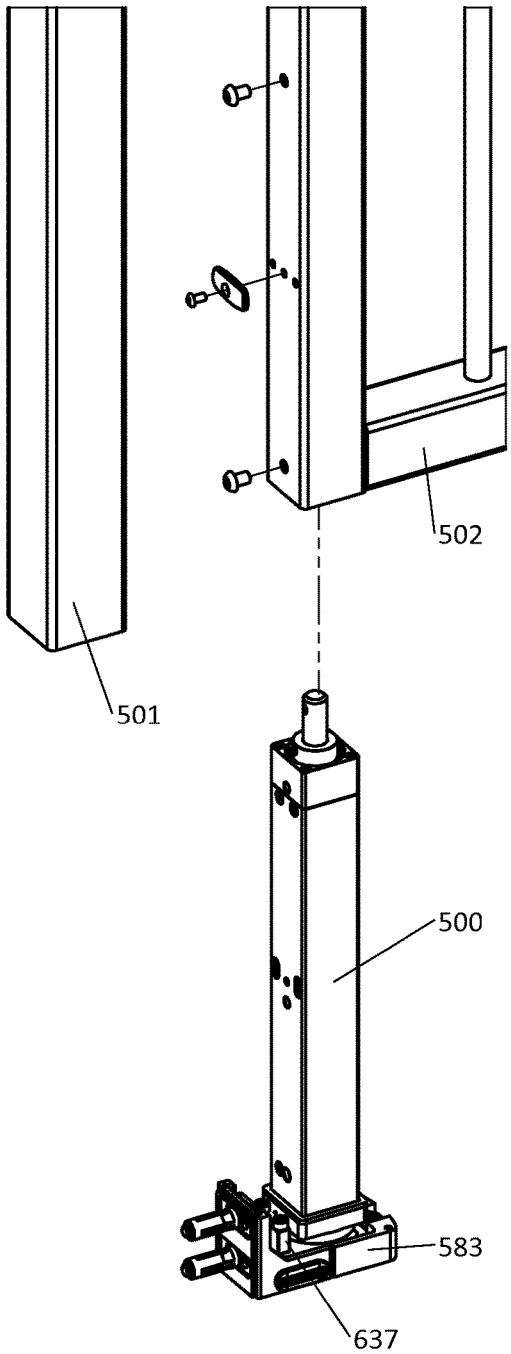
Figure 25E:
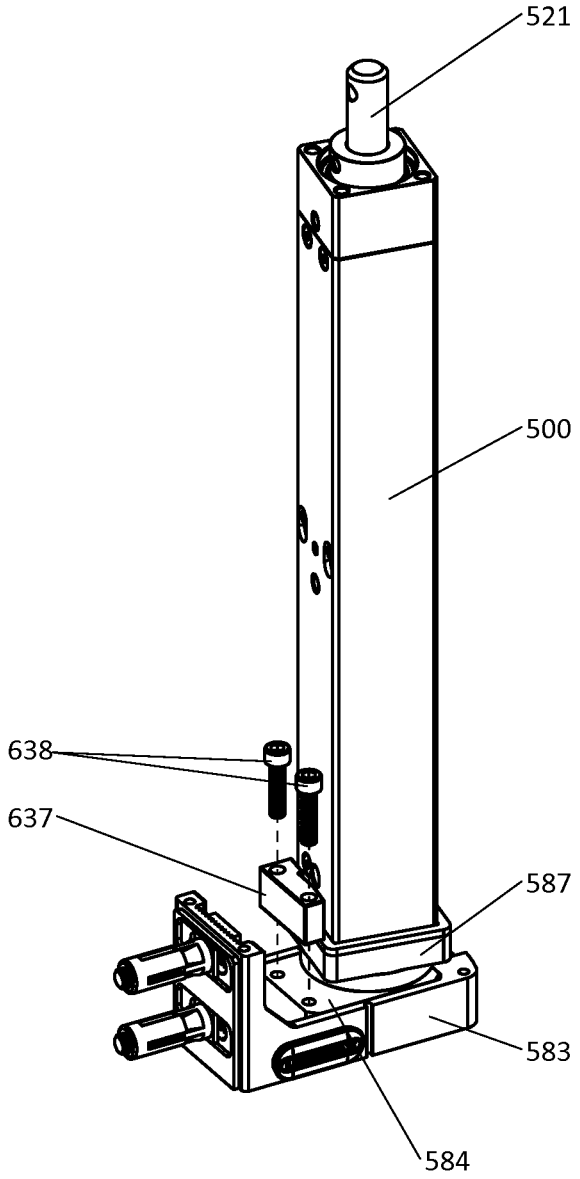

FIGS. 20 to 25E illustrate how the various actuators 100, 200, 300, 500 are to be mounted on the closure system using mounting aids according to the present invention. In particular, FIGS. 20 to 21C illustrate how the actuator 100 is mounted, FIGS. 22 to 23D illustrate how the actuator 200 is mounted, and FIGS. 24 to 25E illustrate how the actuators 300, 500 are mounted.

FIG. 20 illustrates the actuator 100 with the first and second mounting aids 611, 612 fixed on respective ones of the opposing ends of the main body 110. In particular, as illustrated in FIGS. 21A to 21C, the mounting aids 611, 612 are fixed to respective ones of the connection members 112, 113 by means of a bolt 614, 616 that is bolted into one of the holes 114. Furthermore, the mounting aids 611, 612 are fixed to the main body 110, and thus also to the tubular cylinder body 118, by means of two bolts 613, 615 which are bolted into holes provided in the main body 110, which holes are also used to mount the end-cap 116 as illustrated in FIGS. 2A and 2B. As described above, the connection members 112, 113 are irrotatably fixed to the shaft 121. As such, the mounting aids 611, 612 are removably interposed between the tubular cylinder body 118 and the shaft 121.

By bolting the mounting aids 611, 612 to both the connection members 112, 113 and the main body 110, and thus also to the tubular cylinder body 118, it is possible to maintain a specific position of the shaft 121 with respect to the tubular cylinder body 118. In other words, it is possible to maintain the shaft 121 in a rotated position such that the piston 147 is maintained in a position between its extreme positions before mounting the actuator 100 to the closure system.

It will be readily appreciated that more or fewer bolts 613, 614, 615, 616 may also be used to fix the mounting aids 611, 612 to the connection members 112, 113 and/or the tubular cylinder body 118. Furthermore, other means to temporarily fix the mounting aids 611, 612 to the connection members 112, 113 and/or the tubular cylinder body 118 are also be possible. For example, pins may be used instead of bolts.

FIG. 21A illustrates a first step in mounting the actuator 100 to a left-handed closure system, namely the removal of one of the mounting aids 611, 612. Which of the mounting aids 611, 612 that needs to be removed is dependent on the desired orientation of the actuator 100, i.e. upon the handedness of the closure system. The mounting aid 611 is removed by removing the bolts 613, 614 and subsequently the mechanical connector 108 is placed onto the connection member 113 as illustrated in FIG. 21B. As the second mounting aid 612 is still on the actuator 100, the shaft 121 is maintained in a rotated position, meaning that also the mechanical connector 108 is partially rotated with respect to the fully relaxed position of the actuator 100 determined by one of the most extreme positions of the piston 147.

Once the mechanical connector 108 has been placed onto the actuator 100, the actuator 100 is mounted to the closure system as illustrated in FIG. 21C. In particular, the actuator 100 is mounted on the support 101 and the mechanical connector 108 is affixed to the rod portion 104 of the eyebolt hinge 103. As illustrated in FIG. 21C, the closure system is partially opened in order to properly align the rod portion 104 of the eyebolt hinge 103 with the opening in the mechanical connector 108. In other words, the closure member 102 is rotated to achieve the necessary alignment, while the mechanical connector 108 remains stationary, which is advantageous as the closure member 102 is much easier to rotate compared to having to rotate the mechanical connector 108.

Once the actuator 100 is mounted to the closure system, the remaining mounting aid 612 is removed, in particular by removing the bolts 615, 616. This step releases the shaft 121 from its maintained position and will cause the closure system to close. Finally, the end-cap 116 may be mounted to close off the bottom of the actuator 100 as illustrated in FIG. 2A.

It will be readily appreciated that some of the steps in mounting the actuator 100 may be executed in a different order. For example, the actuator 100 may already be mounted onto the support 101 before any one of the mounting aids 611, 612 is removed.

FIG. 22 illustrates the actuator 200 with the first and second mounting aids 621, 622 fixed on respective ones of the opposing ends of the main body 210. In particular, as illustrated in FIGS. 23A to 23D, the mounting aids 621, 622 are fixed to respective ones of the connection members 212, 213 by means of a bolt 624, 626 that is bolted into one of the holes 214. Furthermore, the mounting aids 621, 622 are irrotatably positioned with respect to the main body 210, and thus also to the tubular cylinder body 218, by means of their shape. Specifically, the mounting aids 621, 622 abut against a protrusion of the main body 210 thereby avoiding that the shaft 221 can further rotate due to the energy storing mechanism. As described above, the connection members 212, 213 are irrotatably fixed to the shaft 221. As such, the mounting aids 621, 622 are removably interposed between the tubular cylinder body 218 and the shaft 221.

By bolting the mounting aids 621, 622 to the connection members 212, 213 and being in abutment with the main body 210, and thus also to the tubular cylinder body 218, it is possible to maintain a specific position of the shaft 221 with respect to the tubular cylinder body 218. In other words, it is possible to maintain the shaft 221 in a rotated position such that the piston 247 is maintained in a position between its extreme positions before mounting the actuator 200 to the closure system.

FIG. 23A illustrates a first step in mounting the actuator 200 to a left-handed closure system, namely mounting the actuator 200 to the support 201 and mounting the mechanical connector 208 with the rail 276 to the closure member 202. Subsequently, as illustrated in FIG. 21B, the mounting aid 621 is removed by removing the bolt 624. Which of the mounting aids 621, 622 that needs to be removed is dependent on the desired orientation of the actuator 200, i.e. upon the handedness of the closure system. As the second mounting aid 622 is still on the actuator 200, the shaft 221 is maintained in a rotated position, meaning that the connection member 213 is partly rotated. This can be seen when comparing to FIG. 9 which shows the actuator 200 in its fully relaxed position; notice the different position of the openings 214 with respect to the protrusion of the main body 210 in FIGS. 9 and 21B.

The rotated position of the connection member 213 ensures that the openings in the mechanical connector 208 align with the openings in the connection member 213 by opening the closure member 202. Once the mechanical connector 208 is attached to the actuator 200 (see FIG. 23C), the remaining mounting aid 622 is removed, in particular by removing the bolt 626 as illustrated in FIG. 23D. This step releases the shaft 221 from its maintained position and will cause the closure system to close.

It will be readily appreciated that some of the steps in mounting the actuator 200 may be executed in a different order. For example, the mounting aid 621 may already be removed before the actuator 200 is mounted onto the support 201.

FIG. 24 illustrates the actuator 500 with the first and second mounting aids 631, 632 fixed on respective ones of the opposing ends of the main body 510. It will be readily appreciated that the same mounting aids 631, 632 may also be used for the actuator 300. In particular, as illustrated in FIGS. 25A to 25E, the mounting aids 631, 632 are fixed to the shaft 521 by means of a bolt 634, 636 that is bolted through the shaft 521. Furthermore, the mounting aids 631, 632 are fixed to the main body 510, and thus also to the tubular cylinder body 518, by means of two bolts 633, 635 which are bolted into holes provided in the main body 510. As such, the mounting aids 631, 632 are removably interposed between the tubular cylinder body 518 and the shaft 521.

By bolting the mounting aids 631, 632 to the shaft 521 and the main body 510, and thus also to the tubular cylinder body 518, it is possible to maintain a specific position of the shaft 521 with respect to the tubular cylinder body 518. In other words, it is possible to maintain the shaft 521 in a rotated position such that the piston 547 is maintained in a position between its extreme positions before mounting the actuator 500 to the closure system.

FIG. 25A illustrates a first step in mounting the actuator 500 to a left-handed closure system, namely the removal of one of the mounting aids 631, 632. Which of the mounting aids 631, 632 that needs to be removed is dependent on the desired orientation of the actuator 500, i.e. upon the handedness of the closure system. The mounting aid 631 is removed by removing the bolts 635, 636 and subsequently (as illustrated in FIG. 25B) the support member 587 with the roller bearing 586 therein and the connection member 584 are placed onto the available extremity of the shaft 521 together with a further mounting aid 637 that maintains a rotated position of the support member 587 with respect to the connection member 584, which connection member 584 is part of the mechanical connector 508. In particular, the further mounting aid 637 is bolted to the connection member 584 by two bolts 638 and has an a-symmetrical shape designed to maintain the rotated position of the support member 587 with respect to the connection member 584.

This further mounting aid 637 ensures that the remaining mounting aid 631 may be removed as illustrated in FIG. 25C, in particular by removing the bolts 633, 634. The actuator 500 is now ready to be inserted into the closure member 502 as illustrated in FIG. 25D while still maintaining a rotated position of the tubular cylinder barrel 518, and thus the closure member 502, with respect to the connection member 584, and thus the mechanical connector 508 and the support 501.

Once the actuator 500 is mounted to the closure system, the further mounting aid 637 is removed, in particular by removing the bolts 638 as illustrated in FIG. 25E where the closure system is no longer drawn to improve the clarity of the drawing. This step releases the shaft 521 from its maintained position and will cause the closure system to close.

It will be readily appreciated that some of the steps in mounting the actuators 300, 500 may be executed in a different order.

The invention claimed is:

1. A hydraulically damped actuator for closing a closure system having a first member and a second member that are hingedly connected to each other, the actuator comprising:

a tubular cylinder barrel having a longitudinal axis, a first end, and a second end;

an energy storing mechanism inside the tubular cylinder barrel configured for storing energy when said closure system is being opened and for restoring said energy to effect closure of said closure system;

a hydraulic damping mechanism inside the tubular cylinder barrel configured for damping a closing movement of said closure system, the damping mechanism comprising a piston configured to be slidable within said tubular cylinder barrel between two extreme positions in the direction of said longitudinal axis;

a shaft that is rotatable with respect to said tubular cylinder barrel, said shaft having a first extremity, a second extremity, and a rotation axis that substantially coincides with said longitudinal axis, the shaft being configured for operatively coupling the energy storing mechanism and the damping mechanism; and a mechanical connector configured for operatively coupling the shaft to said second member, wherein said tubular cylinder barrel has a first tubular part and a second tubular part separated by an inner collar on the tubular cylinder barrel, the energy storing mechanism being located in said first tubular part and the damping mechanism being located in said second tubular part, wherein the first tubular part has an inner diameter which decreases from said first end towards the collar and the second tubular part has an inner diameter which decreases form said second end towards the collar.

2. A hydraulically damped actuator for closing a closure system having a first member and a second member that are hingedly connected to each other, the actuator comprising:

a tubular cylinder barrel having a longitudinal axis, a first end, and a second end;

an energy storing mechanism inside the tubular cylinder barrel configured for storing energy when said closure system is being opened and for restoring said energy to effect closure of said closure system;

a hydraulic damping mechanism inside the tubular cylinder barrel configured for damping a closing movement of said closure system, the damping mechanism comprising a piston configured to be slidable within said tubular cylinder barrel between two extreme positions in the direction of said longitudinal axis;

a shaft that is rotatable with respect to said tubular cylinder barrel, said shaft having a first extremity, a second extremity, and a rotation axis that substantially coincides with said longitudinal axis, the shaft being configured for operatively coupling the energy storing mechanism and the damping mechanism; and a mechanical connector configured for operatively coupling the shaft to said second member, wherein said tubular cylinder barrel has a first tubular part and a second tubular part separated by an inner collar on the tubular cylinder barrel, the energy storing mechanism being located in said first tubular part and the damping mechanism being located in said second tubular part, wherein the collar is formed by an annular element which is fixed within the tubular cylinder barrel.

3. A hydraulically damped actuator for closing a closure system having a first member and a second member that are hingedly connected to each other, the actuator comprising:

a tubular cylinder barrel having a longitudinal axis, a first end, and a second end;

an energy storing mechanism inside the tubular cylinder barrel configured for storing energy when said closure system is being opened and for restoring said energy to effect closure of said closure system;

a hydraulic damping mechanism inside the tubular cylinder barrel configured for damping a closing movement of said closure system, the damping mechanism comprising a piston configured to be slidable within said tubular cylinder barrel between two extreme positions in the direction of said longitudinal axis;

a shaft that is rotatable with respect to said tubular cylinder barrel, said shaft having a first extremity, a second extremity, and a rotation axis that substantially coincides with said longitudinal axis, the shaft being configured for operatively coupling the energy storing mechanism and the damping mechanism; and a mechanical connector configured for operatively coupling the shaft to said second member, wherein said tubular cylinder barrel has a first tubular part and a second tubular part separated by an inner collar on the tubular cylinder barrel, the energy storing mechanism being located in said first tubular part and the damping mechanism being located in said second tubular part, wherein the first tubular part, the second tubular part and the collar are integrally formed in the tubular cylinder barrel.

4. A hydraulically damped actuator for closing a closure system having a first member and a second member that are hingedly connected to each other, the actuator comprising:

a tubular cylinder barrel having a longitudinal axis a first end, and a second end;

an energy storing mechanism inside the tubular cylinder barrel configured for storing energy when said closure system is being opened and for restoring said energy to effect closure of said closure system;

a hydraulic damping mechanism inside the tubular cylinder barrel configured for damping a closing movement of said closure system, the damping mechanism comprising a piston configured to be slidable within said tubular cylinder barrel between two extreme positions in the direction of said longitudinal axis;

a shaft that is rotatable with respect to said tubular cylinder barrel, said shaft having a first extremity, a second extremity, and a rotation axis that substantially coincides with said longitudinal axis, the shaft being configured for operatively coupling the energy storing mechanism and the damping mechanism; and a mechanical connector configured for operatively coupling the shaft to said second member, wherein the shaft extends at least from said first end to said second through the tubular cylinder barrel, said tubular cylinder barrel being configured to be irrotatably fixed to the first member of the closure system with its longitudinal axis in a first orientation for a right-handed closure system and in a second orientation, opposite to the first orientation, for a left-handed closure system, and the mechanical connector being configured to be connected to the first extremity of the shaft when the tubular cylinder barrel is with its longitudinal axis in said first orientation and to the second extremity of the shaft when the tubular cylinder barrel is with its longitudinal axis in said second orientation, wherein the damping mechanism comprises:

a closed cylinder cavity which is filled with a volume of hydraulic fluid;

said piston which is disposed within the closed cylinder cavity so as to divide the closed cylinder cavity into a high pressure compartment and a low pressure compartment, the piston being operatively coupled to said shaft to be slidable between said two extreme positions;

a motion converting mechanism to convert a relative rotational motion of the shaft with respect to the tubular cylinder barrel into a sliding motion of the piston;

a one-way valve allowing fluid flow from the low pressure compartment to the high pressure compartment when said closure system is being opened; and at least one restricted fluid passage between the high pressure compartment and the low pressure compartment.

5. The actuator according to claim 4, wherein the actuator comprises at least one adjustable valve to regulate a flow of hydraulic fluid through said at least one restricted fluid passage.

6. The actuator according to claim 5, wherein said at least one restricted fluid passage is formed in the shaft and comprises a bore that extends substantially in the direction of said longitudinal axis and terminates in an end face of the shaft at the second extremity thereof, said at least one adjustable valve being placed in said bore.

7. The actuator according to claim 4, wherein said tubular cylinder barrel has a first tubular part and a second tubular part separated by an inner collar on the tubular cylinder barrel, the energy storing mechanism being located in said first tubular part and the damping mechanism being located in said second tubular part, wherein the first tubular part, the second tubular part and the collar are integrally formed in the tubular cylinder barrel.

8. A hydraulically damped actuator for closing a closure system having a first member and a second member that are hingedly connected to each other, the actuator comprising:

a tubular cylinder barrel having a longitudinal axis, a first end, and a second end;

an energy storing mechanism inside the tubular cylinder barrel configured for storing energy when said closure system is being opened and for restoring said energy to effect closure of said closure system;

a hydraulic damping mechanism inside the tubular cylinder barrel configured for damping a closing movement of said closure system, the damping mechanism comprising a piston configured to be slidable within said tubular cylinder barrel between two extreme positions in the direction of said longitudinal axis;

a shaft that is rotatable with respect to said tubular cylinder barrel, said shaft having a first extremity, a second extremity, and a rotation axis that substantially coincides with said longitudinal axis, the shaft being configured for operatively coupling the energy storing mechanism and the damping mechanism; and a mechanical connector configured for operatively coupling the shaft to said second member, wherein said tubular cylinder barrel has a first tubular part and a second tubular part separated by an inner collar on the tubular cylinder barrel, the energy storing mechanism being located in said first tubular part and the damping mechanism being located in said second tubular part, wherein the actuator comprises:

a first roller bearing interposed between the shaft and the tubular cylinder barrel, said first roller bearing having an inner race and an outer race, the inner race of the first roller bearing axially engaging a first transverse surface that is, in the direction of said longitudinal axis, in a fixed position with respect to the shaft, the outer race of the first roller bearing axially engaging a second transverse surface that is, in the direction of said longitudinal axis, in a fixed position with respect to the tubular cylinder barrel, the outer race of the first roller bearing preferably radially engaging said tubular cylinder barrel; and a second roller bearing interposed between the shaft and the tubular cylinder barrel, said second roller bearing having an inner race and an outer race, the inner race of the second roller bearing axially engaging a third transverse surface that is, in the direction of said longitudinal axis, in a fixed position with respect to the shaft, the outer race of the second roller bearing axially engaging a fourth transverse surface that is, in the direction of said longitudinal axis, in a fixed position with respect to the tubular cylinder barrel, the outer race of the second roller bearing preferably radially engaging said tubular cylinder barrel.

9. The actuator according to claim 8, wherein the actuator comprises:

a first connection member irrotatably fixed to said first extremity, in particular by a first member pin that is placed through the shaft and through the first connection member in a direction that is transverse to said longitudinal axis, said first connection member forming said first transverse surface, the inner race of the first roller bearing preferably radially engaging said first connection member; and a second connection member irrotatably fixed to said second extremity, in particular by a second member pin that is placed through the shaft and through the second connection member in a direction that is transverse to said longitudinal axis, the second member pin preferably being offset with respect to the rotation axis of the shaft, said second connection member forming said third transverse surface, the inner race of the second roller bearing preferably radially engaging said second connection member, and in that the mechanical connector is configured to be affixed to said first connection member when the tubular cylinder barrel is in said first orientation and to said second connection member when the tubular cylinder barrel is in said second orientation.

10. The actuator according to claim 9, wherein the first connection member comprises at least one right-handed orientation member, the second connection member comprises at least one left-handed orientation member, and the mechanical connector comprises at least one orientation member, said right-handed orientation member and said orientation member being configured such that, when the tubular cylinder barrel is with its longitudinal axis in said first orientation, the mechanical connector is oriented for a right-handed closure system, said left-handed orientation member and said orientation member being configured such that, when the tubular cylinder barrel is with its longitudinal axis in said second orientation, the mechanical connector is oriented for a left-handed closure system.

11. The actuator according to claim 4, wherein the shaft is integrally formed between its first and second extremity.

12. The actuator according to claim 4, wherein the energy storing mechanism comprises:

a first actuation member that is irrotatably fixed with respect to the tubular cylinder barrel;

a second actuation member that is irrotatably fixed with respect to the shaft and a torsion spring having a first end region connected to said first actuation member and a second end region connected to said second actuation member.

13. The actuator according to claim 4, wherein the tubular cylinder barrel is integrally formed.

14. The actuator according to claim 4, wherein the actuator further comprises:

a first mounting aid removably interposed between said first extremity and the tubular cylinder barrel to maintain the shaft in a partially rotated position with respect to the tubular cylinder barrel, said partially rotated position corresponding to a partially opened closure system; and a second mounting aid removably interposed between said second extremity and the tubular cylinder barrel to maintain the shaft in said partially rotated position with respect to the tubular cylinder barrel.

15. The actuator according to claim 7, wherein the motion converting mechanism comprises a rotation prevention mechanism to prevent rotation of the piston in the closed cylinder cavity, the rotation prevention mechanism comprising a guiding element that is bolted to said collar, the piston being irrotatably and slideably in the direction of said longitudinal axis coupled to the guiding element.

16. The actuator according to claim 4, wherein the shaft extends through said piston.

17. The actuator according to claim 8, wherein the first roller bearing is a double roller bearing, and the second roller bearing is a double roller bearing.

18. The actuator according to claim 1, wherein the collar is formed by an annular element which is fixed within the tubular cylinder barrel.

19. The actuator according to claim 1, wherein the first tubular part, the second tubular part and the collar are integrally formed in the tubular cylinder barrel.

20. The actuator according to claim 2, wherein a seal is pressed between the tubular cylinder barrel and the annular element or the annular element itself forms a seal.

21. The actuator according to claim 2, wherein the annular element is fixed within the tubular cylinder barrel by means of at least one bolt or pin which extends transversally through the tubular cylinder barrel.

* * * * *